US006337170B1

(12) United States Patent
Naruse

(10) Patent No.: US 6,337,170 B1
(45) **Date of Patent: *Jan. 8, 2002**

(54) COLOR DIFFUSION TRANSFER IMAGE FORMING MATERIAL

(75) Inventor: Hideaki Naruse, Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/089,228

(22) Filed: Jun. 3, 1998

(30) Foreign Application Priority Data

Jun. 6, 1997 (JP) ..... 9-165102

(51) Int. Cl.[7] ..... G03C 8/10; G03C 8/26; G03C 8/36; G03C 8/40; G03C 5/30

(52) U.S. Cl. ..... 430/203; 430/216; 430/218; 430/351; 430/380; 430/443; 430/959

(58) Field of Search ..... 430/203, 216, 430/218, 443, 959, 380, 351

(56) References Cited

U.S. PATENT DOCUMENTS

| | | | | | |
|---|---|---|---|---|---|
| 3,700,455 | A | * | 10/1972 | Ishikawa et al. | 430/551 |
| 4,021,240 | A | | 5/1977 | Cerquone et al. | 430/203 |
| 4,266,020 | A | * | 5/1981 | Sakai et al. | 430/216 |
| 4,358,525 | A | * | 11/1982 | Mooberry et al. | 430/218 |
| 4,367,272 | A | * | 1/1983 | Hayashi et al. | 430/216 |
| 4,426,441 | A | * | 1/1984 | Adin et al. | 430/566 |
| 4,554,243 | A | * | 11/1985 | Ono et al. | 430/959 |
| 4,590,152 | A | * | 5/1986 | Sato et al. | 430/351 |
| 4,789,623 | A | * | 12/1988 | Sato et al. | 430/203 |
| 4,840,870 | A | * | 6/1989 | Iwagaki et al. | 430/203 |
| 5,049,473 | A | * | 9/1991 | Furuya et al. | 430/203 |
| 5,071,740 | A | * | 12/1991 | Okauchi et al. | 430/203 |
| 5,830,625 | A | * | 11/1998 | Hirano | 430/959 |
| 6,004,736 | A | * | 12/1999 | Taguchi et al. | 430/543 |

FOREIGN PATENT DOCUMENTS

| | | | |
|---|---|---|---|
| JP | 60-128438 | 7/1985 | G03C/7/00 |
| JP | 8-110608 | 4/1996 | G03C/1/498 |
| JP | 8-122994 | 5/1996 | G03C/8/40 |
| JP | 8-146552 | 6/1996 | G03C/1/498 |

* cited by examiner

*Primary Examiner*—Richard L. Schilling
(74) *Attorney, Agent, or Firm*—Sughrue Mion, PLLC

(57) ABSTRACT

This invention provides a color diffusion transfer image forming material comprising a light-sensitive material containing a compound which forms or releases a diffusible dye upon reaction with a developing agent derived from a light-sensitive silver halide, aminopheno derivative or phenylenediamine derivative and an oxidation product of the developing agent supported on a first support, and a dye-fixing material containing a discoloration preventing agent having a specific structure supported on a second support which may be the same as or different from the first support, wherein the light-sensitive material and the dye-fixing material are located so that the diffusible dye formed or released by developing is at least transferred from the light-sensitive material to the dye-fixing material in developing the light-sensitive material, thereby providing the image forming material with excellent properties in terms of dye concentration, image fastness and the like.

12 Claims, No Drawings

COLOR DIFFUSION TRANSFER IMAGE FORMING MATERIAL

BACKGROUND OF THE INVENTION

1. Field of the Invention

The present invention relates to a color diffusion transfer image forming material.

2. Description of the Related Art

It is well known to form an image by heat developing a silver halide photography light-sensitive material. Such process is described, for example, in "Base for Photographic Technology (ed. By Non-Silver Salt Photography (1982), Corona Corp.)", pp. 242 to 255, U.S. Pat. No. 4,500,626 and the like. The method where a silver halide is used for a light-sensitive material has been widely effected since the material is excellent in photographic properties such as sensitivity and gradation as compared with methods such as an electrophotography method, diazo photography method and the like. There are a lot of methods suggested in which a color image is formed by heat development using a silver halide light-sensitive material. One of the methods may be a coloring developing method in which a dye image is formed by coupling reaction of an oxidation product of a developing agent with a coupler. Regarding the developing agent and coupler used in the color developing method, there have been suggested combination of p-phenylenediamines reducing agents with phenol or an active methylene coupler (see, U.S. Pat. No. 3,531,256), a p-aminophenol-based reducing agent (see, U.S. Pat. No. 3,761,270), combination of a sulfonamidephenol-based reducing agent with a tetra-equivalent coupler (see, U.S. Pat. No. 4,021,240), and the like.

However, the above-described method has defects such as undesired coloring of a undeveloped part due to an undeveloped silver halide remaining after the treatment through printing out or lapse of time, color clouding due to simultaneous existence of reduced silver and color image in an exposed part. Thus, in order to solve these defects, a dye transfer method in which a diffusible dye is formed by heat developing and transferred to a dye-fixing layer has been suggested.

Such a diffusion transfer type photosensitive material is generally classified into two types: 1) a dye-fixing layer which can receive a dye is supported on the same support as for a light-sensitive material and 2) a dye-fixing layer is supported on a different support from that for a light-sensitive material.

When used as a heat developing color light-sensitive material, it is desirable that a dye-fixing material supported on a different support from that for a light-sensitive material is used, in order to obtain a dye image with high color purity. In such a case, a dye is diffused and transferred, simultaneously with formation of a diffusible dye or after the formation of a diffusible dye by color development.

In a method where a diffusible dye is released or formed in image form by heat development and the diffusible dye is transferred to a fixing element, various kinds of dye donative compounds and silver halides can be used to obtain both a negative dye image and a positive dye image. The more details are described in U.S. Pat. Nos. 4,500,625, 4,483,914, 4,503,137 and 4,559,290, Japanese Patent Application Laid-Open (JP-A) Nos. 58-149,046, 60-133,449, 59-218,443 and 61-238,056, European Patent Application Laid-Open (EP-A) No. 220,746A2, Open Technical Publication No. 87-6199, EP-A No. 210660A2, and the like. However, these methods have a problem that sensitivity of a light-sensitive material is lowered since a color-developed dye is previously fixed to the dye donative substance. Therefore, it is preferable to realize a method in which a colorless coupler is first reacted with a developing agent and a subjected dye is diffused.

Regarding a process for forming an image according to the above-described coupling method, Japanese Patent Application Publication (JP-B) No. 63-36,487, JP-A Nos. 5-224,381 and 6-83,005, and the like disclose a color developing agent precursor which releases p-phenylenediamine and a light-sensitive material which contains a coupler. JP-A No. 59-111,148 discloses combination of a ureidoaniline-based reducing agent with an active methylene type coupler. JP-A No. 58-149,047 discloses a light-sensitive material using a coupler which has a polymer chain in a leaving group and which releases diffusible dye through color development.

However, color developing agents or precursors thereof used in these documents have problems that color image concentration after transfer is insufficient. In addition, increases in photo image fastness and stain during storage are remarkable. Therefore, there are needs to provide a technique which suffices fastness and transfer concentration simultaneously.

SUMMARY OF THE INVENTION

The object of the present invention is to provide a color diffusion transfer image forming material with excellent color image concentration and image fastness.

Further, the object of the present invention is to provide a color diffusion transfer image forming material with excellent color image concentration and image fastness, which can suffice fastness and transfer concentration simultaneously.

The inventors have found that the object of the present invention can be solved by the following methods i) to iv).

i) A color diffusion transfer image forming material comprising a light-sensitive material and a dye-fixing material, wherein the light-sensitive material comprises a first support having thereon a light-sensitive silver halide, a binder, a first compound represented by general formula (I) described below, and a second compound that forms or releases a diffusible dye by reacting with the oxidation product of the first compound, wherein the dye-fixing material comprises at least a dye-fixing layer, wherein the dye-fixing layer or an adjacent layer contains at least one of a third compound represented by general formula (II), (III), (IV), (V) or (VI) described below, and wherein the dye-fixing material is coated on the first support or on a separate support, and the light-sensitive material and the dye-fixing material are located so that the diffusible dye is transferred from the light-sensitive material to the dye-fixing material when the light-sensitive material is developed after exposure:

(I)

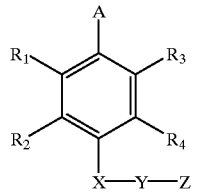

In the formula (I), each of $R_1$ to $R_4$ represents independently a hydrogen atom or substituent. A represents a hydroxyl group or substituted amino group. X represents a group selected from the group consisting of —NHCO—, —NHSO—, —$NHSO_2$—, and —NHPO<. Y represents a divalent connecting group. z represents a nucleophilic group which can attack X, when oxidized. $R_1$ and $R_2$ may be linked to each other to form a ring. $R_3$ and $R_4$ may be linked to each other to form a ring.

(II)

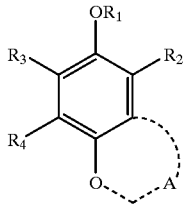

In the formula (II), $R_1$ represents a hydrogen atom, an alkyl group, an acyl group, a sulfonyl group, a carbamoyl group, a sulfamoyl group, an alkoxycarbamoyl group or a trialkylsilyl group.

A represents a group of non-metal atoms necessary to form a 5-membered or 6-membered ring with —C═C—O—. Each of $R_2$, $R_3$ and $R_4$ represents independently a hydrogen atom, an alkyl group, a cycloalkyl group, an alkoxy group, an aryl group, an aryloxy group, an aralkyl group, an aralkyloxy group, an alkenyl group, an alkenoxy group, an acylamino group, a halogen atom, an alkylthio group, a diacylamino group, an arylthio group, an alkoxycarbonyl group, an acyloxy group, an acyl group or a sulfonamide group.

(III)

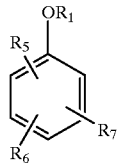

In the formula (III), $R_1$ represents a hydrogen atom, an alkyl group, an acyl group, a sulfonyl group, a carbamoyl group, a sulfamoyl group, an alkoxycarbamoyl group or a trialkylsilyl group.

$R_5$ represents an alkyl group, an alkoxy group, an alkoxycarbonyl group, an arylthio group, an arylsulfinyl group, an arylsulfonyl group, an aralkyl group, a halogen atom, an aryl group or an acyl group.

$R_6$ represents a hydrogen atom, an alkyl group, an alkoxy group (provided that $R_1O$— and $R_6$ never represent the same substituent), an aralkyloxy group, an alkylthio group, an aralkylthio group, an acylamino group, an acyl group, an alkylamino group, an arylamino group or a heterocyclic amino group. $R_7$ represents a hydrogen atom, a halogen atom, an alkyl group, an arylthio group, an alkylthio group, an arylsulfonyl group, an arylsulfinyl group, an aralkyl group, an aryl group, an aryldithio group or an aryloxy group.

(IV)

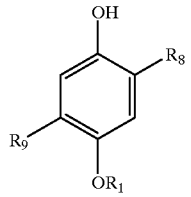

In the formula (IV), $R_1$ represents a hydrogen atom, an alkyl group, an acyl group, a sulfonyl group, a carbamoyl group, a sulfamoyl group, an alkoxycarbamoyl group or a trialkylsilyl group. $R_8$ represents a hydrogen atom, an alkyl group or an alkenyl group. $R_9$ represents an alkyl group or an alkenyl group.

(V)

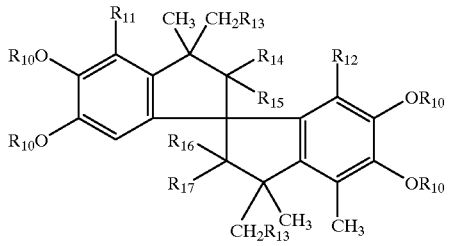

In the formula (V), $R_{10}$ represents an alkyl group, an alkenyl group, an aryl group, an aralkyl group, a heterocyclic group or a group represented by $R_{18}CO$, $R_{19}SO_2$ or $R_{20}NHCO$ wherein each of $R_{18}$ to $R_{20}$ represents independently an alkyl group, an alkenyl group, an aryl group or a heterocyclic group. Each of $R_{11}$ and $R_{12}$ represents independently a hydrogen atom, a halogen atom, an alkyl group, an alkenyl group, an alkoxy group or an alkenoxy group. Each of $R_{13}$ to $R_{17}$ represents independently a hydrogen atom, an alkyl group, an alkenyl group or an aryl group.

(VI)

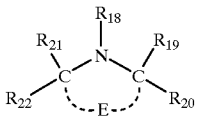

In the formula (VI), E represents a group of non-metal atoms necessary to form a 5 to 7-membered ring with C and N. $R_{18}$ represents a hydrogen atom, an alkyl group, an alkenyl group, an alkynyl group, an acyl group, a sulfonyl group, a sulfinyl group, an oxyradical group or a hydroxyl group. Each of $R_{19}$, $R_{20}$, $R_{21}$ and $R_{22}$ represents independently a hydrogen atom or an alkyl group.

ii) The color diffusion transfer image forming material in the above described invention i), wherein the third compound represented by the general formula (III) is a compound represented by the general formula (III') described below.

(III')

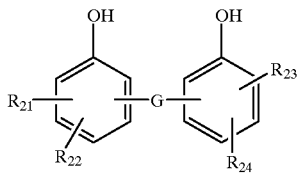

In the formula (III'), G represents —S—, —S—S—, —O—, $—CH_2—S—CH_2—$, $—SO_2—$, —SO—, $—(CH_2)_n—CO—(CH_2)_m—CO—(CH_2)_n—$, $—(CH_2)_n—CO_2—(CH_2)_m—CO_2—(CH_2)_n—$, $—CH_2—O—CH_2—$, $—N(R_{25})—$, $—C(R_{26})(R_{27}))_m—$ wherein each of n and m represents independently an integer of 1 or more, or the following structure.

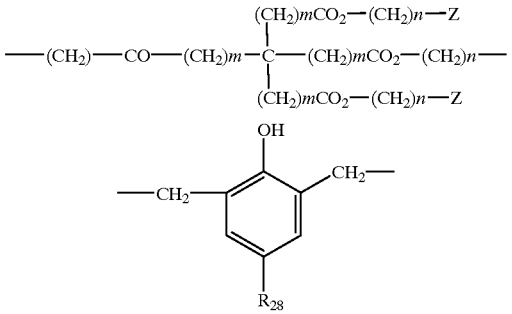

Each of $R_{21}$ to $R_{24}$ represents independently a hydrogen atom, an alkyl group, an aryl group, an aralkyl group, an alkylthio group, a halogen atom, an alkoxy group, an arylthio group, an aralkyloxy group, $—COOR_{29}$, $—NHCOR_{29}$, $—NHSO_2R_{29}—SO_2R_{29}$, $—O—COR_{29}$, $—N(R_{30})(R_{31})$ or $—CH_2—N(R_{30})(R_{31})$. $R_{25}$ represents a hydrogen atom, an alkyl group or an aryl group. Each of $R_{26}$ and $R_{27}$ represents independently a hydrogen atom, an alkyl group, an aryl group or a substituted 5- or 6-membered ring formed by mutual bonding thereof.

$R_{28}$ represents a hydrogen atom or a methyl group. $R_{29}$ represents an alkyl group or an aryl group, $R_{30}$ and $R_{31}$ represent each independently a hydrogen atom, an alkyl group, an aryl group, a heterocycle, an aralkyl group or a heterocyclic 5- or 6-membered ring having any substituent described above formed by mutual bonding thereof. Z represents a substituted phenol.

iii) The color diffusion transfer image forming material in the above described invention i) or ii), wherein the light-sensitive material is developed by heating in the presence of a base and/or a base precursor.

iv) The color diffusion transfer image forming material in any of the above described inventions i) to iii), wherein the dye-fixing material is coated on the separate support, and wherein after the light-sensitive material is exposed, the dye-fixing material is located onto the light-sensitive material so that the dye-fixing layer faces the light-sensitive silver halide layer.

When the light-sensitive material is developed after exposure, the diffusible dye produced is transferred to the dye-fixing layer, whereby a color diffusion transfer image with excellent dye concentration and image fastness is provided.

DESCRIPTION OF THE PREFERRED EMBODIMENTS

The color diffusion transfer image forming material of the present invention comprises a light-sensitive material and a dye-fixing material. The light-sensitive material comprises at least one light-sensitive silver halide layer on a first support, wherein said layer or other constituent layers contain a light-sensitive silver halide, a binder, a first compound represented by the formula (I), and a second compound that forms or releases a diffusible dye by reacting with an oxidation product of the first compound. The dye-fixing material comprises at least one dye-fixing layer supported on the first support or on a separate support, and the dye-fixing layer or an adjacent layer contains at least one compound represented by the general formula (II), (III), (IV), (V) or (VI).

When the support of the light-sensitive material is the same as that of the dye-fixing material, the dye-fixing layer is coated on the support of the light-sensitive material, and the dye-fixing layer is provided on such position that a diffusible dye can be transferred thereto, i.e., the dye-fixing layer is provided on the same side for the light-sensitive silver halide layer.

When used as a heat developing color light-sensitive material, it is preferable that the light-sensitive material and the dye-fixing material are provided on separate supports. In this case, after exposure of the light-sensitive material, the light-sensitive material and the dye-fixing material are laminated so that the dye-fixing layer faces the light-sensitive silver halide layer. In this procedure, the diffusible dye is transferred from the light-sensitive material to the dye-fixing material.

It is preferable that the first compound (a color developing agent) and the second compound (a coupler) are contained in the light-sensitive silver halide layer or an adjacent light-insensitive layer, and it is particularly preferable that the both compounds are contained in the same light-sensitive silver halide layer.

The compound represented by the general formula (I) will be described in detail below.

The compound represented by the above-described general formula (I) is a developing agent classified to aminophenol derivatives and phenylenediamine derivatives. In the general formula (I), each of $R_1$ to $R_4$ independently represents a hydrogen atom or substituent. Examples thereof may include a halogen atom (such as chloro and bromo groups), an alkyl group (such as methyl, ethyl, isopropyl, n-butyl and t-butyl groups), an aryl group (such as phenyl, tolyl and xylyl groups), a carbonamide group (such as acetylamino, propionylamino, butyloylamino and benzoylamino groups), a sulfonamide group (such as methanesulfonylamino, ethanesulfonylamino, benzenesulfonylamino and toluenesulfonylamino groups), an alkoxy group (such as methoxy and ethoxy groups), an aryloxy group (such as a phenoxy group), an alkylthio group (such as methylthio, ethylthio and butylthio groups), an arylthio group (such as phenylthio and tolylthio groups), a carbamoyl group (such as methylcarbamoyl, dimethylcarbamoyl, ethylcarbamoyl, diethylcarbamoyl, dibutylcarbamoyl, piperidinocarbamoyl, morpholinocarbamoyl, phenylcarbamoyl, methylphenylcarbamoyl, ethylphenylcarbamoyl and benzylphenylcarbamoyl groups), a sulfamoyl group (such as methylsulfamoyl, dimethylsulfamoyl, ethylsulfamoyl, diethylsulfamoyl, dibutylsulfamoyl, piperidinosulfamoyl, morpholinosulfamoyl, phenylsulfamoyl, methylphenylsulfamoyl, ethylphenylsulfamoyl and benzylphenylsulfamoyl groups), a cyano group, a sulfonyl group (such as methanesulfonyl, ethanesulfonyl, phenylsulfonyl, 4-chlorophneylsulfonyl and p-toluenesulfonyl groups), an alkoxycarbonyl group (such as methoxycarbonyl, ethoxycarbonyl and butoxylcarbonyl groups), an aryloxycarbonyl group (such as a phenoxycarbonyl group), an acyl group (such as acetyl, propionyl, butyloyl, benzoyl and alkylbenzoyl groups), aureido group (such as methylaminocarbonamide and diethylaminocarbonamide groups), a urethane group (such as methoxycarbonamide and butoxycarbonamide groups), an acyloxy group (such as acetyloxy, propionyloxy and butyloxy groups) and the like. Among $R_1$ to $R_4$, $R_2$ and/or $R_4$ preferably represents a hydrogen atom. When A represents a hydroxy group, the total of Hammett's constants $\sigma_p$ of $R_1$ to $R_4$ is preferably 0 or more. When A represents a substituted amino group, the total of Hammett's constants $\sigma_p$ of $R_1$ to $R_4$ is preferably 0 or less.

A represents a hydroxy group or substituted amino group (such as dimethylamino, diethylamino and ethylhydroxyethylamino groups), and preferably a hydroxy group. X represents a group selected from the group consisting of —NHCO—, —NHSO—, —$NHSO_2$—, and —NHPO<, and among them, —NHCO—, —$NHSO_2$—, and —NHPO< are preferable. Z represents a nucleophilic group. The present compound represented by formula (I) reduces a silver halide to obtain an oxidation product of the present compound. The oxidation product is coupled with a coupler. Then, the nucleophilic group represented by Z functions as nucleophilic attacking group on a carbon atom, sulfur atom or phosphorus atom of X to form a dye. In the nucleophilic group, those which exhibit nucleophilicity are atoms having an unshared electron pair (for example, a nitrogen atom, phosphorus atom, oxygen atom, sulfur atom, selenium atom and the like) and anion species (for example, a nitrogen anion, oxygen anion, carbon anion, sulfur anion) as is general in the field of organic chemistry. Examples of the nucleophilic group may include groups having partial structures listed below and dissociations thereof. In the following structures, an atom underlined has a nucleophilicity.

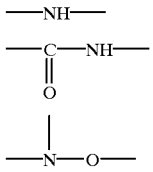

-continued

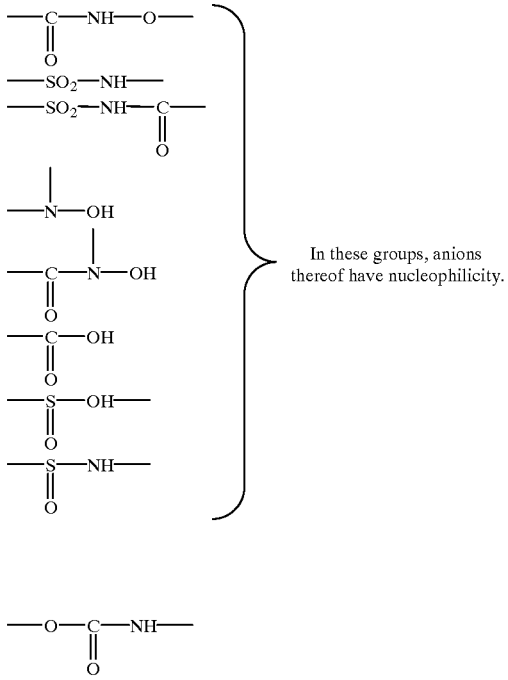

Preferably, Z may be the following groups.

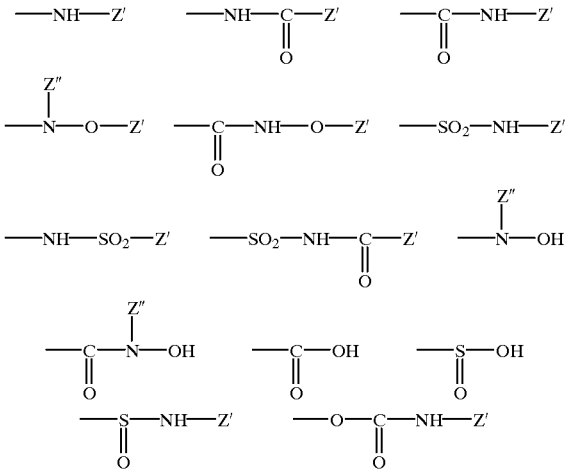

wherein Z' and Z" represent a hydrogen atom or substituent. The substituent may be the same as described above in $R_1$. Preferably, the substituent may be alkyl groups, more preferably —NH—Z', —NH—CO—Z', —CO—NH—Z', —$SO_2$—NH—Z' and —NH—$SO_2$—Z', most preferably —NH—CO—Z' and —CO—NH—Z'.

Y represents a bivalent connecting group. The connecting group means a group which connects Z in such manner that Z can intramolecularly, nucleophilically attack X via Y, conveniently. Practically, it is preferable that atoms are connected so that a ring composed of 5 to 6 atoms is constructed under transition condition when the nucleophilic group effects nucleophilic attack on X.

Preferably, the connecting group Y may be an alkylene groups such as methylene, 1,2- or 1,3-alkylene and 1,2-cycloalkylene group, alkenylene groups such as vinylene group, arylene group such as 1,2-phenylene group and 1,8-naphthylene group, divalent heterocyclic groups such as 2,3-pyridinediyl group, aralkyl groups such as 1,2-phenylmethylene group, and the like. These groups may be substituted. Examples of the substituent maybe same as defined in the above-described $R_1$. $R_1$ and $R_2$ may be linked to each other to form a ring. Also, $R_3$ and $R_4$ may be linked to each other to form a ring.

In a process for adding a developing agent represented by the general formula (I), a coupler, a developing agent and an organic solvent having high boiling point (such as alkyl phosphate, alkyl phthalate and the like) can be first mixed and dissolved in an organic solvent having low boiling point (such as ethyl acetate, methyl ethyl ketone and the like). Then, the resulting mixture is dispersed in water using a emulsifying dispersion method known in the field prior to addition. Further, the addition, which is conducted according to a solid dispersion method described in JP-A No. 63-271339, may be used in the present invention.

The compound represented by the general formula (I) is preferably an oil-soluble compound if added by the emulsion dispersion method of the above-described addition methods. Therefore, the compound may contain at least one group having ballasting property. The ballast group herein referred to represents an oil solubilizing group, and it is a group containing oil-soluble partial structure, having 8 to 80 carbon atoms, preferably 10 to 40 carbon atoms. Thus, a ballast group having 8 or more carbon atoms may be contained in any one of $R_1$ to $R_4$, X, Y and Z. Preferably, the ballast group may be contained in either Y or Z. The number of carbon atoms in the ballast group may be preferably from 8 to 80, more preferably from 8 to 20.

The amount added of the developing agent represented by the general formula (I) may vary within wide range. The amount may be preferably from 0.001 to 1000 mmol/$m^2$, more preferably from 0.01 to 50 mmol/$m^2$.

The developing agent of the present invention can be synthesized by several organic synthesis reactions. Typical compound synthesis examples are described below.

<Synthesis of Developing Agent D-1>

A developing agent D-1 was synthesized by a synthesis route according to the following Scheme-1.

Scheme-1

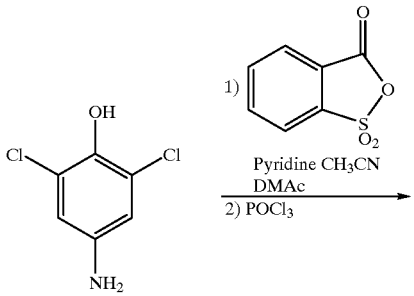

-continued

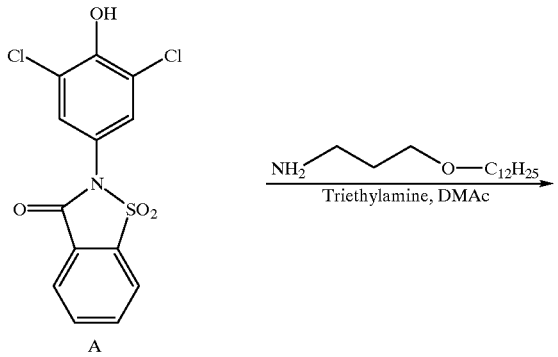

A

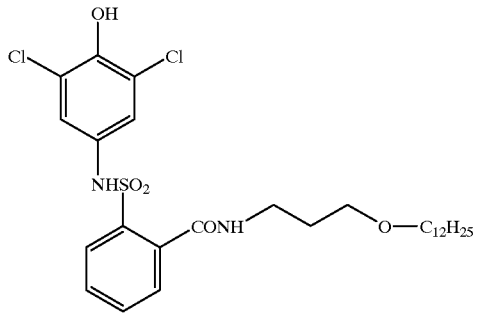

D-1

(1) Synthesis of Compound A

Into a 2 L three-necked flask equipped with a condenser and thermometer were charged 600 ml of acetonitrile and 178 g (1 mol) of 2,6-dichloro-4-aminophenol. The mixture was kept at −0° C. or lower with stirring on a methanol-ice bath. When 81 ml (1 mol) of pyridine was added to the mixture with passing nitrogen flow, the solution became uniform and heat was generated. Under condition that the temperature had been lowered to 5° C. or lower, a solution of 184 g (1 mol) of o-sulfo benzoic anhydride in 250 ml of N,N-dimethylacetamide (DMAc) was added carefully so that the temperature in the flask did not exceed 35° C. After adding, the reaction was conducted for further 1 hour with stirring in a room temperature. Then, to this was added dropwise 200 g (1.3 mol) of phosphorus oxychloride. Heat was generated by this addition, and the inner temperature increased up to about 60° C. The temperature was kept from 60 to 70° C. by a hot bath, and the mixture was further reacted for 5 hours with stirring. After the reaction, the reaction mixture was poured into 10 liter of ice water, and the precipitated crystal was filtered off. This crude crystal was re-crystallized from a mixed solvent of acetonitrile-DMAc, to obtain 300 g of a crystal of a compound A (yield: 87%).

(2) Synthesis of Developing Agent D-1

Into a 1 L three-necked flask equipped with a condenser and thermometer were charged 172 g (0.5 mol) of the compound A, 600 ml of DMAc, 140 ml (1 mol) of triethylamine and 122 g (0.5 mol) of lauryloxypropylamine. Then, they were reacted for 3 hours with stirring at 70° C. of the inner temperature. After the reaction, the reaction mixture was poured into 10 L of ice-hydrochloric acid solution, and the deposited crystal was separated by filtration. The resulted crude crystal was re-crystallized from ethanol to obtain 265 g of a crystal of a developing agent D-1 (yield: 90%).

<Synthesis of Developing Agent D-7>

A developing agent D-7 was synthesized by a synthesis route according to the following Scheme-2.

Scheme-2

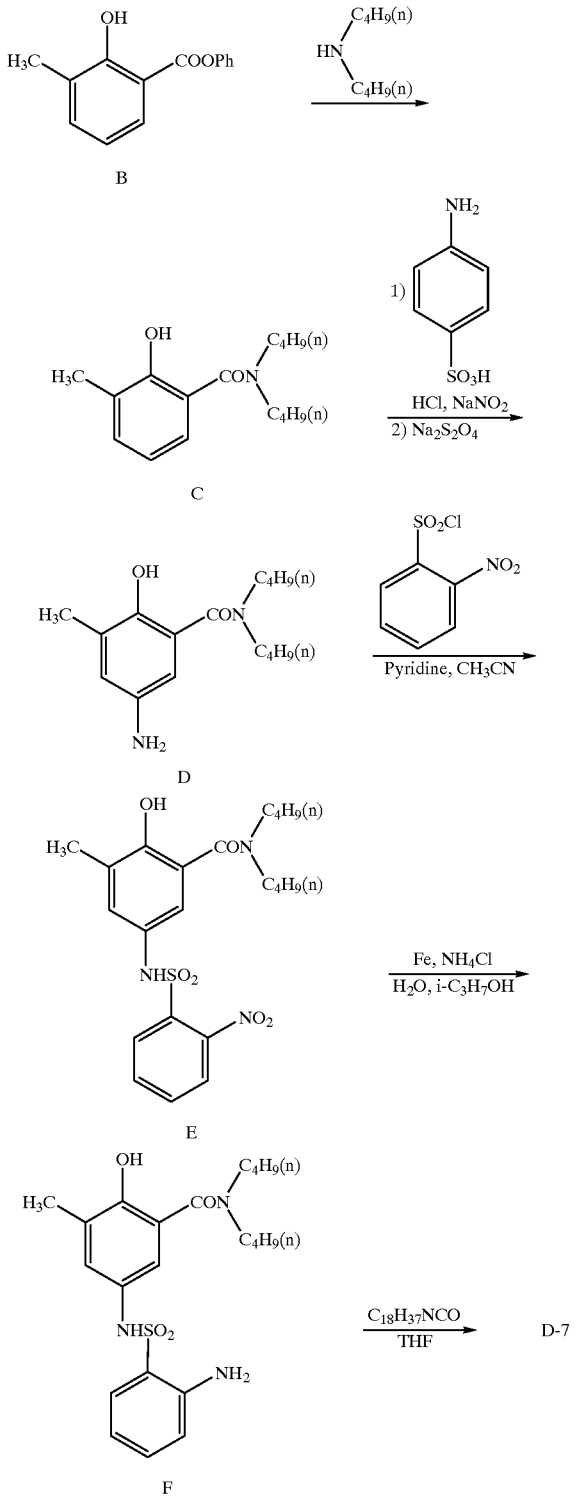

(1) Synthesis of Compound C from Compound B

Into a 1 L eggplant-type flask were charged a rotator for a magnetic stirrer, 228 g (1 mol) of compound B and 155 g (1.2 mol) of di-n-butylamine. A gas introducing tube was installed to this flask, and the tube was connected to an aspirator through a pressure resistant rubber tube. The solution was stirred using a magnetic stirrer while reduced pressure was maintained by water flow, and the temperature thereof was raised up to 120° C. to cause deposition of crystals of phenol in the glass section of the aspirator. The reaction was continued for 4 hours until the deposition of phenol crystals stopped. Then, the temperature was lowered again to room temperature. The resulting reaction mixture was added to 3 L of a hydrochloric acid solution, and the deposited crystals were collected by filtration. The crude crystal was re-crystallized from 1 L of methanol to obtain 242 g of crystals of compound C (yield: 92%).

(2) Synthesis of Compound D from Compound C

Into a 5 L beaker was charged 66 g (0.25 mol) of compound C, then 100 ml of methanol, 250 g (1.8 mol) of potassium carbonate and 500 ml of water were added and dissolved completely. The solution was kept at 0° C. or lower with stirring. A separately prepared solution which was prepared by dissolving 65 g (0.375 mol) of sulfanilic acid into 16.5 g of sodium hydroxide in 30 ml of water. To this was added 90 ml of concentrated hydrochloric acid to prepare a slurry solution. The prepared solution was vigorously stirred while being maintained at 0° C. or lower, and to this was gradually added a solution prepared by dissolving 27.5 g (0.4 mol) of sodium nitrite into 50 ml of water, to produce a diazonium salt. This reaction was effected with the ice added appropriately so that the temperature was kept at 0° C. or lower. Thus diazonium salt obtained was gradually added to the solution of the compound C with stirring. The reaction was also effected while adding ice appropriately so that the temperature was kept at 0° C. or lower. As the addition proceeded, the solution turned red color due to the azo dye. After the addition, the solution was further reacted for 30 minutes at 0° C. or lower until disappearance of the raw materials was recognized. Then, 500 g (3 mol) of sodium hydrosulfite in the form of a powder was added. When this solution was heated to 50° C., reduction of the azo group occurred with intense foaming. When the foaming stopped and the solution was decolorized to a yellowish clear solution, it was cooled down to 10° C. to find deposition of crystals. The deposited crystals were collected by filtration, and the resultant crude crystals were re-crystallized from 300 ml of methanol to obtain 56 g of crystals of a compound D (yield: 80%).

(3) Synthesis of Compound E from Compound D

Into a 1 L three-necked flask equipped with a condenser were charged 200 ml of acetonitrile, 56 g (0.2 mol) of the compound D and 16 ml (0.2 mol) of pyridine, and to this was added 44 g (0.2 mol) of o-nitrobenzenesulfonyl chloride over a period of 30 minutes. After the addition, the mixture was further stirred at room temperature for 2 hours to complete the reaction. The resulting reaction mixture was added to 3 L of a hydrochloric acid solution, and the deposited crystals were collected by filtration. The crude crystals were re-crystallized from methanol to obtain 86 g of crystals of a compound E (yield: 93%).

(4) Synthesis of Compound F from Compound E

Into a 3 L three-necked flask equipped with a condenser were charged 1 L of isopropanol, 100 ml of water, 10 g of ammonium chloride and 100 g of a reduced iron powder. Then, the mixture was heated with stirring on a water vapor bath until isopropanol was mildly reduced. Under reflex conditions, stirring was continued for about 15 minutes. To the mixture was gradually added 100 g of compound E over a period of 30 minutes. Intense reduction occurred on each addition, and the reduction reaction progressed. After the addition, the solution was further reacted for 1 hour under reflux. This reaction mixture was filtered through a Buchner Funnel on which celite was spread with heating, the residue was further washed with methanol. This was also filtered and added to the filtrate. When the filtrate was condensed under reduced pressure to about 300 cc, crystals were deposited, then, this filtrate was cooled to grow the crystals. The crystals were filtered, and washed with methanol before drying to obtain 80 g of crystals of a compound F (yield: 85%).

(5) Synthesis of Developing Agent D-7 from Compound F

Into a 1 L three-necked flask equipped with a condenser and thermometer were charged 300 ml of tetrahydrofuran and 87 g (0.2 mol) of the compound F and the mixture was stirred under condition of room temperature. To this was added 59.1 g (0.2 mol) of octadecylisocyanate. In this procedure, the temperature was controlled so as not to exceed 30° C. After the addition, the mixture was further stirred for 2 hours, then, the reaction mixture was added to 5 liter of ice water. When a crystal precipitated, this was filtered off, and re-crystallized using 600 ml of isopropanol, to obtain 139 g of a crystal of a developing agent D-7 (yield: 95%).

Specific examples of the color developing agent represented by the general formula (I) may include, but not limited to, the following agents.

D-1

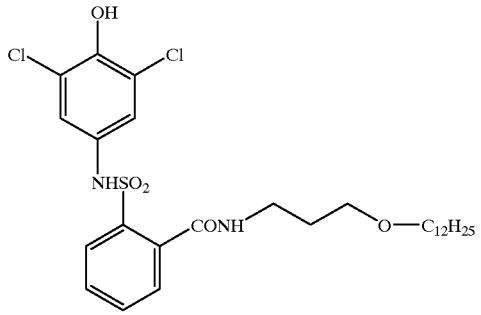

D-2

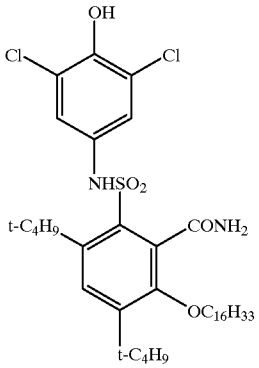

D-3

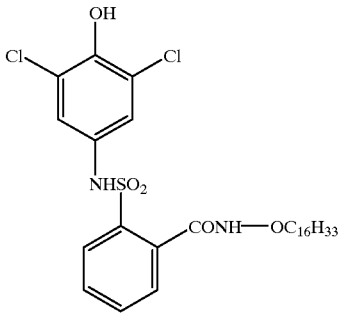

-continued

D-4

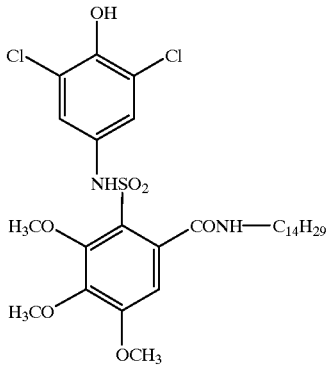

D-5

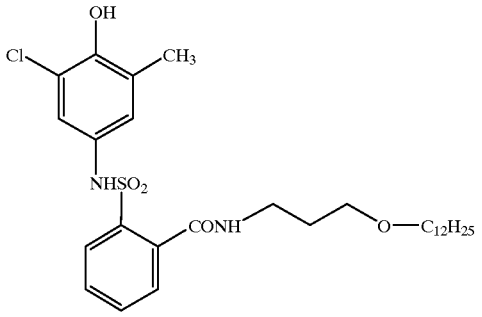

D-6

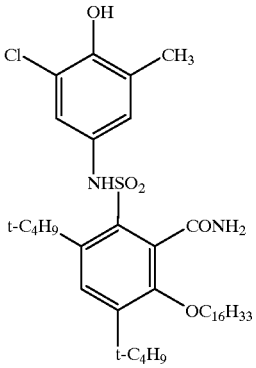

D-7

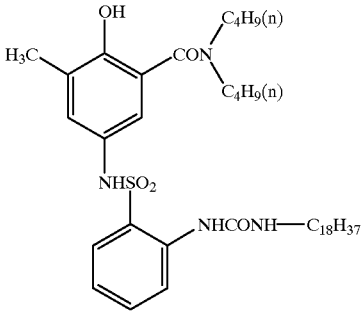

-continued
D-8
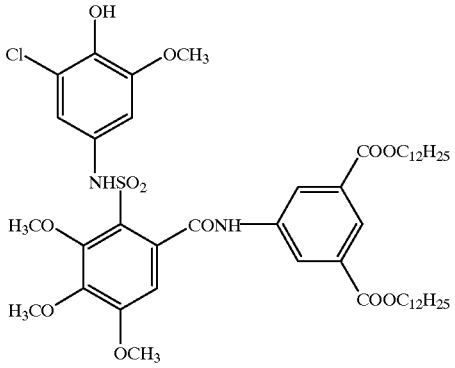
D-9
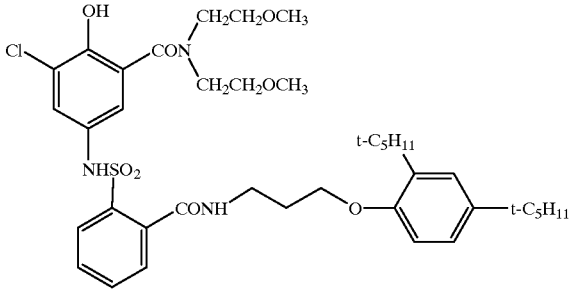
D-10
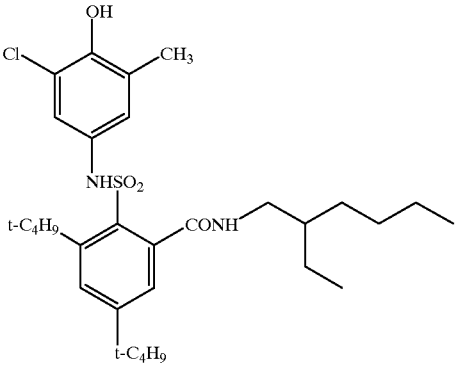
D-11
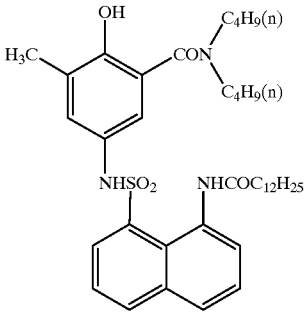
-continued
D-12
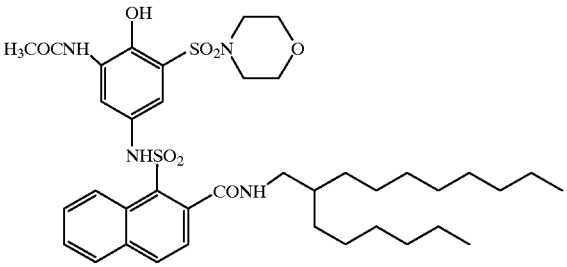
D-13
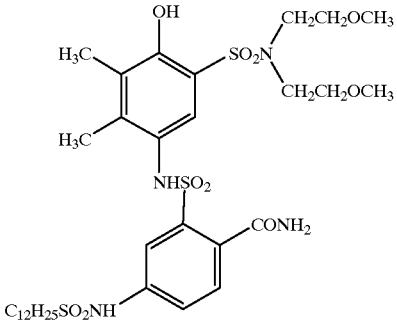
D-14
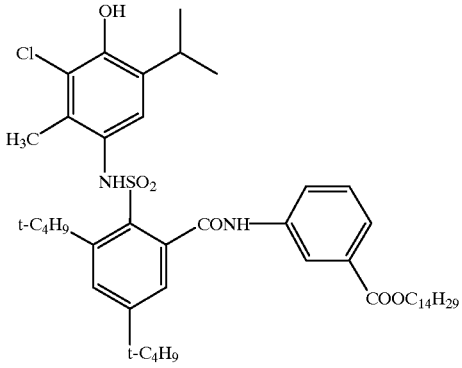
D-15
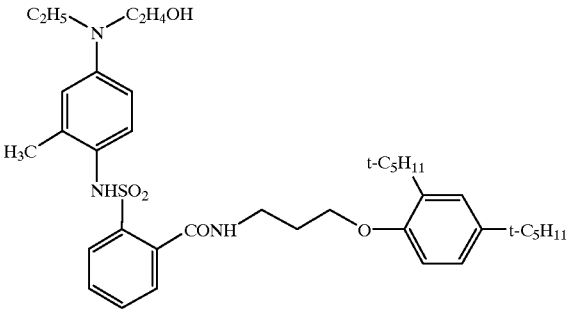

-continued
D-16
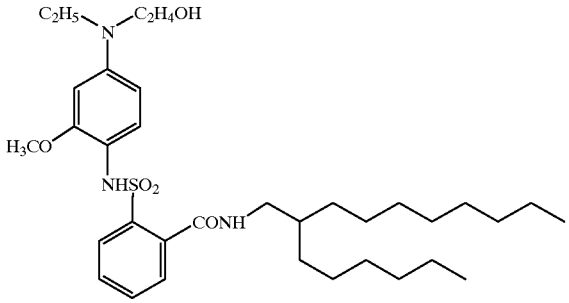
D-17
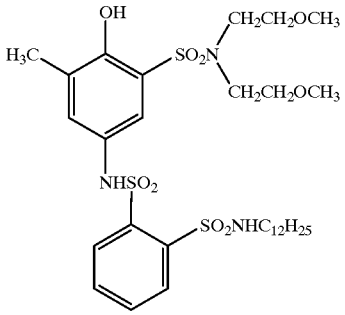
D-18
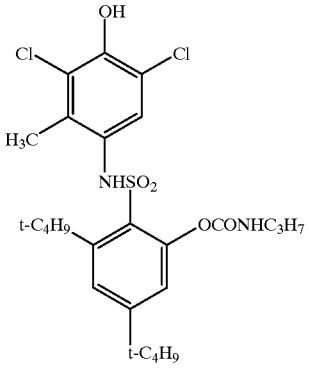
D-19
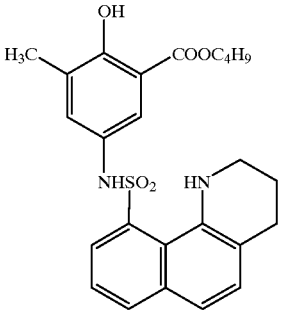
-continued
D-20
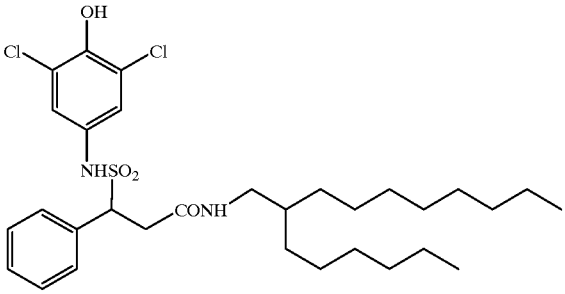
D-21
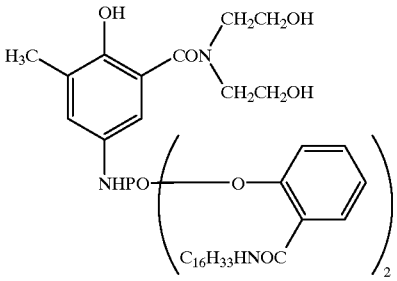
D-22
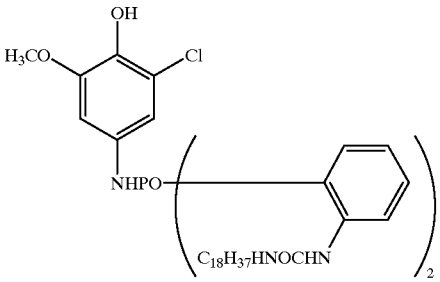
D-23
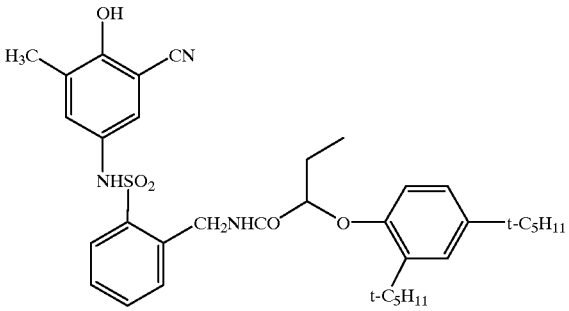
D-24
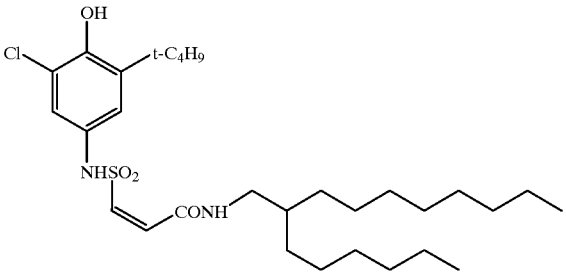

-continued
D-25
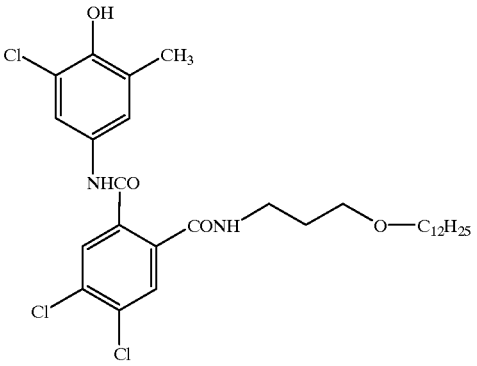
D-26
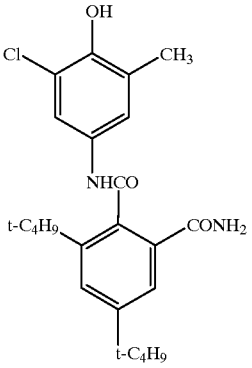
D-27
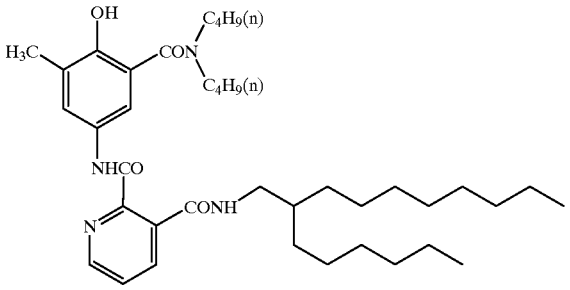
D-28
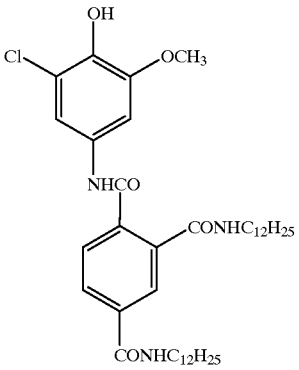
-continued
D-29
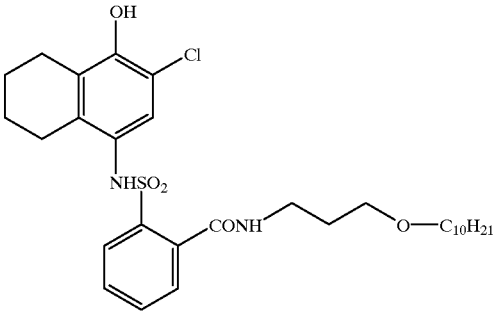
D-30
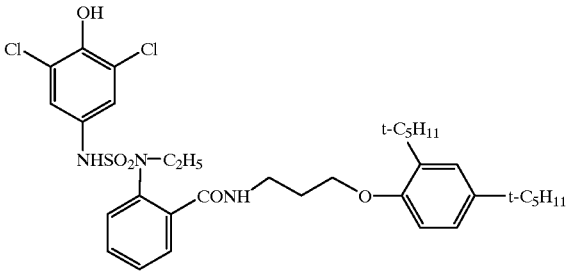
D-31
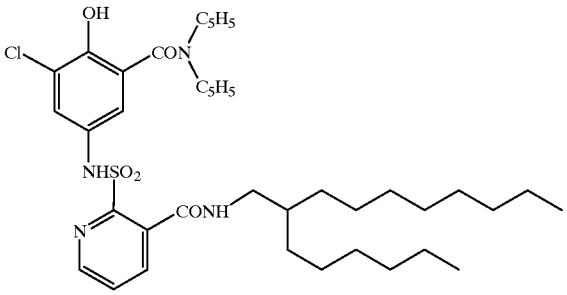
D-32
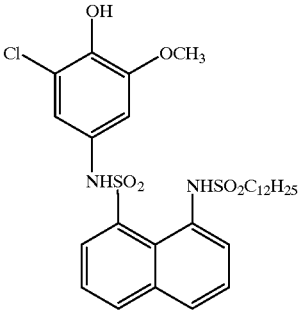
D-33
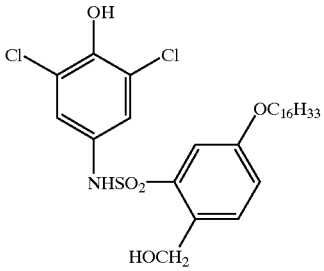

-continued

D-34

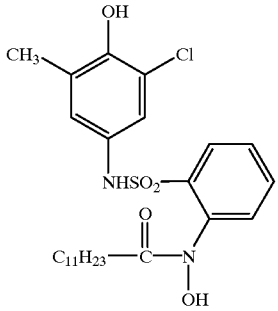

D-35

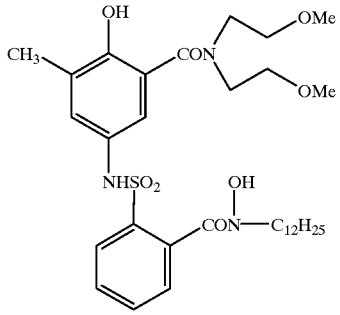

D-36

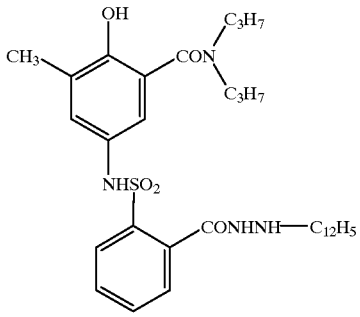

D-37

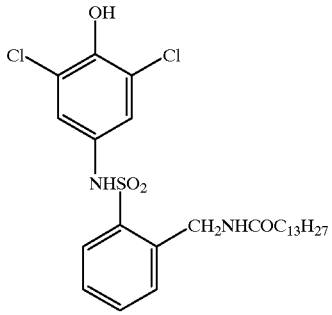

-continued

D-38

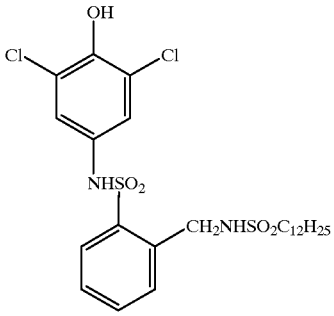

The color developing agent of the present invention is used together with a compound (coupler) which forms a dye by oxidizing coupling reaction. Preferably, a so-called "bivalent coupler" may be used in the present invention, in which coupling position used in conventional silver salt photography by using a p-phenylenediamines as a developing agent is substituted. Details of specific examples of the coupler are described, for example, in T. H. James, The Theory of the Photographic Process, 4th edition, Macmillan, 1977 pp. 291–334, pp. 354–361, and in JP-A Nos. 58-12, 353, 58-149,046, 58-149,047, 59-11,114, 59-124,399, 59-174,835, 59-231,539, 59-231,540, 60-2,951, 60-14,242, 60-23,474, 60-66,249 and the like.

Examples of the compound preferably used in the present invention are listed below.

Examples of the coupler preferably used in the present invention may include compounds having structures described in the following general formulae (1) to (12). These are compound generally called active methylene, pyrazolone, pyrazoloazole, phenol, naphthol or pyrrolotriazole respectively, and well known in the art.

(1)

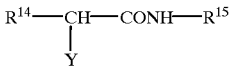

(2)

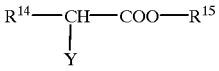

(3)

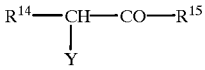

(4)

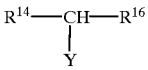

(5)

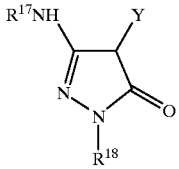

-continued (6)

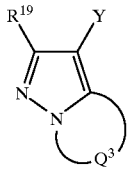

(7)

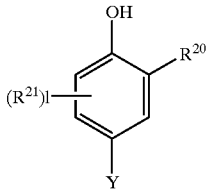

(8)

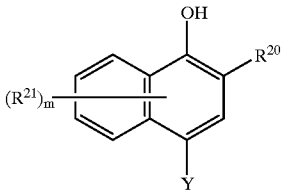

(9)

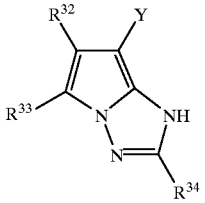

(10)

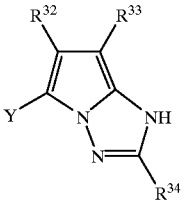

(11)

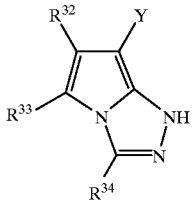

(12)

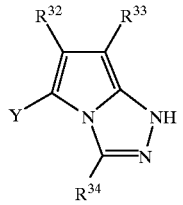

The general formulae (1) to (4) represent a coupler referred to as an active methylene-based coupler described in U.S. Pat. Nos. 3,933,501, 4,022,620 and 4,248,961, JP-B No. 58-10,739, U.K. Patent Nos. 1,425,020 and 1,476,760, U.S. Pat. Nos. 3,973,968, 4,314,023 and 4,511,649, EP-A No. 249,473A, and the like. $R_{14}$ represents an acyl group, cyano group, nitro group, aryl group, heterocyclic group, alkoxycarbonyl group, aryloxycarbonyl group, carbamoyl group, sulfamoyl group, alkylsulfonyl group or arylsulfonyl group which may have a substituent.

In the general formulae (1) to (3), $R_{15}$ represents an alkyl group, aryl group or heterocyclic group which may have a substituent. In the general formula (4), $R_{16}$ represents an aryl group or heterocyclic group which may have a substituent. Example of the substituent, which $R_{14}$, $R_{15}$ and $R_{16}$ may have, may include a ring formed by Q and C described later.

In the general formulae (1) to (4), $R_{14}$ and $R_{15}$, as well as $R_{14}$ and $R_{16}$ may be linked to each other to form a ring, respectively.

The general formula (5) represents a coupler referred to as a 5-pyrazolone-based coupler. In the formula, $R_{17}$ represents an alkyl group, aryl group, acyl group or carbamoyl group. $R_{18}$ represents a phenyl group or a phenyl group having one or more substituents selected from a halogen atom, alkyl group, cyano group, alkoxy group, alkoxycarbonyl group and acylamino group.

In the 5-pyrazolone-based coupler represented by the general formula (5), $R_{17}$ is preferably an aryl group or acyl group, and $R_{18}$ is preferably a phenyl group having one or more substituents selected from halogen atoms.

$R_{17}$ represents an aryl group such as a phenyl group, 2-chlorophenyl group, 2-methoxyphenyl group, 2-chloro-5-tetradecanamidephenyl group, 2-chloro-5-(3-octadecenyl-1-succinimide)phenyl group, 2-chloro-5-octadecylsulfonamidephenyl group, 2-chloro-5-[2-(4-hydroxy-3-t-butylphenoxy)tetradecanamide]phenyl and the like, or an acyl group such as an acetyl group, 2-(2,4-di-t-pentylphenoxy)butanoyl group, benzoyl group, 3-(2,4-di-t-amylphenoxyacetamide)benzoyl group and the like. These groups may further have a substituent, which is an organic substituent or halogen atom connected via a carbon atom, oxygen atom, nitrogen atom or sulfur atom. Y is as defined below.

$R_{18}$ preferably represents a substituted phenyl group such as 2,4,6-trichlorophenyl group, 2,5-dichlorophenyl group, 2-chlorophenyl group and the like.

The general formula (6) represents a coupler referred to as a pyrazoloazole-based coupler. In the formula, $R_{19}$ represents a hydrogen atom or a substituent. $Q^3$ represents a non-metal atom group to form a 5-membered azole ring containing 2 to 4 nitrogen atoms. The azole ring may have a substituent (including condensed ring).

Among the pyrazoloazole-based couplers represented by the general formula (6), imidazo[1,2-b]pyrazoles described in U.S. Pat. No. 4,500,630, pyrazolo[1,5-b]-1,2,4-triazoles described in U.S. Pat. No. 4,500,654 and pyrazolo[5,1-c]-1,2,4-triazoles described in U.S. Pat. No. 3,725,067 are preferable in terms of absorption property of a color developing dye.

The details of substituents on an azole ring represented by the substituent $R_{19}$, and $Q^3$ are described, for example, in U.S. Pat. No. 4,540,654, 2nd column, lines 41 to 8th column, line 27. Preferable examples thereof may include a pyrazoloazole coupler in which a branched alkyl group directly bonds to the 2, 3 or 6-position of a pyrazolotriazole group described in JP-A No. 61-65,245 and U.S. Pat. No. 5,541,501, a pyrazoloazole coupler containing a sulfonamide group in the molecule described in JP-A No. 61-65,245, a pyrazoloazole coupler having an alkoxyphenylsulfonamide ballast group described in JP-A No. 61-147,254, a pyrazoloazole coupler having an alkoxy group and aryloxy group in the 6-position described in JP-A No. 62-209,457 or 63-307,453, a pyrazoloazole coupler having a carbonamide group in the molecule described in JP-A No. 2-201,443, and a pyrazolotriazole coupler having a amidephenyl group in the molecule described in JP-A No. 6-43,611.

The compounds represented by the general formulae (7) and (8) are couplers referred to as a phenol-based coupler and naphthol-based coupler respectively, and in the formulae, $R_{20}$ represents a hydrogen atom or a group selected from $—CONR_{22}R_{23}$, $—SO_2NR_{22}R_{23}$, $—NHCOR_{22}$, $—NHCONR_{22}R_{23}$ and $—NHSO_2NR_{22}R_{23}$. $R_{22}$ and $R_{23}$ represent a hydrogen atom or a substituent. In the general formulae (7) and (8), $R_{21}$ represents a substituent, l represents an integer selected from 0 to 2, and m represents an integer selected from 0 to 4. If l and m are 2 or more, $R_{21}$ may be different. The substituents on $R_{21}$ to $R_{23}$ may be the substituent as described above, which may be a ring formed by Q and C.

Preferable examples of the phenol-based coupler represented by the above-described formula (7) may include 2-alkylamino-5-alkylphenol-based couplers described in U.S. Pat. Nos. 2,369,929, 2,801,171, 2,772,162, 2,895,826, 3,772,002 and the like, 2,5-dialkylaminophenol-based couplers described in U.S. Pat. Nos. 2,772,162, 3,758,308, 4,126,396, 4,334,011 and 4,327,173, OLS No. 3,329,729, JP-A No. 59-166956 and the like, 2-phenylureido-5-acylaminophenol-based couplers described in U.S. Pat. Nos. 3,446,622, 4,333,999, 4,451,559, 4,427,767, and the like.

Preferable examples of the naphthol coupler represented by the above-described formula (8) may include 2-carbamoyl-1-naphtol-based couplers described in U.S. Pat. Nos. 2,474,293, 4,052,212, 4,146,396, 4,282,233, 4,296,200 and the like, 2-carbamoyl-5-amide-1-naphtol-based couplers described in U.S. Pat. No. 4,690,889, and the like.

The compounds represented by the above-described general formulae (9) to (12) are couplers each referred to as pyrrolotriazole. Each of $R_{32}$, $R_{33}$ and $R_{34}$ represents a hydrogen atom or a substituent. Y is as described below. The substituents on $R_{32}$ to $R_{34}$ may be a ring formed by Q and C as described above. Preferable examples of the pyrrolotriazole-based couplers represented by the above-described general formulae (9) to (12) may include couplers in which at least one of $R_{32}$ and $R_{33}$ is an electron attractive group described in EP Nos. 488,248A1, 491,197A1 and 545,300, U.S. Pat. No. 5,384,236, and JP-A No. 8-110,623.

In the general formulae (1) to (12), Y is a group which can leave by coupling reaction with an oxidation product of a developing agent, and preferably a group which imparts diffusion resistance to a coupler. Examples of Y may include a heterocyclic group (saturated or unsaturated 5 to 7-membered single rings or condensed rings containing at least one of nitrogen, oxygen, sulfur and the like as a hetero atom. Examples thereof may include succinimide, maleinimide, phthalimide, diglycolimide, pyrrole, pyrazole, imidazole, 1,2,4-triazole, tetrazole, indole, benzopyrazole, benzimidazole, benztriazole, imdazoline-2,4-dione, oxazolidine-2,4-dione, thiazolidine-2,4-dione, imidazolidine-2-one, oxazoline-2-one, thiazoline-2-one, benzimidazoline-2-one, benzoxazoline-2-one, benzthiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine, 2-imino-1,3,4-thiazolidine-4-one and the like), a halogen atom (such as chlorine, bromine atoms and the like), an aryloxy group (such as phenoxy, 1-naphthoxy and the like), heterocyclic oxy group (such as pyridyloxy, pyrazolyloxy and the like), an acyloxy group (such as acetoxy, benzoyloxy and the like), an alkoxy group (such as methoxy, dodecyloxy and the like), a carbamoyloxy group (such as N,N-diethylcarbamoyloxy, morpholinocarbonyloxy and the like), an aryloxycarbonyloxy group (such as phenoxycarbonyloxy and the like), an alkoxycarbonyloxy group (such as methoxycarbonyloxy, ethoxycarbonyloxy and the like), an arylthio group (such as phenylthio, naphthylthio and the like), a heterocyclic thio group (such as tetorazolylthio, 1,3,4-thiadiazolylthio, 1,3,4-oxadiazolylthio, benzimidazolylthio and the like), an alkylthio group (such as methylthio, octylthio, hexadecylthio and the like), an alkylsulfonyloxy group (such as methanesulfonyloxy and the like), an arylsulfonyloxy group (such as benzenesulfonyloxy, toluenesulfonyloxy and the like), a carbonamide group (such as acetamide, trifluoroacetamide and the like), a sulfonamide (such as methanesulfonamide, benzenesulfonamide and the like), and an alkylsulfonyl group (such as methanesulfonyl and the like), an arylsulfonyl group (such as benzenesulfonyl and the like), an alkylsulfinyl group (such as methanesulfinyl and the like), an arylsulfinyl group (such as benzenesulfinyl and the like), an arylazo group (such as phenylazo, naphthylazo and the like), a carbamoylamino group (such as N-methylcarbamoylamino group and the like), and the like. Y may be substituted by a substituent. The substituent may be a ring formed by Q and C as described above. The total number of carbon atoms contained in Y is preferably from 6 to 50, more preferably from 8 to 40, most preferably from 10 to 30.

Y preferably represents an aryloxy group, heterocyclic oxy group, acyloxy group, aryloxycarbonyloxy group, alkoxycarbonyloxy group, carbamoyloxy group.

In the present invention, in addition to the above-described couplers, there can be used other couplers having different structure such as condensed ring phenol, imidazole, pyrrole, 3-hydroxypyridine, active methylene, active methine, 5,5-condensed heterocyclic ring and 5,6-condensed heterocyclic ring.

As the above-described condensed phenol-based coupler, there can be used couplers described in U.S. Pat. Nos. 4,327,173, 4,564,586, 4,904,575 and the like.

As the above-described imidazole-based coupler, there can be used couplers described in U.S. Pat. Nos. 4,818,672, 5,051,347 and the like.

As the above-described 3-hydroxypyridine-based coupler, there can be used couplers described in JP-A No. 1-315,736 and the like.

As the above-described active methylene, and active methine-based coupler, there can be used couplers described in U.S. Pat. Nos. 5,104,783, 5,162,196 and the like.

As the above-described 5,5-condensed heterocyclic ring-based couplers, there can be used pyrrolopyrazole-based couplers described in U.S. Pat. No. 5,164,289, pyrroloimidazole-based couplers described in JP-A No. 4-174,429, and the like.

As the above-described 5,6-condensed heterocyclic ring-based couplers, there can be used pyrazolopyrimidine-based couplers described in U.S. Pat. No. 4,950,585, pyrrolotriazine-based couplers described in JP-A No.4-204,730, couplers described in EP No. 556,700, and the like.

In the present invention, in addition to the above-described couplers, there can be used couplers described in German Patent Nos. 3,819,051A, 3,823,049, U.S. Pat. Nos. 4,840,883, 5,024,930, 5,051,347 and 4,481,268, EP Nos. 304,856A2, 329,036, 354,549A2, 374,781A2, 379,110A2 and 386,930A1, JP-A Nos. 63-141,055, 64-32,260, 64-32, 261, 2-297,547, 2-44,340, 2-110,555, 3-7,938, 3-160,440, 3-172,839, 4-172,447, 4-179,949, 4-182,645, 4-184,437, 4-188,138, 4-188,139, 4-194,847, 4-204,532, 4-204,731 and 4-204,732, and the like.
In the coupler used in the present invention, the total number of carbon atoms contained in moieties excepting Y is preferably from 1 to 30, more preferably from 3 to 24 and most preferably from 3 to 18.
Specific examples of the coupler which can be used in the present invention may be, but not limited to, the following couplers.
(1)
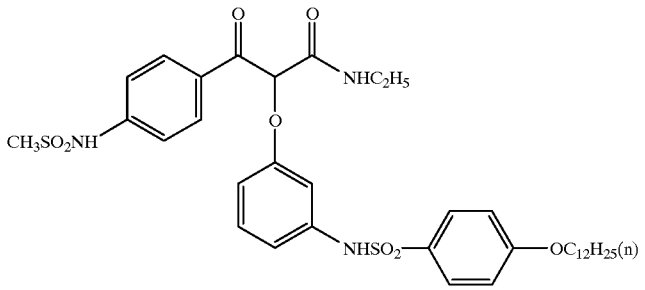
(2)
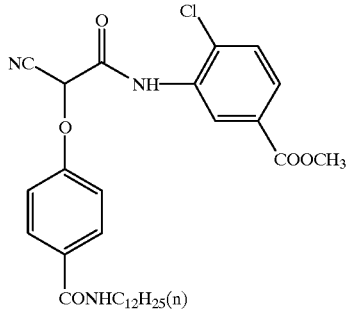
(3)
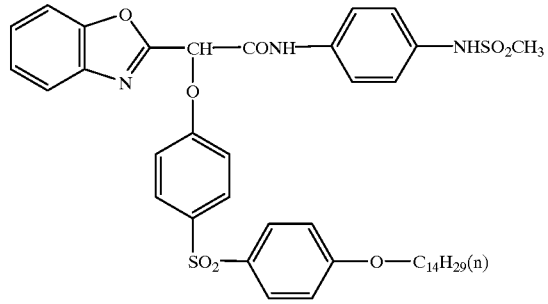
(4)
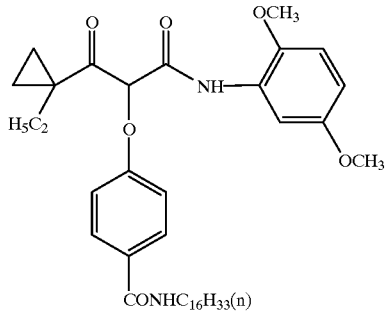

-continued
(5)
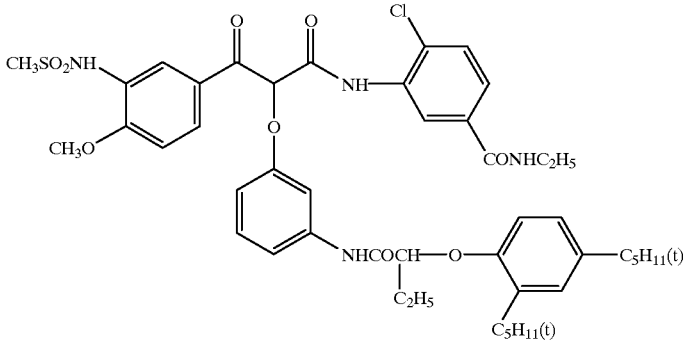
(6)
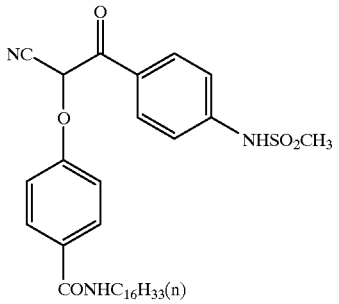
(7)
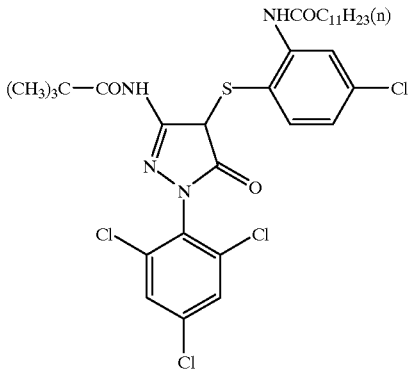
(8)
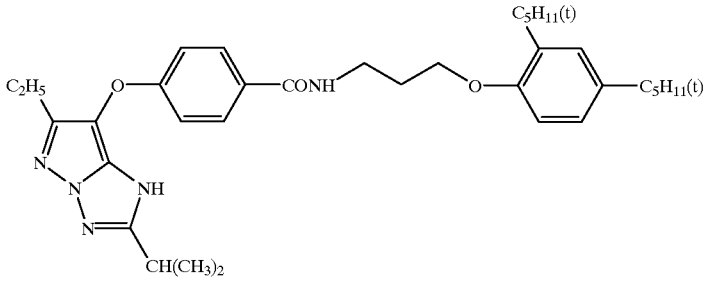

-continued
(9)
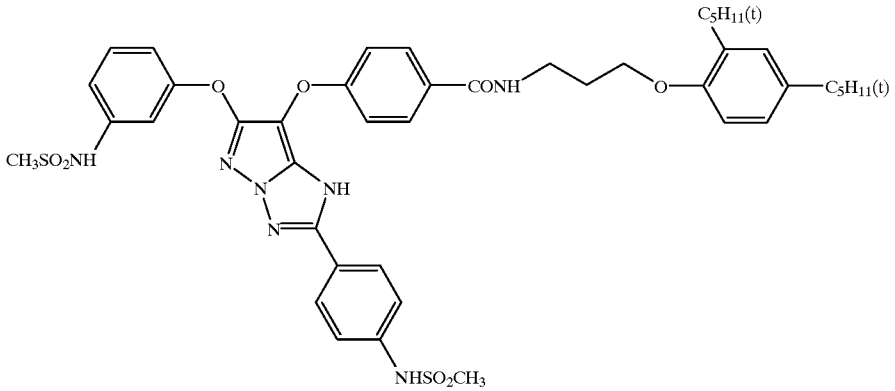
(10)
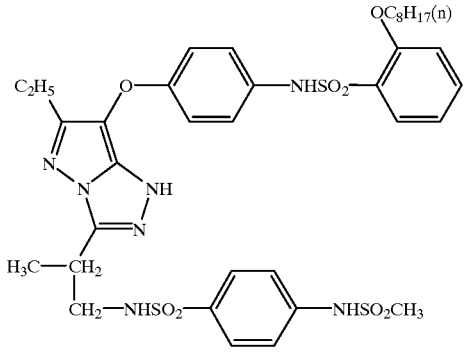
(11)
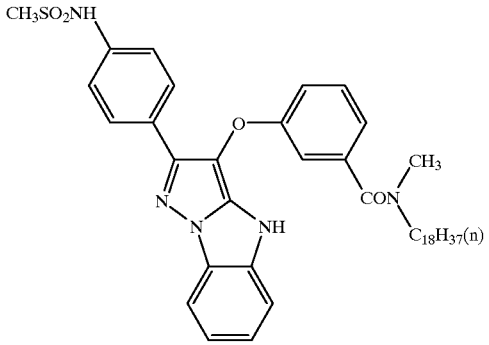
(12)
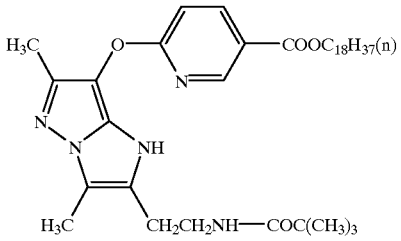

-continued
(13)
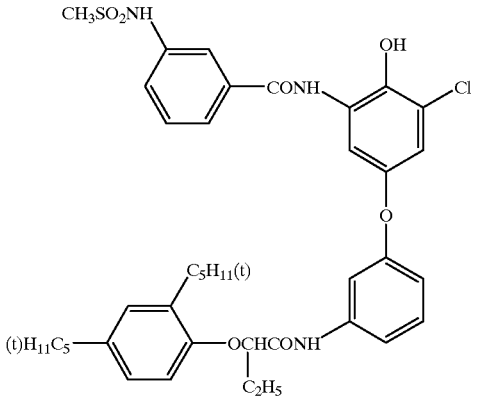
(14)
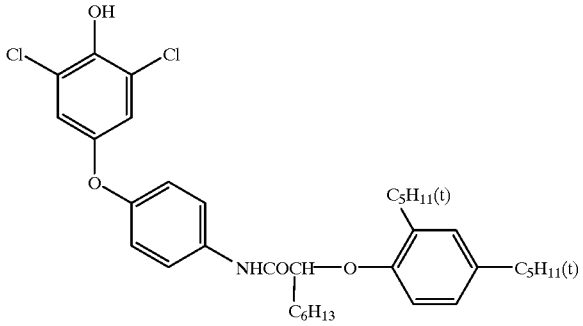
(15)
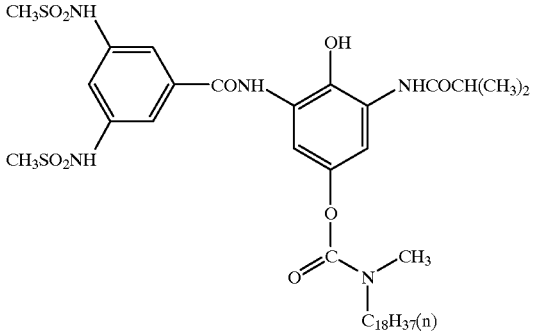
(16)
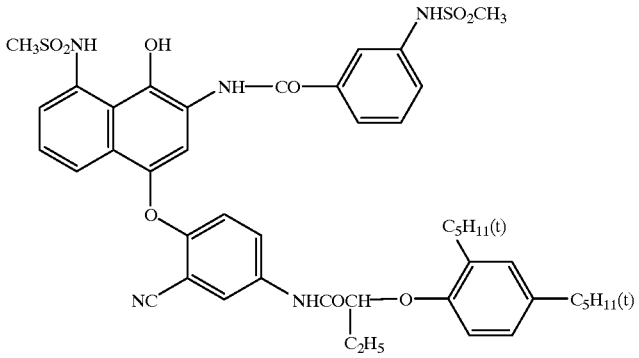

-continued
(17)
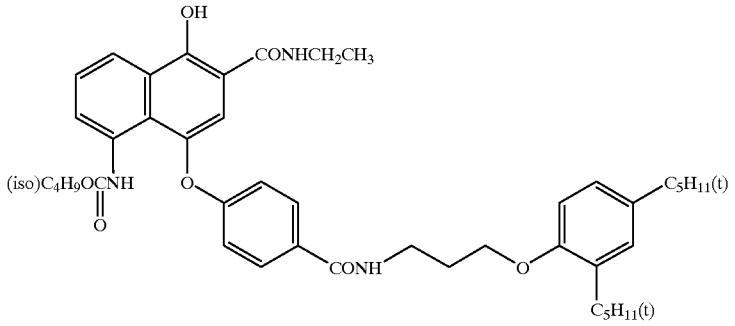
(18)
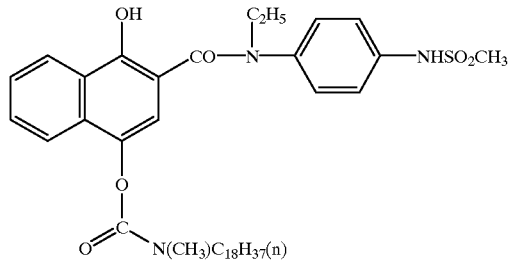
(19)
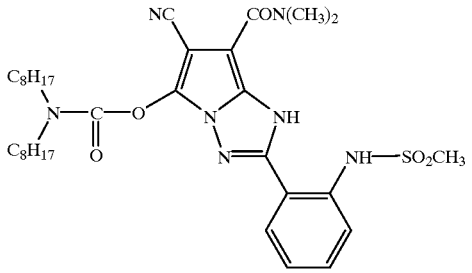
(20)
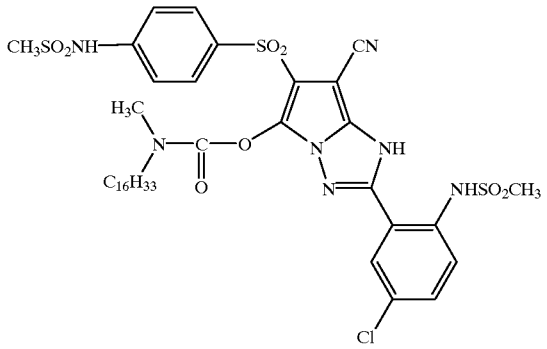

-continued
(21)
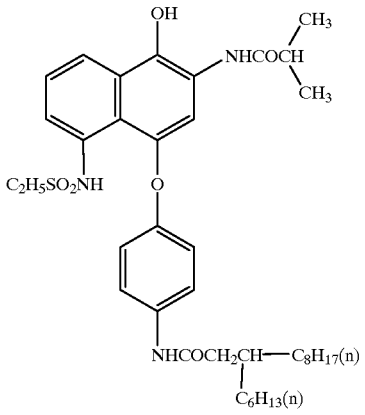
(22)
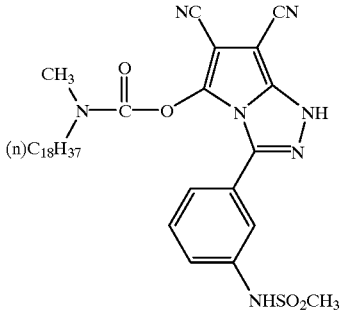
(23)
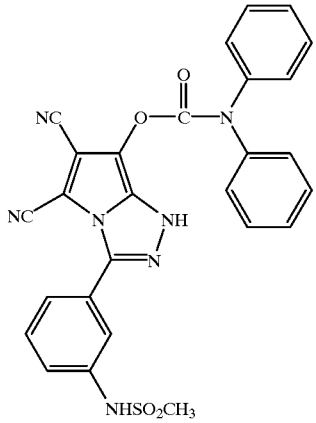
(24)
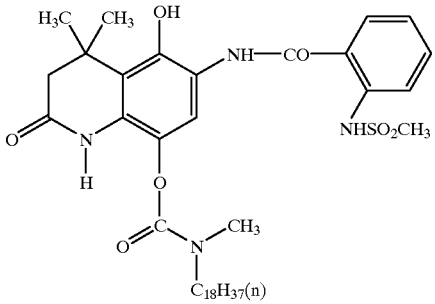

-continued
(25)
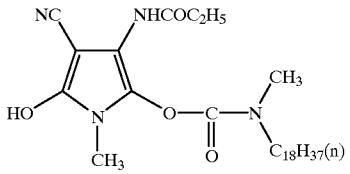
(26)
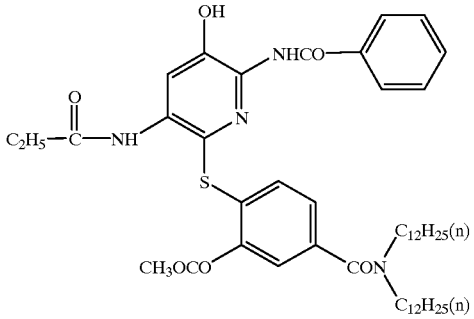
(27)
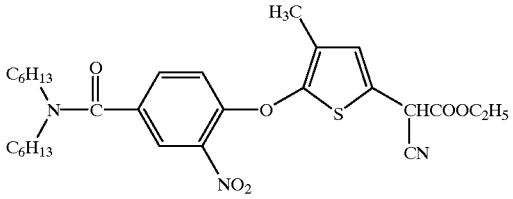
(28)
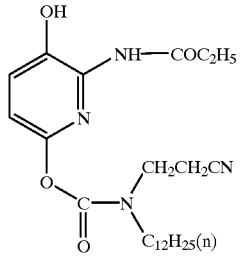
(29)
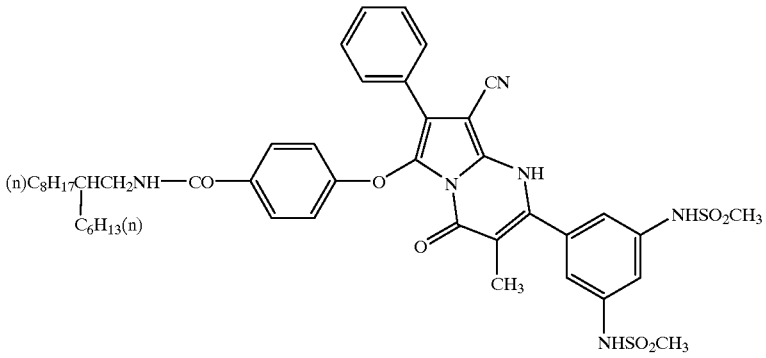

-continued (30)

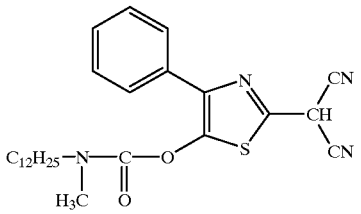

The amount added of the above-described coupler used in the present invention depends on molar absorption coefficient ($\epsilon$) of a dye formed, and in the case of a coupler in which $\epsilon$ of a dye produced by coupling is from about 5,000 to 500,000, it is suitable that the amount coated is from about 0.001 to 100 mmol/$m^2$, preferably from about 0.01 to 10 mmol/$m^2$, and more preferably from about 0.05 to 5.0 mmol/$m^2$, for obtaining an image concentration of 1.0 or more in terms of reflection concentration.

The amount added of the color developing agent of the present invention is from 0.01 to 100 times, preferably from 1 to 10 times, and more preferably from 0.2 to 5 times base on the coupler. The coupler can be used in combination of two or more.

Then, the compound used in the general formulae (II) to (VI) are described in detail below.

In the formula (II), $R_1$ represents a hydrogen atom, alkyl group, acyl group, sulfonyl group, carbamoyl group, sulfamoyl group, alkoxycarbamoyl group or trialkylsilyl group. A represents a group of non-metal atoms required to form a 5-membered or 6-membered ring with —C═C—O—. Each of $R_2$, $R_3$ and $R_4$ independently represents a hydrogen atom, alkyl group, cycloalkyl group, alkoxy group, aryl group, aryloxy group, aralkyl group, aralkyloxy group, alkenyl group, alkenoxy group, acylamino group, halogen atom, alkylthio group, diacylamino group, arylthio group, alkoxycarbonyl group, acyloxy group, acyl group or sulfonamide group.

In preferable groups represented by $R_1$, examples of the alkyl group may include alkyl groups having 1 to 22 carbon atoms such as a methyl group, ethyl group, propyl group, n-octyl group, dodecyl group, hexadecyl group and the like; examples of the acyl group may include acyl groups having 1 to 22 carbon atoms such as an acetyl group, benzoyl group, pentanoyl group, (2,4-di-tert-acylphenoxy)acetyl group and the like; examples of the sulfonyl group may include sulfonyl groups having 1 to 22 carbon atoms such as a methanesulfonyl group, butanesulfonyl group, benzenesulfonyl group, toluenesulfonyl group, hexadecanesulfonyl group and the like; examples of the carbamoyl group may include carbamoyl groups having 1 to 22 carbon atoms such as a N-methylcarbamoyl group, N,N-diethylcarbamoyl group, N-dodecylcarbamoyl group, N-phenylcarbamoyl group and the like; examples of the sulfamoyl group may include sulfamoyl groups having 0 to 22 carbon atoms such as a N-methylsulfalmoyl group, N,N-dimethylcarbamoyl group, N-tetradecylsulfamoyl group, N-phenylsulfamoyl group and the like; examples of the alkoxycarbamoyl group may include alkoxycarbamoyl groups having 2 to 22 carbon atoms such as a methoxycarbamoyl group, ethoxycarbamoyl group, benzyloxycarbamoyl group, phenoxycarbamoyl group and the like; and examples of the trialkylsilyl group may include trialkylsilyl groups having 3 to 22 carbon atoms such as a trimethylsilyl group, dimethylbutylsilyl group and the like.

A represents a group of non-metal atoms required to form a 5-membered or 6-membered ring with —C═C—O—. The ring may be substituted. Preferably examples of the substituent may include an alkyl group (such as methyl, t-butyl, cyclohexyl, octyl, dodecyl and octadecyl groups), alkoxy group (such as methoxy, butoxy and dodecyloxy groups), an aryl group (such as phenyl group), an aryloxy group (such as a phenoxy group), an aralkyl group (such as benzyl and phenethyl groups), an aralkyloxy group (such as benzyloxy and phenethyloxy groups) an alkenyl group (such as an allyl group), a N-substituted amino group (such as alkylamino, dialkylamino, N-alkyl-N-arylamino, piperazino groups), a heterocyclic group (such as benzothiazolyl and benzoxazoyl groups). Further, the ring may be substituted by a residual group which forms a condensed ring. The above-described alkyl group and aryl group may be further substituted. Examples of the preferable substituent may include a halogen atom, hydroxy group, carboxy group, alkoxycarbonyl group, acyloxy group, sulfo group, sulfonyloxy group, amide group (such as acetamide, ethanesulfonamide and benzamide groups), alkoxy group, aryloxy group and the like.

In preferable groups represented by $R_2$, $R_3$ and $R_4$, examples of the alkyl group may include alkyl groups having 1 to 30 carbon atoms such as a methyl group, t-butyl group, n-octyl group, t-octyl group, dodecyl group, octadecyl group and the like; examples of the cycloalkyl group may include cycloalkyl groups having 3 to 30 carbon atoms such as a cyclopentyl group, cyclohexyl group and the like; examples of the alkoxy group may include alkoxy groups having 1 to 22 carbon atoms such as a methoxy group, butoxy group, dodecyloxy group and the like; examples of the aryl group may include aryl groups having 6 to 30 carbon atoms such as a phenyl group and the like; examples of the aryloxy group may include aryloxy groups having 6 to 30 carbon atoms such as a phenoxy group and the like; examples of the aralkyl group may include aralkyl groups having 7 to 30 carbon atoms such as a benzyl group, phenethyl group and the like; examples of the aralkyloxy group may include aralkyloxy groups having 6 to 30 carbon atoms such as a benzyloxy group, phenethyloxy group and the like; examples of the alkenyl group may include alkenyl groups having 2 to 30 carbon atoms such as an allyl group and the like; examples of the alkenoxy group may include alkenoxy groups having 2 to 30 carbon atoms such as an allyloxy group and the like; examples of the acylamino group may include acylamino groups having 1 to 30 carbon atoms such as an acetylamino group, benzamide group, (2,4-di-tert-acylphenoxy)acetylamino group and the like; examples of the halogen atom may include a chlorine atom, bromine atom and the like; examples of the alkylthio group may include alkylthio groups having 1 to 30 carbon atoms such as an ethylthio group, dodecylthio group, octadecylthio group and the like; examples of the diacylamino group may include diacylamino groups having 2 to 30 carbon atoms such as a succinimido, hydantoinyl group and the like; examples of the arylthio group may include arylthio groups having 6 to 30 carbon atoms such as a phenylthio group and the like; examples of the alkoxycarbonyl group may include alkoxycarbonyl groups having 2 to 30 carbon atoms such as a methoxycarbonyl group, ethoxycarbonyl group, benzyloxycarbonyl group and the like; examples of the acyloxy group may include acyloxy groups having 1 to 30 carbon atoms such as an acetyloxy group, benzoyloxy group and the like; examples of the acyl group may include acyl groups having 1 to 30 carbon atoms such as a methylcarbonyl group and the like. The bisspiroindane according to the present invention may be compounds represented by the following general formula (II').

(II')

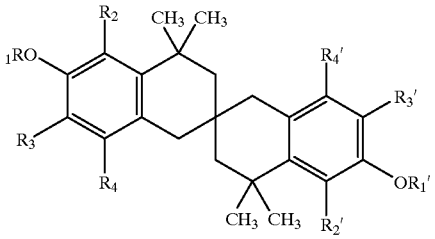

$R_1'$ to $R_4'$ and $R_1$ to $R_4$ in the general formula (II') have the same meanings as for $R_1$ to $R_4$ in the general formula (II).

Compounds represented by the general formula (II) in which the total number of carbon atoms in $R_2$ to $R_4$ and A is 8 or more. Compounds represented by the general formula (II') have low diffusible property and suited for existing selectively in a specific hydrophilic layer of a dye-fixing element.

Further, 5-hydroxychramans and 6-hydroxychroman where one of $R_2$ and $R_3$ is a hydrogen atom, and 6,6'-dihydroxybis-2,2'-spirochromans represented by the general formula (II') are particularly effective.

More preferably, each of $R_2$ to $R_4$ and $R_2'$ to $R_4'$ in the general formula (II) and (A) independently represents an alkyl group, alkoxy group, aryl group, aryloxy group or alkylthio group.

Then, the compound represented by the general formula (III) will be described.

$R_1$ has the same meanings as in the general formula (II).

In preferable groups represented by $R_5$, examples of the alkyl group may include alkyl groups having 1 to 22 carbon atoms such as a methyl group, t-butyl group, propyl group, n-octyl group, dodecyl group, hexadecyl group and the like; examples of the alkoxy group may include alkoxy groups having 1 to 22 carbon atoms such as a methoxy group, ethoxy group, octyloxy group and the like; examples of the alkoxycarbonyl group may include alkoxycarbonyl groups having 2 to 22 carbon atoms such as an ethoxycarbonyl group and the like; examples of the arylsulfinyl group may include arylsulfinyl groups having 6 to 22 carbon atoms such as a phenylsulfinyl group and the like; examples of the arylthio group may include arylthio groups having 6 to 22 carbon atoms such as a phenylthio group and the like; examples of the arylsulfonyl group may include arylsulfonyl groups having 6 to 22 carbon atoms such as a phenylsulfonyl group and the like; examples of the aralkyl group may include aralkyl groups having 7 to 22 carbon atoms such as a benzyl group, phenethyl group and the like; examples of the halogen atom may include a chlorine atom and the like; examples of the aryl group may include aryl groups having 6 to 30 carbon atoms such as a phenyl group, α- or β-naphthyl group and the like; examples of the acyl group may include acyl groups having 1 to 22 carbon atoms such as an acetyl group, butanoyl group, benzoyl group and the like.

$R_6$ represents preferably a hydrogen atom, an alkyl group having 1 to 22 carbon atoms, an alkoxy group having 1 to 22 carbon atoms, an aralkyloxy group having 7 to 22 carbon atoms, an alkylthio group having 1 to 22 carbon atoms, an aralkylthio group having 7 to 22 carbon atoms (benzylthio group, β-phenoxythio group and the like), an acylamino group having 2 to 22 carbon atoms, an alkylamino group having 2 to 22 carbon atoms, an arylamino group having 6 to 22 carbon atoms (such as a phenylamino group, N-phenyl-N-methylamino group, N-phenyl-N-methylamino group, β-naphthylamino group and the like), a heterocyclic amino group having 1 to 22 carbon atoms.

$R_7$ represents preferably a hydrogen atom, a halogen atom, an alkyl group having 1 to 22 carbon atoms, an arylthio group having 6 to 22 carbon atoms, an alkylthio group having 1 to 22 carbon atoms, an arylsulfonyl group having 6 to 22 carbon atoms, an arylsulfinyl group having 6 to 22 carbon atoms, an aralkyl group having 7 to 22 carbon atoms, an aryl group having 6 to 30 carbon atoms, an aryldithio group having 6 to 32 carbon atoms, or an aryloxy group having 6 to 22 carbon atoms. Further, the above-described $R_5$, $R_6$ and $R_7$ may also have a substituent. Examples of such a substituent may include any substituents represented by $R_5$ to $R_7$ and a hydroxy group. Among the compounds represented by the general formula (III), more preferable are compounds represented by the general formula (III').

(III')

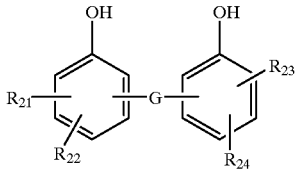

wherein G represents —S—, —S—S—, —O—, —$CH_2$—S—$CH_2$—, —$SO_2$—, —SO—, —$(CH_2)_n$—CO—$(CH_2)_m$—CO—$(CH_2)_n$—, —$(CH_2)_n$—$CO_2$—$(CH_2)_m$—$CO_2$—$(CH_2)_n$—, —$CH_2$—O—$CH_2$—, —$N(R_{25})$, —$(C(R_{26})(R_{27}))_m$— (wherein each of n and m independently represents an integer of 1 or more) and the following structure.

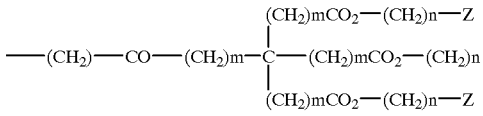

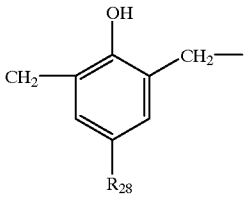

Each of $R_{21}$ to $R_{24}$ preferably represents a hydrogen atom, an alkyl group having 1 to 20 carbon atoms, an aryl group having 6 to 20 carbon atoms, an aralkyl group having 6 to 20 carbon atoms, an alkylthio group having 1 to 20 carbon atoms, a halogen atom, an alkoxy group having 1 to 20 carbon atoms, an arylthio group having 6 to 20 carbon atoms, an aralkyloxy group having 6 to 20 carbon atoms, $—COOR_{29}$, $—NHCOR_{29}$, $—NHSO_2R_{29}$—$SO_2R_{29}$, $—O—COR_{29}$, $—N(R_{30})(R_{31})$, or $—CH_2—N(R_{30})(R_{31})$.

$R_{25}$ represents a hydrogen atom, an alkyl group having 1 to 20 carbon atoms, or an aryl group having 6 to 20 carbon atoms. Each of $R_{26}$ and $R_{27}$ preferably represents a hydrogen atom, an alkyl group having 1 to 20 carbon atoms, an aryl group having 6 to 20 carbon atoms or a substituted 5 or 6-membered ring formed by bonding them each other. $R_{28}$ represents a hydrogen atom or a methyl group. $R_{29}$ represents an alkyl group having 1 to 20 carbon atoms, or an aryl group having 6 to 20 carbon atoms. Each of $R_{30}$ and $R_{31}$ independently represents a hydrogen atom, an alkyl group having 1 to 20 carbon atoms, an aryl group having 6 to 20 carbon atoms, a heterocyclic group having 1 to 20 carbon atoms, an aralkyl group having 7 to 20 carbon atoms or a 5 or 6-membered hetero ring having any of the above-described substituents formed by bonding them each other. Z represents substituted phenol.

The general formula (IV) will be described.

$R_1$ has the same meanings as in the general formula (II).

$R_8$ preferably represents a hydrogen atom, an alkyl group having 1 to 22 carbon atoms, or an alkenyl group having 3 to 22 carbon atoms. $R_9$ preferably represents an alkyl group having 1 to 22 carbon atoms, or an alkenyl group having 3 to 22 carbon atoms.

The general formula (V) is explained below.

In the formula, $R_{10}$ represents an alkyl group, alkenyl group, aryl group, aralkyl group, heterocyclic group, or a group represented by $R_{18}CO—$, $R_{19}SO_2—$ or $R_{20}NHCO—$. In these groups, each of $R_{18}$ to $R_{20}$ independently represents an alkyl group, alkenyl group, aryl group or heterocyclic group. Each of $R_{11}$ and $R_{12}$ independently represents a hydrogen atom, halogen atom, alkyl group, alkenyl group, alkoxy group, or alkenoxyl group. Each of $R_{13}$ to $R_{17}$ independently represents a hydrogen atom, alkyl group, alkenyl group or aryl group.

In the groups represented by $R_{10}$, examples of the alkyl group may include alkyl groups having 1 to 20 carbon atoms such as a methyl group, ethyl group, propyl group, n-octyl group, tert-octyl group, benzyl group, hexadecyl group and the like; examples of the alkenyl group may include alkenyl groups having 2 to 20 carbon atoms such as an allyl group, octynyl group, oleyl group and the like; examples of the aryl group may include aryl groups having 6 to 20 carbon atoms such as a phenyl group, naphthyl group and the like; examples of the aralkyl group may include aralkyl groups having 7 to 22 carbon atoms such as a benzyl group and the like; examples of the heterocyclic group may include heterocyclic groups having 1 to 20 carbon atoms such as a tetrapyranyl group, pyrimidyl group and the like.

Each of $R_{18}$ to $R_{20}$ independently represents an alkyl group having 1 to 20 carbon atoms (such as methyl, ethyl and benzyl groups), an alkenyl group having 2 to 20 carbon atoms (such as allyloctenyl and oleyl groups), an aryl group having 6 to 20 carbon atoms (such as phenyl, methoxyphenyl and naphthyl groups) or a heterocyclic group having 1 to 20 carbon atoms (such as pyridyl and pyrimidyl groups).

In the groups represented by $R_{11}$ or $R_{12}$, examples of the halogen atom may include chlorine, bromine and the like; examples of the alkyl group may include alkyl groups having 1 to 20 carbon atoms such as a methyl group, ethyl group, benzyl group and the like; examples of the alkenyl group may include alkenyl groups having 2 to 20 carbon atoms such as an allyl group, hexenyl group, octenyl group and the like; examples of the alkoxy group may include alkoxy groups having 1 to 20 carbon atoms such as a methoxy group, ethoxy group, benzyloxy group and the like; examples of the alkenoxy group may include alkenoxy groups having 2 to 20 carbon atoms such as a 2-propenyloxy group, hexenyloxy group and the like.

In the groups represented by $R_{13}$ to $R_{17}$, examples of the alkyl group may include alkyl groups having 1 to 20 carbon atoms such as a methyl group, ethyl group, butyl group and the like; examples of the alkenyl group may include alkenyl groups having 2 to 20 carbon atoms such as a 2-propenyl group, hexenyl group, octenyl group and the like; examples of the aryl group may include aryl groups having 6 to 20 carbon atoms such as a phenyl group, methoxyphenyl group, chlorophenyl group, naphthyl group and the like.

The general formula (VI) will be described below.

In the formula, E represents an non-metal atom group required to form a 5 to 7-membered ring together with C and N.

$R_{18}$ represents a hydrogen atom, an alkyl group, alkenyl group, alkynyl group, acyl group, sulfonyl group, sulfinyl group, oxy radical group, or hydroxy group. Each of $R_{19}$ to $R_{22}$ independently represents a hydrogen atom or an alkyl group.

Examples of the 5 to 7-membered ring formed by E may include a pyrrolidine ring, pyperazine ring, morpholine ring, pyperidine ring and the like.

In the groups represented by $R_{18}$, examples of the alkyl group may include alkyl groups having 1 to 20 carbon atoms such as a methyl group, octyl group, benzyl group, hexadecyl group and the like; examples of the alkenyl group may include alkenyl groups having 2 to 20 carbon atoms such as an allyl group, oleyl group and the like; examples of the alkynyl group may include alkynyl groups having 2 to 20 carbon atoms such as an ethynyl group, propynyl group and the like; examples of the acyl group may include acyl groups having 1 to 20 carbon atoms such as an acetyl group, benzoyl group, pentanoyl group and the like; examples of the sulfonyl group may include sulfonyl groups having 1 to 20 carbon atoms such as a methanesulfonyl group, benzenesulfonyl group, toluenesulfonyl group, hexadecanesulfonyl group and the like; examples of the sulfinyl group may include sulfinyl groups having 1 to 20 carbon atoms such as a methanesulfinyl group, benzenesulfinyl group, butanesulfinyl group and the like. Examples of the alkyl group represented by $R_{19}$ to $R_{22}$ may include alkyl groups having 1 to 20 carbon atoms such as a methyl group, butyl group and the like.

In these groups, it is preferable that the ring formed by E is a piperidine ring, and more preferable that the ring formed by E is a piperidine ring and two or more of $R_{19}$ to $R_{22}$ represent a methyl group.

Specific examples of the compound represented by the general formula (II) to (VI), (II') and (III') in the present invention may include, but not limited to, the following compounds.

Examples of Compounds Represented by General Formula (II)
II-1
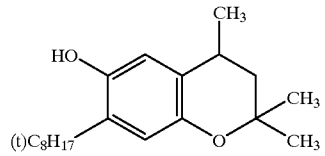
II-2
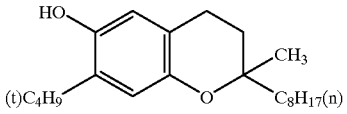
II-3
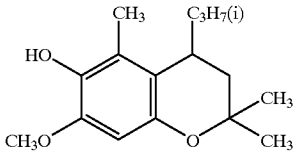
II-4
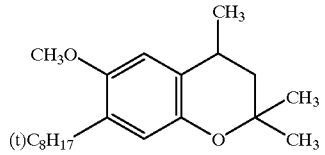
II-5
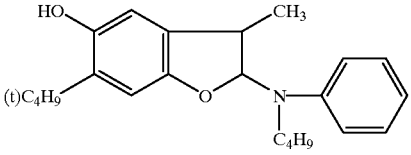
II-6
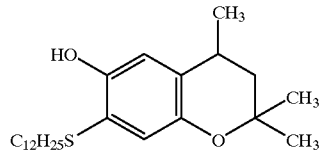
II-7
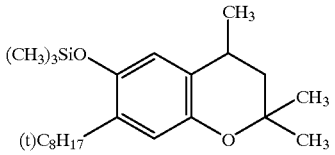
II-8
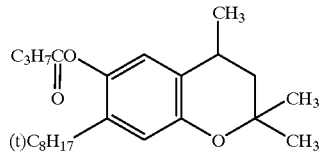
II-9
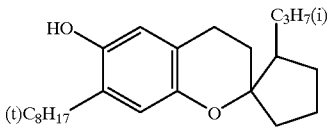
-continued
II-10
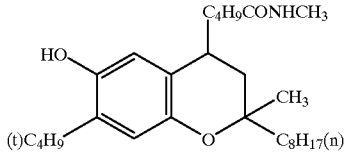
II-11
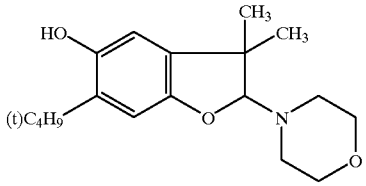
II-12
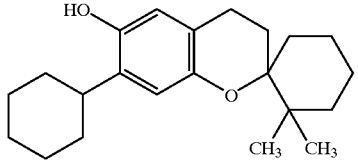
II-13
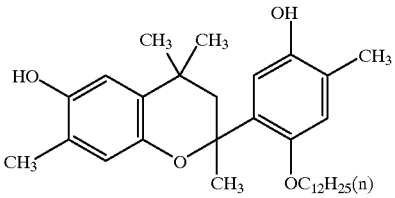
II-14
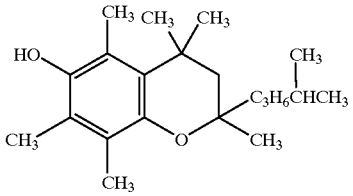
Examples of Compounds Represented by General Formula (II')
II'-1
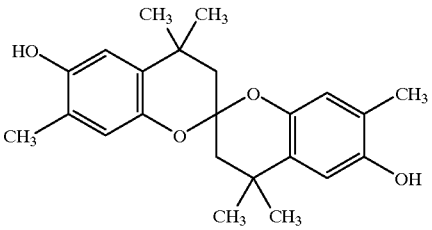
II'-2
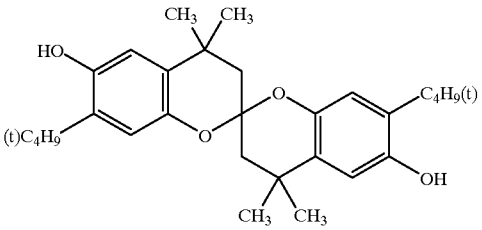

-continued
II'-3
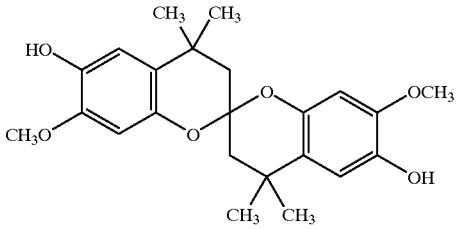
II'-4
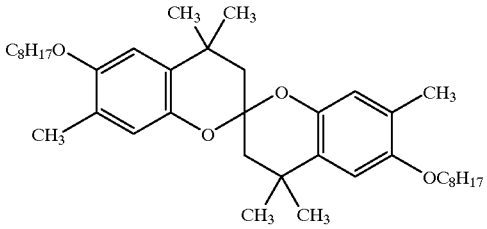
II'-5
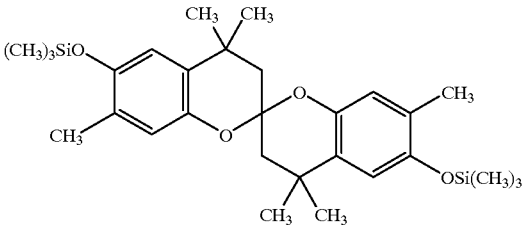
II'-6
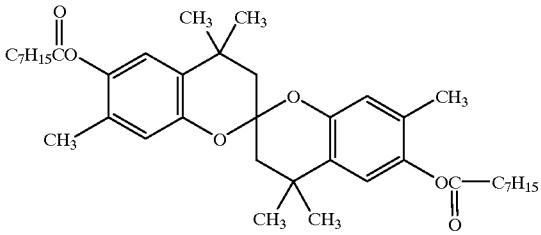
II'-7
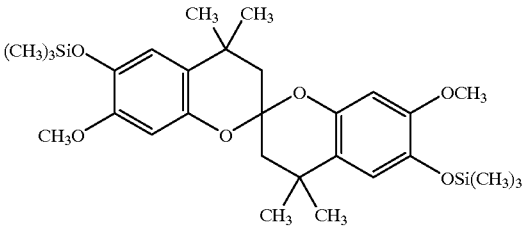
II'-8
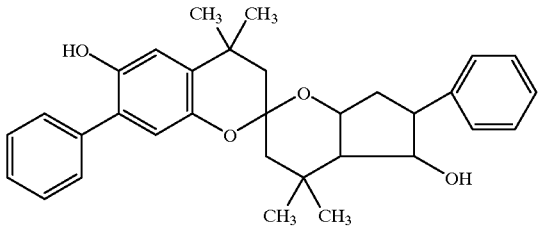
Examples of Compounds Represented by General Formula (III)
III-1
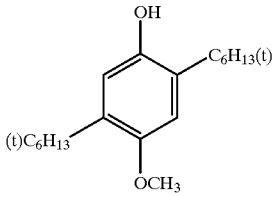
III-2
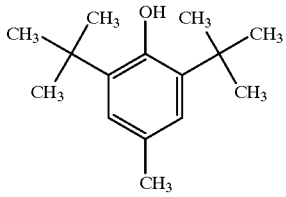
III-3
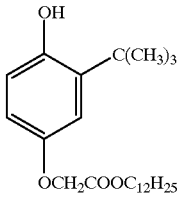
III-4
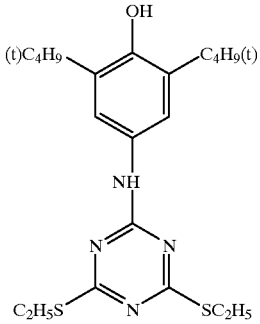
III-5
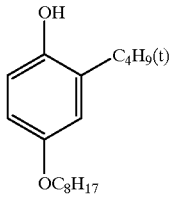
III-6
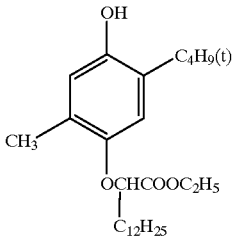

-continued
III-7
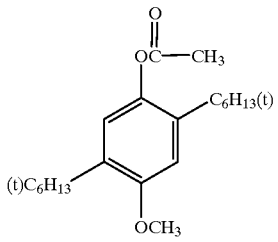
III-8
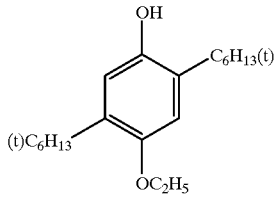
III-9
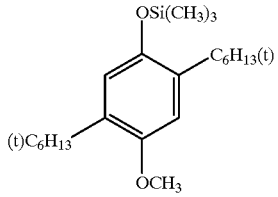
III-10
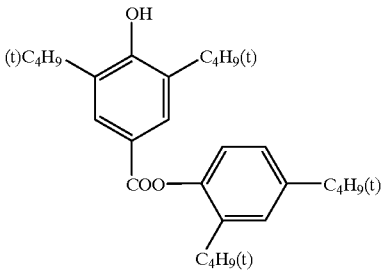
III-11
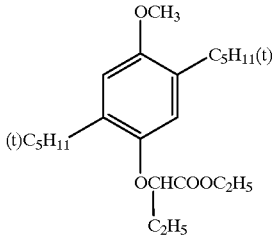
III-12
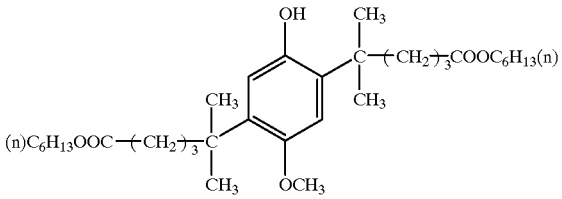
-continued
III-13
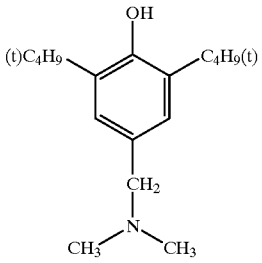
Examples of Compounds Represented by General Formula (III')
III'-1
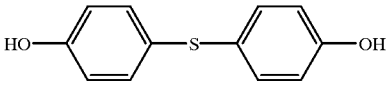
III'-2
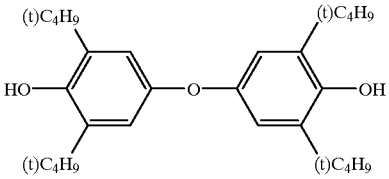
III'-3
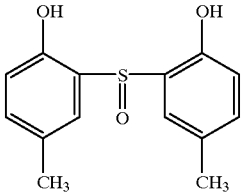
III'-4
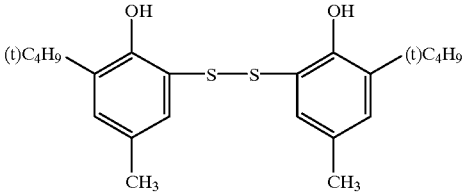
III'-5
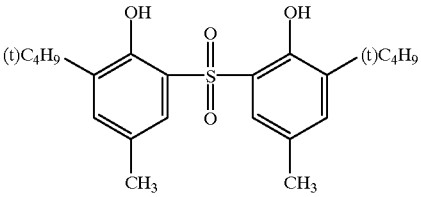
III'-6
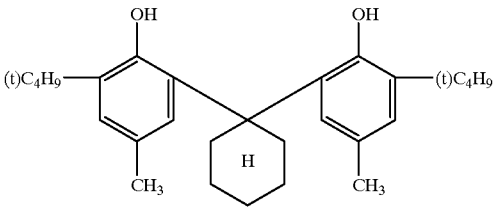

-continued
III′-7
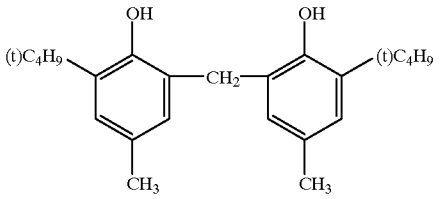
III′-8
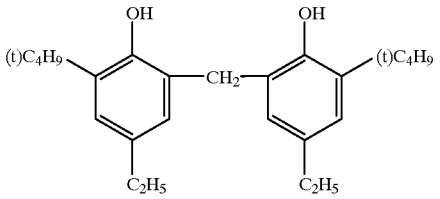
III′-9
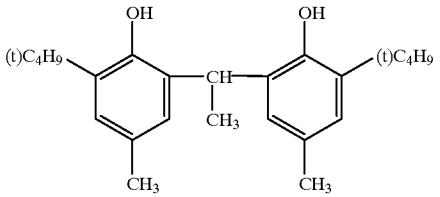
III′-10
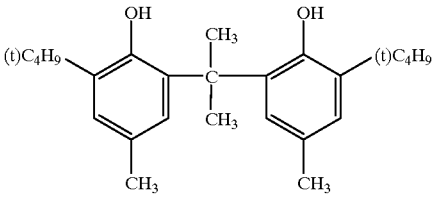
III′-11
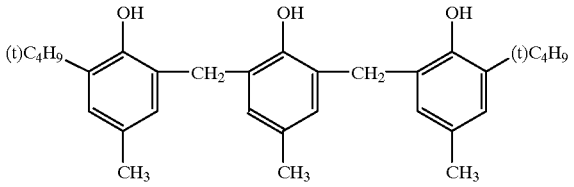
III′-12
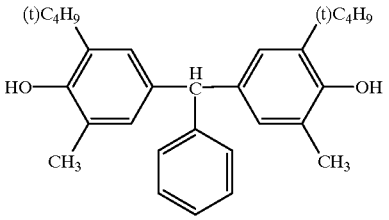
III′-13
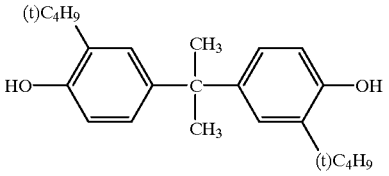
-continued
III′-14
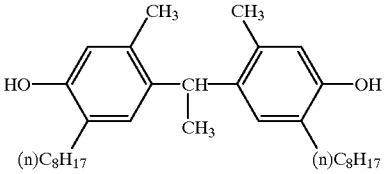
III′-15
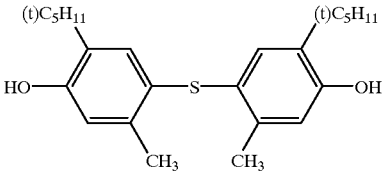
III′-16
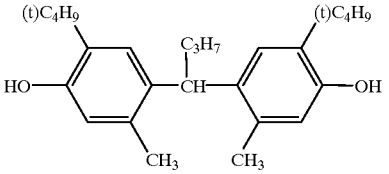
III′-17
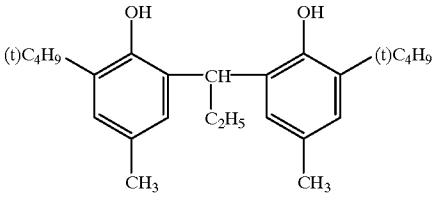
III′-18
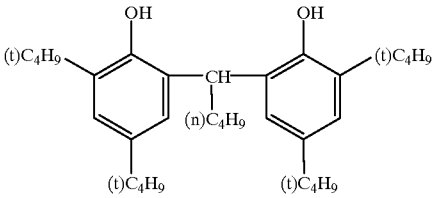
III′-19
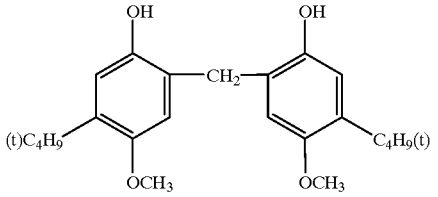
III′-20
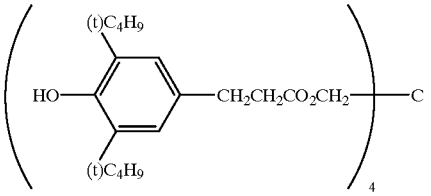
III′-21
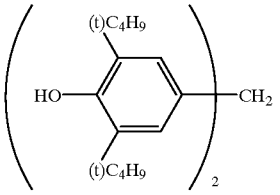

-continued
III'-22
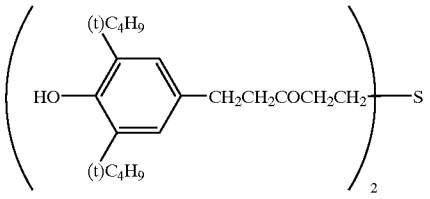
Examples of Compounds Represented by General Formula (IV)
IV-1
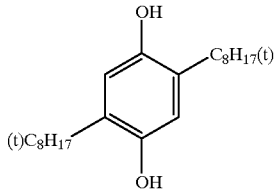
IV-2
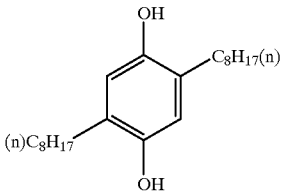
IV-3
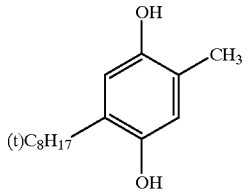
IV-4
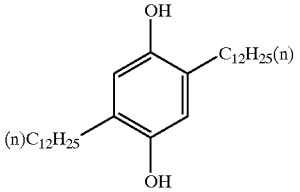
IV-5
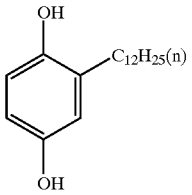
IV-6
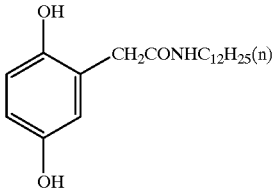
-continued
IV-7
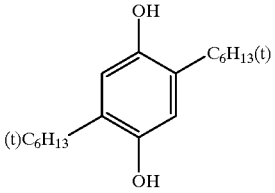
IV-8
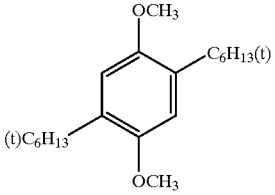
IV-9
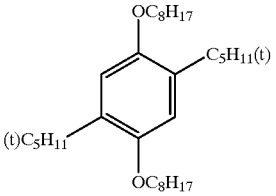
IV-10
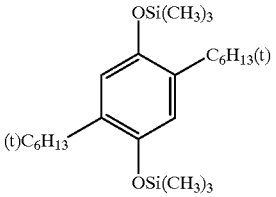
IV-11
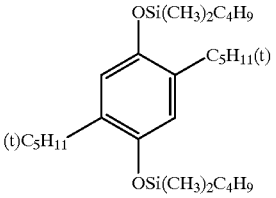
IV-12
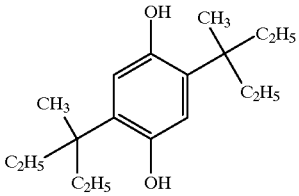
IV-13
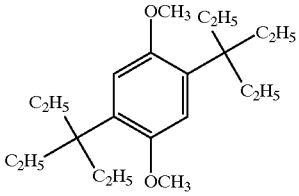

-continued
IV-14
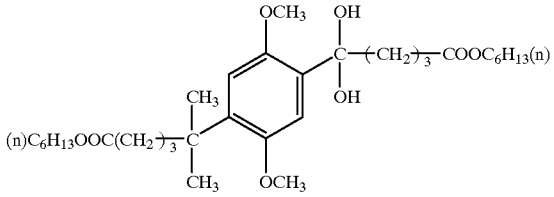
IV-15
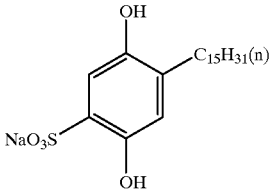
Examples of Compounds Represented by General Formula (V)
V-1
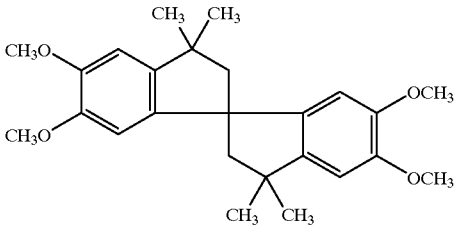
V-2
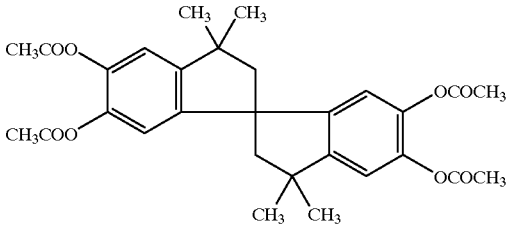
V-3
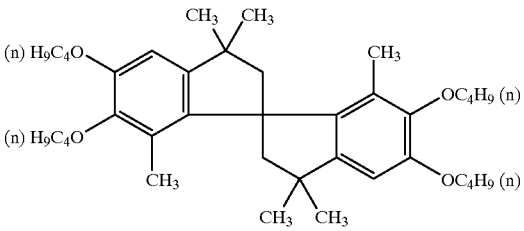
V-4
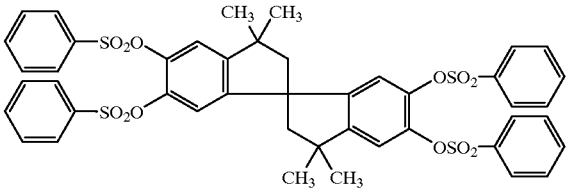
-continued
V-5
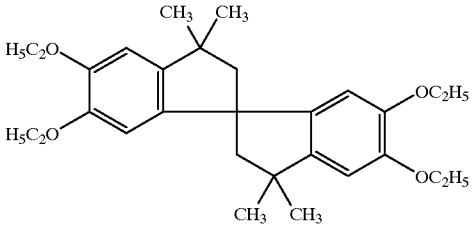
V-6
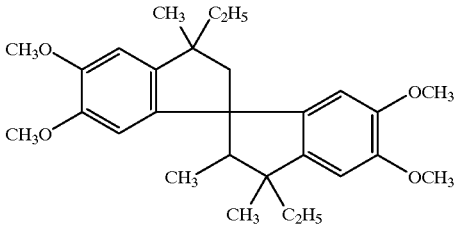
V-7
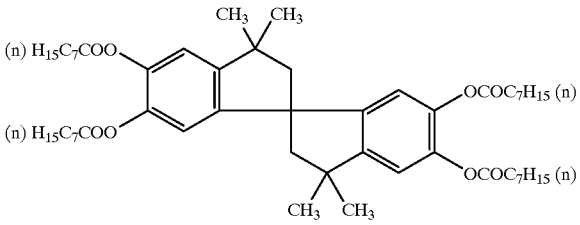
V-8
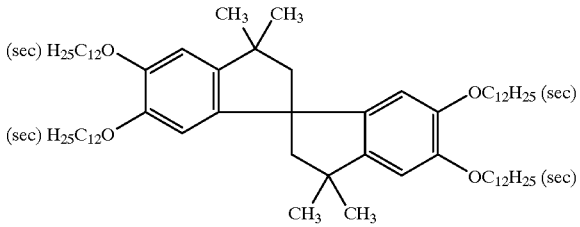
V-9
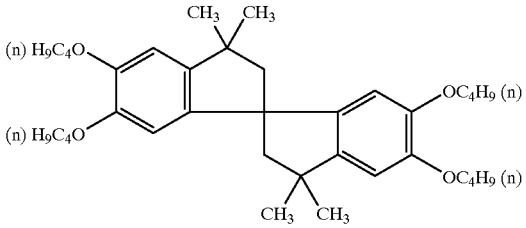
V-10
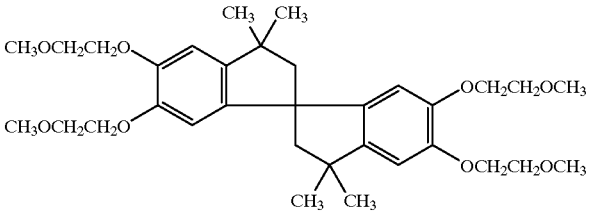

-continued
V-11
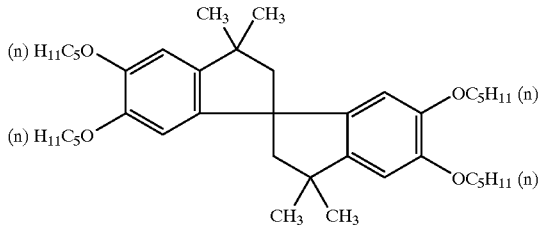
V-12
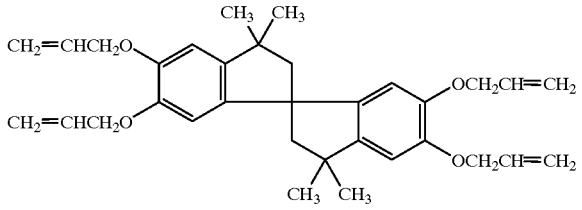
V-13
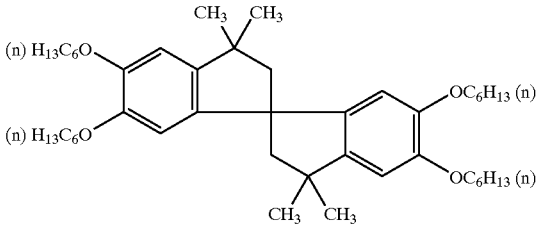
V-14
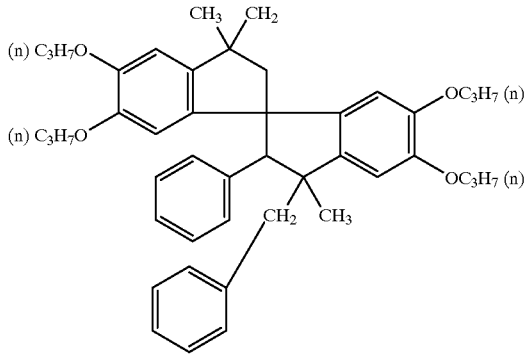
V-15
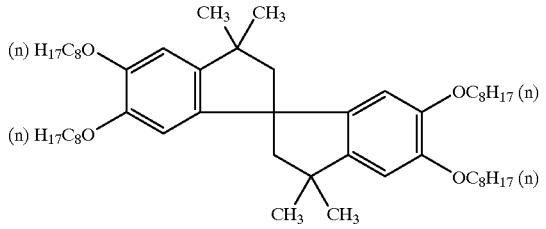
V-16
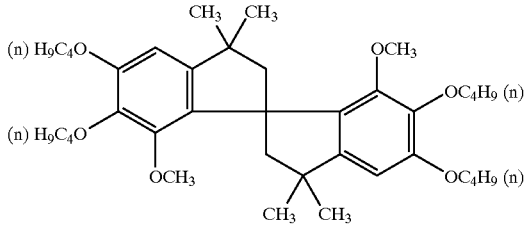
-continued
V-17
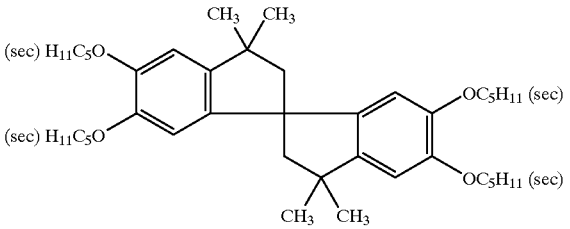
V-18
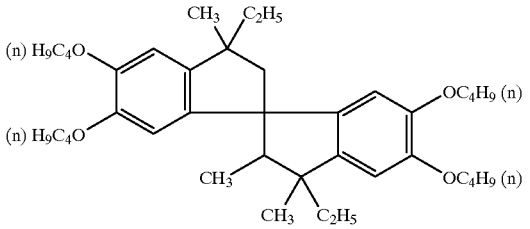
V-19
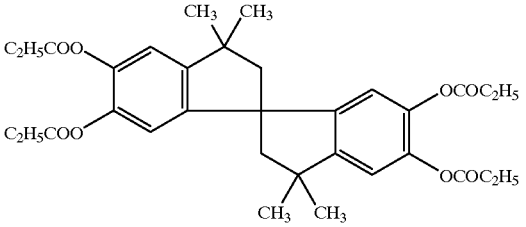
V-20
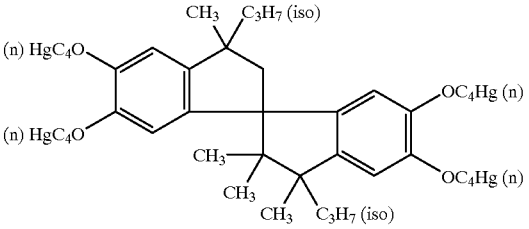
V-21
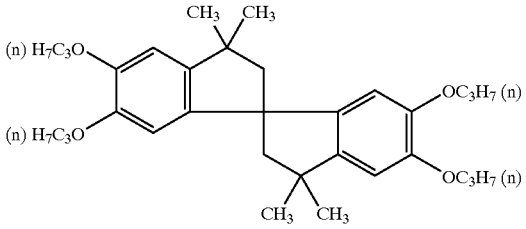
V-22
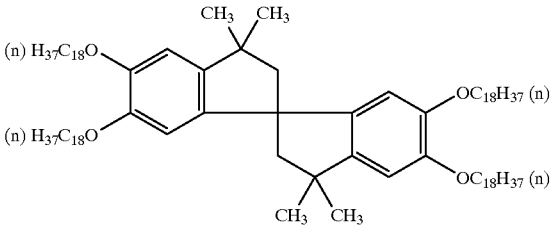

-continued
V-23
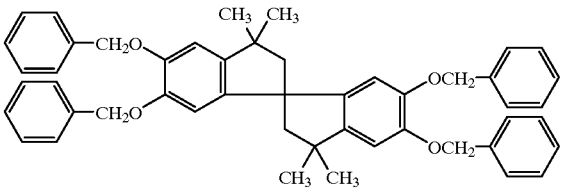
-continued
V-24
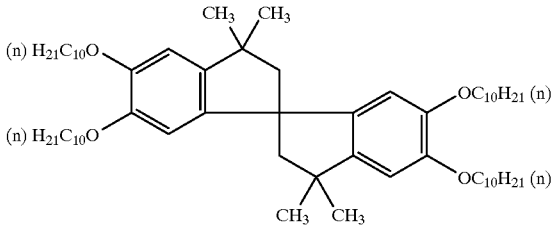
Examples of Compounds Represented by General Formula (VI)
VI-1
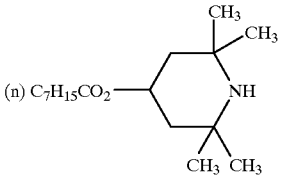
VI-2
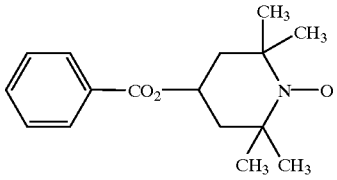
VI-3
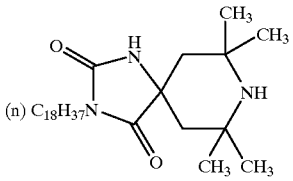
VI-4
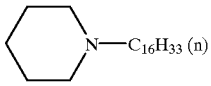
VI-5
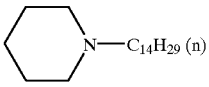
VI-6
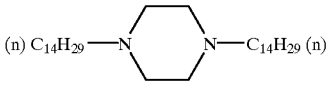
VI-7
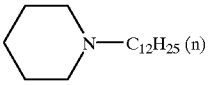
VI-8
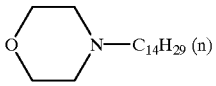
VI-9
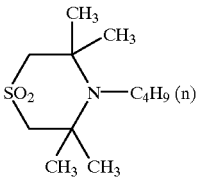
VI-10
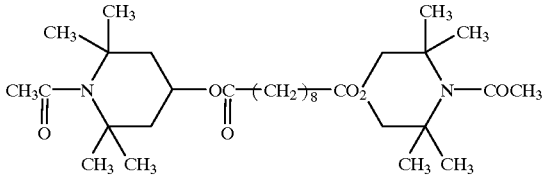

-continued
VI-11
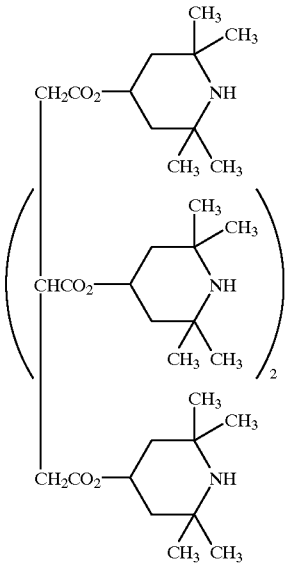
VI-12
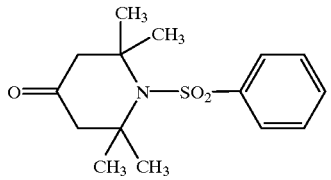
VI-13
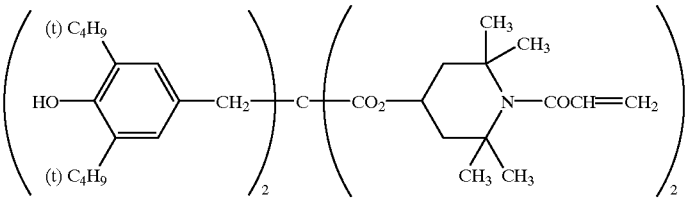
VI-14
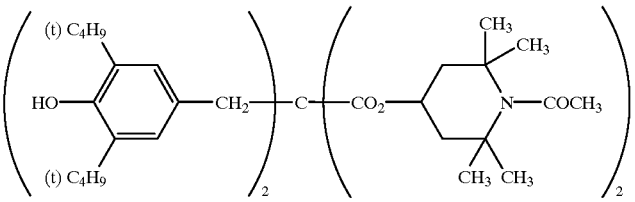
VI-15
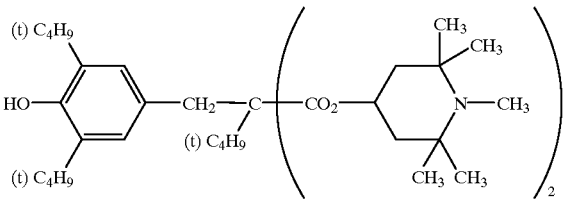
VI-16
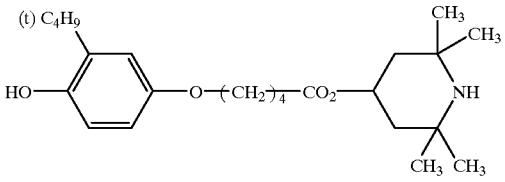

-continued

VI-17

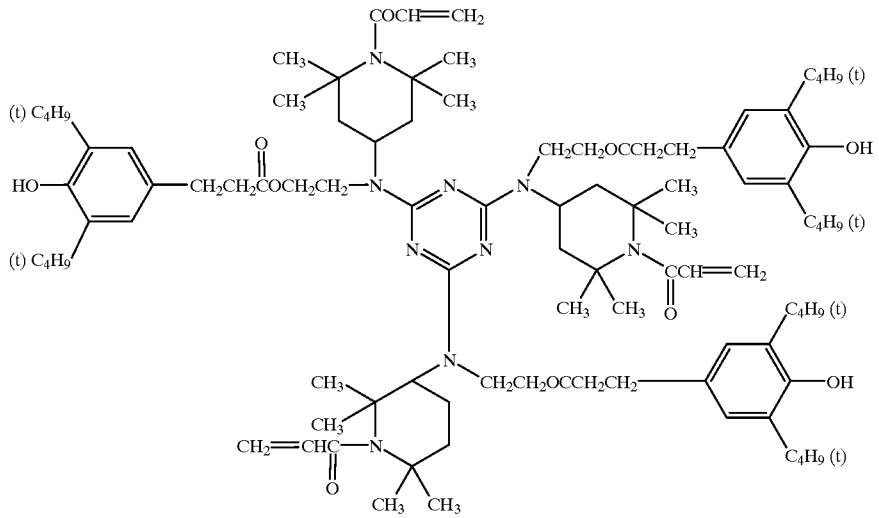

The amount used of these compounds may be from 20 to 300% by mol, preferably from 50 to 150% by mol per 1 mol of a dye fixed.

Further, these compounds can be dissolved in an organic solvent having high boiling point as described below and then emulsified and dispersed, or can be dissolved in a soluble solvent and then added directly to a dye-fixing layer or to an adjacent layer. These compounds can be synthesized by methods described in JP-A Nos. 62-244,045, 62-227,989 and 4-333,843.

Then techniques which are desirably used together with the present invention are described below.

To obtain wide range of colors on a chromaticity diagram using three primary colors of yellow, magenta and cyan, at least three silver halide layers (referred to as silver halide emulsion layer, or simply emulsion layer) each having light-sensitivity in different spectral range are combined for use. Examples thereof may include combination of a blue sensitive layer, green sensitive layer and red sensitive layer, combination of a green sensitive layer, red sensitive layer and infrared sensitive layer, combination of a red sensitive layer, infrared sensitive layer (1) and infrared sensitive layer (2), described in JP-A Nos. 59-180,550, 64-13,546 and 62-253,159, EP-A No. 479,167 and the like. Each light-sensitive layer can adopt various arranging orders known in usual color light-sensitive materials. These light-sensitive layers may each be optionally separated into two or more layers as described in JP-A No. 1-252,954. On the light-sensitive material, there can optionally be formed various non-light-sensitive layers such as a protective layer, primer layer, intermediate layer, yellow filter layer, antihalation layer, and the like between the above-described silver halide emulsion layers and in a top layer and bottom layer, and further, various complementary layer such as a back layer and the like can also be provided on the opposite side of a support. Concretely, there can be provided layer constitutions described in the patents, namely, a primer layer described in U.S. Pat. No. 5,051,335, an intermediate layer containing a solid pigment described in JP-A Nos. 1-167,838 and 61-20,943, an intermediate layer containing a reducing agent and DIR compound described in JP-A Nos. 1-129,553, 5-34,884 and 2-64,634, an intermediate layer containing an electron delivering agent described in U.S. Pat. Nos. 5,017,454 and 5,139,919, and JP-A No. 2-235,044, a protective layer containing a reducing agent described in JP-A No. 4-249,245, layers in combination thereof, or the like. It is preferable to design the support so that it has electric charge preventing function and a surface resistance of $10^{12}$ Ω·cm or less.

Then, the silver halide emulsion used in the light-sensitive material will be described in detail. The silver halide emulsion which can be used in the present invention may be any of silver chloride, silver bromide, silver iodine bromide, silver chlorine bromide, silver chlorine iodide and silver chlorine iodine bromide.

The silver halide emulsion used in the present invention may be surface latent image-type emulsion or also inner latent image-type emulsion. The above-described inner latent image-type emulsion is combined with a nuclear forming agent and light fogging agent and used as a direct inversion emulsion. Also, a so-called core-shell emulsion in which inner part has different phase from that of surface part of a particle may be possible, and silver halide having different composition may be connected by epitaxial connection. The above-described silver halide emulsion may be mono dispersion or also multi dispersion type, and there is preferably used a method in which mono dispersion emulsions are mixed and gradation is controlled as described in JP-A Nos. 1-167,743 and 4-223,463. The particle size may be from 0.1 to 2 μm, more preferably 0.2 to 1.5 μm. The crystal habit of the silver halide particle may be any of one comprising a regular crystal such as cube, octahedron and tetradecahedron, one comprising irregular crystal system such as sphere, plane having high aspect ratio, one comprising crystal defect such as twin crystal surface, and complex system thereof.

Specifically, there can be used any silver halide emulsion prepared by using a method described in U.S. Pat. No. 4,500,626, column 50, U.S. Pat. No. 4,628,021, Research Disclosure (hereinafter abbreviated as RD) No. 17,029 (1978), RD No. 17,643 (December 1978), pp. 22–23, RD No. 18,716 (November 1979), p. 648, RD No. 307,105 (November 1989), pp. 863–865, JP-A Nos. 62-253,159, 64-13,546, 2-236,546 and 3-110,555, P. Glafkides, Chemie et Phisique Photographique, Paul Montel, 1967, G. F. Duffin, Photographic Emulsion Chemistry, Focal Press, 1966, and V. L. Zelikman et al., Making and Coating Photographic Emulsion, Focal Press, 1964, and the like.

In the process for preparing the light-sensitive silver halide emulsion of the present invention, it is preferable that a salt removing process be conducted in order to remove excessive salt. For the removal of salt, employable methods may include a Noodle water-washing method in which gelatin is subjected to gelation and a flocculation method which utilizes an inorganic salt comprising a polyvalent anion (e.g., sodium sulfate), an anionic surfactant, an anionic polymer (e.g., polystyrene sulfonic acid sodium salt) or a gelatin derivative (e.g., aliphatic-acylated gelation, aromatic-acylated gelatin and aromatic-carbamoylated gelatin). A flocculation method is preferably used.

For a variety of purposes, the light-sensitive silver halide emulsion used in the present invention may contain a heavy metal such as iridium, rhodium, platinum, cadmium, zinc, thallium, lead, iron and osmium. These heavy metals may be used alone or in combination thereof (two or more of them). Although the amount added of such compounds depends on the purpose of use, the amount is generally in the range of $10^{-9}$ to $10^{-3}$ mol based on 1 mol of silver halide. The heavy metal may be present uniformly in a silver halide grain or may be present in a localized manner within or on the surface of a silver halide grain. Preferred examples of these emulsions are the emulsions described in JP-A Nos. 2-236, 542, 1-116,637 and 5-181,246.

Such compound as a rhodanate, ammonia, a tetra-substituted thioether compound and an organic thioether derivative described in JP-B No. 47-11,386, and a sulfur-containing compound described in JP-A No. 53-144,319 may be used as a solvent for silver halide in the grain forming stage for the light-sensitive silver halide emulsion used in the present invention.

For other conditions for the silver halide grain formation, reference will be made, for example, to P. Glafkides, Chemie et Phisique Photographique, Paul Montel, 1967, G. F. Duffin, Photographic Emulsion Chemistry, Focal Press, 1966, V. L. Zelikman et al., Making and Coating Photographic Emulsion, Focal Press, 1964, and the like. That is, an employable method may be selected from an acidic method, a neutral method and an ammonia method. Further, any method selected from a single jet method, a double jet method and a combination thereof may be used as a method for reacting a soluble silver salt with a soluble halide. Preferably, the double jet method is used to obtain a mono-disperse emulsion.

An reversed mixing method in which grains are formed in the presence of an excess of silver iron can also be employed. A so-called controlled double jet method in which pAg of the liquid phase for the formation of silver halide is kept constant can also be employed as a double jet method.

Meanwhile, the concentrations, amounts to be added and adding rates of the silver salt and halogen salt may be increased in order to accelerate the growth of the grains (JP-A Nos. 55-142,329 and 55-158,124, U.S. Pat. No. 3,650, 757, and the like).

The stirring of the reaction mixture may be effected by any known method. Further, the temperature and pH of the reaction mixture during the formation of silver halide grains may be selected depending on the purpose. The pH is preferably in the range of 2.3 to 8.5, and more preferably 2.5 to 7.5.

A light-sensitive silver halide emulsion is normally a chemically sensitized silver halide emulsion. A sensitizing method by means of chalcogen, such as sulfur sensitization, selenium sensitization or tellurium sensitization, a sensitizing method by means of a rare metal, such as gold, platinum or palladium, and a sensitizing method by means of reduction, which are known sensitizing methods in the preparation of conventional light-sensitive emulsions, may be used alone or in combination thereof as a chemical sensitizing method of the light-sensitive silver halide emulsion used in the present invention (see, for example, JP-A Nos. 3-110,555 and 5-241,267, and the like). A chemical sensitization according any of the above-mentioned methods can be effected in the presence of a nitrogen-containing heterocyclic compound (JP-A No. 62-253,159). Beside, an anti-fogging agent, which is described later, may be added to a silver halide emulsion after the chemical sensitization thereof. More concretely, the method, which are described in JP-A Nos. 5-45,833 and 62-40,446, can be used.

When a chemical sensitization is carried out, pH is preferably in the range of 5.3 to 10.5, and more preferably 5.5 to 8.5, while pAg is preferably in the range of 6.0 to 10.5, and more preferably 6.8 to 9.0.

The coated weight of the light-sensitive silver halide to be used in the present invention is in the range of 1 mg to 10 $g/m^2$, preferably 10 mg to 10 $g/m^2$, based on the weight of silver.

In order to impart color-sensitivity, such as green-sensitivity, red-sensitivity or infrared-sensitivity, to the light-sensitive silver halide as used in the present invention, the light sensitive silver halide emulsion is spectrally sensitized by means of methine dyes or the like. Further, if necessary, a blue-sensitive emulsion may be spectrally sensitized in order to enhance sensitivity to the light of the blue color region.

Examples of employable dyes may include cyanine dyes, merocyanine dyes, complex cyanine dyes, complex merocyanine dyes, holopolar cyanine dyes, hemicyanine dyes, styryl dyes and hemioxonol dyes, and the like.

More concrete examples of these sensitizing dyes are disclosed, for example, in U.S. Pat. No. 4,617,257 and JP-A Nos. 59-180,550, 64-13,546, 5-45,828 and 5-45,834.

Although these sensitizing dyes may be used alone, they may also be used in a combination thereof. A combination of these sensitizing dyes in often used particularly for supersensitization or for wavelength adjustment of spectral sensitization.

The light-sensitive silver halide emulsion used in the present invention may contain a compound which is a dye having no spectral sensitization effect itself or a compound substantially incapable of absorbing a visible light but which exhibits a supersensitizing effect together with the sensitizing dyes (e. g., compounds described in U.S. Pat. No. 3,615,641 and JP-A No. 63-23,145, and the like).

The above-mentioned sensitizing dye can be added to the emulsion at the stage of chemical aging or thereabout, or before or after the formation of the nucleus of the silver halide grains in accordance with the descriptions in U.S. Pat. Nos. 4,183,756 and 4,225,666. These sensitizing dyes or supersensitizers may be added to the emulsion as a solution in an organic solvent, such as methanol, and dispersion in gelation or solution containing a surfactant. The amount to be added is generally in the range of $10^{-8}$ to $10^{-2}$ mol based on 1 mol of silver halide.

Known photographic additives, which are used in the above-described processes and in the light-sensitive material and the dye-fixing material of the present invention, are described in the aforementioned RD No. 17,643, RD No. 18,716 and RD No. 307,105, the relationship in the description is shown below.

| Kinds of additives: | RD 17,643 | RD 18,716 | RD 307,105 |
|---|---|---|---|
| 1. Chemical sensitizer | p. 23 | p. 648, RC | p. 866 |
| 2. Sensitivity enhancer | p. 648, RC | | |
| 3. Spectral sensitizer/ Supersensitizer | pp. 23–24 | pp. 648, RC ~649 | pp. 866–868 |
| 4. Brightening agent | p. 24 | p. 648, RC | p. 868 |
| 5. Anti-fogging agent/ Stabilizer | pp. 24–25 | p. 649, RC | pp. 868–870 |
| 6. Light absorber/ Filter dyestuff/ Ultraviolet ray absorber | pp. 25–26 | pp. 649, RC ~650, LC | p. 873 |
| 7. Dye image stabilizer | p. 25 | p. 650, LC | p. 872 |
| 8. Film hardener | p. 26 | p. 651, LC | pp. 874–875 |
| 9. Binder | p. 26 | p. 651, LC | pp. 873–874 |
| 10. Plasticizer/ Lubricant | p. 27 | p. 650, RC | p. 876 |
| 11. Coating aid/ Surfactant | pp. 26–27 | p. 650, RC | pp. 875–876 |
| 12. Anti-static agent | p. 27 | p. 650, RC | pp. 876–877 |
| 13. Matting agent | | | pp. 878–879 |

RC: right column,
LC: left column

The binder for a constituent layer of the light-sensitive material and dye-fixing material is preferably a hydrophilic material, examples of which include those described in the aforesaid Research Disclosure and in JP-A No. 64-13,546, pp. 71–75. More specifically, the binder is preferably a transparent or translucent hydrophilic material, exemplified by a naturally occurring compound, such as a protein including gelatin and a gelatin derivative; and a polysaccharide including a cellulose derivative, starch, gum arabic, dextran and pullulane, and by a synthetic polymer such as polyvinyl alcohol, polyvinyl pyrrolidone and acryl amide polymer. Also usable as the binder is a highly water-absorbent polymer described in U.S. Pat. No. 4,960,681 and JP-A No. 62-245,260, for example, a homopolymer composed of a vinyl monomer having —COOM or —$SO_3M$ (M stands for a hydrogen atom or an alkali metal), or a copolymer obtained by a combination of these monomers or obtained by a combination of at least one of these monomers and another monomer(s) such as sodium methacrylate and ammonium methacrylate (e. g., SUMIKAGEL L-5H manufactured by Sumitomo Chemical Co., Ltd.). These binders may be used alone or in a combination of two or more of them. Particularly, a combination of gelatin and any of the above-mentioned non-gelatin binders is preferable. Gelatin may be advantageously selected from a lime-processed gelatin, acid-processed gelatin and delimed gelatin which has undergone a deliming process to decrease the content of calcium and the like can be used, depending on purposes, and it is also preferred to combine them.

When a system in which heat developing is conducted with supplying a small amount water is adopted, it is possible to effect absorption of water quickly by using the above-described high water-absorbent polymer. Further, apart from the present invention, when a high water-absorbent polymer is used in the dye-fixing layer and protective layer thereof, it is possible to prevent a dye from re-transferring from the dye-fixing material to other materials after transfer.

In the present invention, it is suitable that the amount coated of a binder in the light-sensitive material and dye-fixing material is from about 0.2 to 20 g, preferably from 0.2 to 10 g, more preferably from 0.5 to 7 g per 1 $m^2$ of the material.

An organic metal salt may be used as an oxidant together with a light-sensitive silver halide in the present invention. Among these organic metal salts, an organic silver salt is particularly preferable.

Examples of the organic compounds which can be used for the preparation of the above-mentioned organic silver salts serving as an oxidant may include benzotriazoles, fatty acids and other compounds described in U.S. Pat. No. 4,500,626, columns 52–53. The silver acetylide described in U.S. Pat. No. 4,775,613 is also useful. These organic silver salts may also be used in a combination of two or more of them.

The above-mentioned organic silver salt can be used in an amount in the range of 0.01 to 10 mol, and preferably 0.01 to 1 mol, based on 1 mol of the light-sensitive silver halide. The total coated weight of the light-sensitive silver halide and the organic silver salt is in the range of 0.05 to 10 g/$m^2$, and preferably 0.1 to 4 g/$m^2$, in terms of the weight of silver.

The reducing agent may be used in the present invention, which is known in the art of a light-sensitive material. Further, a dye donative compound having reducing property as described later is also included (in this case, other reducing agents can also be used together). Further, there can also be used a reducing agent precursor which does not have reducing property itself and exhibits reducing property by being influenced by a nucleophilic agent, or in the presence of heat in developing process.

Examples of the reducing agent used in the present invention may include reducing agents and reducing agent precursors described in U.S. Pat. No. 4,500,626, columns 49 to 50, U.S. Pat. Nos. 4,839,272, 4,330,617, 4,590,152, 5,017,454 and 5,139,919, JP-A Nos. 60-140,335, pp. (17) to (18), 57-40,245, 56-138,736, 59-178,458, 59-53,831, 59-182,449, 59-182,450, 60-119,555, 60-128,436, 60-128,439, 60-198,540, 60-181,742, 61-259,253, 62-201,434, 62-244,044, 62-131,253, 62-131,256, 63-10,151, 64-13,546, pp. (40) to (57), 1-120,553, 2-32,338, 2-35,451, 2-234,158 and 3-160,443, EP-A No. 220,746, pp. 78 to 96, and the like.

Combinations of various reducing agents disclosed in U.S. Pat. No. 3,039,869 can also be used.

When nondiffusion reducing agent is used, an electron transporting agent and/or precursor thereof can be optionally combined for use to accelerate electron transportation between the nondiffusion reducing agent and a developable silver halide. Particularly preferably, those described in the above-described U.S. Pat. No. 5,139,919, EP-A No. 418,743, and JP-A Nos. 1-138,556 and 3-102,345 are used. Further, methods for introducing an electron into a layer in stable manner as described in JP-A Nos. 2-230,143 and 2-235,044 are preferably used.

The electron transporting agent or the precursor thereof can be selected from the above-described reducing agents or precursors thereof. The electron transporting agent or the precursor thereof preferably has higher moving property than that of the nondiffusion reducing agent (electron donor).

The nondiffusion reducing agent (electron donor) used together with the electron transporting agent may advantageously be that does not substantially move into a layer of a light-sensitive material among the above-described reducing agents. Preferably, examples thereof may include hydroquinones, sulfonamidephenols, sulfonamidenaphthols, compounds described as an electron donor in JP-A No. 53-110,827, and U.S. Pat. Nos. 5,032,487, 5,026,634 and 4,839,272, and nondiffusion dye donative compounds having reducing property as described later, and the like.

Further, electron donor precursors described in JP-A No. 3-160,443 are also used preferably.

The above-described reducing agents can be used in the intermediate layer and protective layer for various purposes such as prevention of color mixing, improvement in color reproducibility, improvement in white ground, prevention of silver transfer to a dye-fixing material, and the like. Preferably, for example, there can be used the reducing agent described in EP-A Nos. 524,649 and 357,040, and JP-A Nos. 4-249,245, 2-64,633, 2-46,450 and 63-186,240. Also, there can be used reductive compounds which release a development inhibitor described in JP-B No. 3-63,733, JP-A Nos. 1-150,135, 2-110,557, 2-64,634 and 3-43,735, and EP-A No. 451,833.

In the present invention, the total amount added of the reducing agents may be from 0.01 to 20 mol, preferably from 0.1 to 10 mol based on 1 mol of silver.

Hydrophobic additives such as a nondiffusion reducing agent and the like can be introduced into layers of the light-sensitive material according to known methods such as described in U.S. Pat. No. 2,322,027 and the like. In this case, an organic solvent having high boiling point described in U.S. Pat. Nos. 4,555,470, 4,536,466, 4,536,467, 4,587,206, 4,555,476 and 4,599,296, JP-B No. 3-62,256 and the like can be optionally used together with an organic solvent having a low boiling point of 50 to 160° C. These dye donative compound, nondiffusion reducing agent and organic solvent having a high boiling point can be used in combination of two or more.

The amount of the organic solvent having high boiling point may be 10 g or less, preferably 5 g or less, and more preferably 1 to 0.1 g per 1 g of a nondiffusion reducing agent used. Alternatively, it may be 1 cc or less, further 0.5 cc or less and particularly 0.3 cc or less per 1 g of a binder.

Further, there can also be used a diffusion method using a polymer described in JP-B No. 51-39,853 and JP-A No. 51-59,943, and a method in which a fine particle dispersion thereof is added described in JP-A No. 62-30,242 and the like.

In the case of a compound which is substantially insoluble in water, a fine particle thereof can be dispersed and included in a binder in addition to the above-described methods.

When the hydrophobic compound is dispersed in a hydrophilic colloid, various surfactant can be used. For example, there can be used surfactants described in JP-A No. 59-157,636, pp. (37) to (38) and the above-described Research Disclosure.

In the light-sensitive material of the present invention, a compound which can realize stabilization of an image simultaneously with activation of development can be used. Preferably, there can be used compounds described in U.S. Pat. No. 4,500,626, pp. 51 to 52.

In a system which forms an image by diffusion transferring of a dye, various compounds can be added to constitutional layers of the light-sensitive material of the present invention for the purpose of fixation and de-coloring of a dye and coloring material which are not necessary and improvement in white ground of the resulting image.

Specifically, compounds described in EP-A Nos. 353,741 and 461,416, and JP-A Nos. 63-163,345 and 62-203,158 can be used.

In the constitutional layers of the light-sensitive material of the present invention, various pigments and dyestuffs can be used for the purpose of improvement in color discrimination, high-sensitization and the like.

Specifically, there can be used compounds described in the above-described Research Disclosure, and compounds and layer constructions described in EP-A Nos. 479,167 and 502,508, JP-A Nos. 1-167,838, 4-343,355, 2-168,252 and 61-20,943, EP-A Nos. 479,167 and 502,508, and the like.

In the present invention, a dye-fixing material is used together with the heat developable light-sensitive material to form an image by diffusion transfer of a dye. The dye-fixing material may be coated on a support other than that coated with the light-sensitive material, or may be coated on the same support on which the light-sensitive material is coated. Mutual relation of a light-sensitive material and dye-fixing material, relation to a support, relation to a white reflective layer each described in U.S. Pat. No. 4,500,626, column 57 can also be applied to the present invention.

The dye-fixing material preferably used in the present invention has at least one layer containing a mordant and binder. As the mordant, there can be used an agent known in photography filed. Examples thereof may include mordants described in U.S. Pat. No. 4,500,626, columns 58 to 59, JP-A No. 61-88,256, pp. (32) to (41) and JP-A No. 1-161,236, pp. (4) to (7), mordants described in U.S. Pat. Nos. 4,774,162, 4,619,883 and 4,594,308 and the like. Further, dye receptive polymer compounds described in U.S. Pat. No. 4,463,079 may also be used.

The binder used in the dye-fixing material of the present invention is preferably the above-described hydrophilic binder. Further, carageenans described in EP-A No. 443,529 can be preferably used, and latexs having a glass transition temperature of 40° C. or less described in JP-B No. 3-74,820 can preferably be used.

Optionally, auxiliary layers such as a protective layer, releasing layer, primer layer, intermediate layer, backing layer, curl prevention layer and the like can be provided in the dye-fixing material. Particularly, it is useful to provide a protective layer.

In the constitutional layers of the light-sensitive material and dye-fixing material, there can be used a plasticizer and slippery agent, or an organic solvent having a high boiling point as a releasability improving agent between the light-sensitive layer and dye-fixing material. Concrete examples thereof are described in the above-described Research Disclosure, JP-A No. 62-245,253 and the like.

Further, for the above-described object, various silicone oils (all silicone oils including dimethyl silicone oil and modified silicone oil obtained by introducing various organic groups into dimethylsiloxane) can be used. Effective examples thereof may include various modified silicone oils described in Modified Silicone Oil technical data P6-18B published by Shin-Etsu Silicone Co., Ltd., particularly carboxy-modified silicone (trade name: x-22-3710) and the like.

Further, silicone oils described in JP-A Nos. 62-215,953 and 63-46,449 are also effective.

A brightening agent may also be used in the light-sensitive material and the dye-fixing material. It is preferable that the brightening agent is originally contained in the dye-fixing material, or supplied together with additives such as the heat developable light-sensitive material and transfer solvent. Examples thereof may include compounds described in K. Veekataraman, "The Chemistry of Synthetic Dyes", V, chapter 8, JP-A No. 61-143,752 and the like. More specific examples thereof may include stylbene-based compounds, cumarine-based compounds, biphenyl-based compounds, benzoxazolyl-based compounds, naphthalimide-based compounds, pyrazoline-based compounds, carbostylyl-based compounds and the like.

The brightening agent can be used in combination with a discoloring inhibitor and ultraviolet ray absorber.

The concrete examples of these discoloring inhibitor, ultraviolet ray absorber and brightening agent are described in JP-A Nos. 62-215,272, pp. (125) to (137) and 1-161,236, pp. (17) to (43).

Examples of the film hardener used in the constitutional layer of the light-sensitive material and the dye-fixing material may include those described in the above-described Research Disclosures, U.S. Pat. No. 4,678,739, column 41 and U.S. Pat. No. 4,791,042, and in JP-A Nos. 59-116,655, 62-245,261, 61-18,942 and4-218,044 and the like. More specifically, examples of these hardeners may include and aldehyde (e.g., formaldehyde), an aziridine, an epoxy, a vinylsulfone (e.g., N,N'-ethylene-bis (vinylsulfonylacetamide)ethane), a N-methylol compound (e.g., dimethylolurea) and a polymeric compound (e.g., a compound descried in JP-A No. 62-234,157).

The amount of the hardener added may be in the range of 0.001 to 1 g, and preferably 0.005 to 0.5 g, based on 1 g of coated gelatin. Further, a layer to which the film hardener is added may be any layer of constitutional layers of a light-sensitive material and dye-fixing material. Also, the amount of the hardener may be separated into two or more layers before addition of the hardener.

The constitutional layers of the heat developable light-sensitive material and the dye-fixing material may contain various anti-fogging agents or photographic stabilizers or precursors thereof. Specific examples thereof may include azole and azaindenes described in RD 17643 (1978), pp. 24 to 25, carboxylic acids and phosphoric acids containing nitrogen described in JP-A No. 59-168,442, mercapto compounds and metal salts thereof described in JP-A No. 59-111,636, acetylene compounds described in JP-A No. 62-87,957, and the like. In the present invention, when a precursor is used, it is preferably contained in the light-sensitive silver halide emulsion layer as described above, and can also used in the dye-fixing material.

When the compound is not a precursor, the amount of the compound added may be preferably in the range of $5\times10^{-6}$ to $1\times10^{-1}$ mol, and more preferably $1\times10^{-5}$ to $1\times10^{-2}$ mol, based on 1 mol of silver. In the case of a precursor, the more preferably amount used is as described above.

For such purposes as improvement of the coatability, improvement of the releasability, improvement of the slipperiness, prevention of electrostatic charge and acceleration of developing reaction, various surfactant may be added to the constitutional layers of the light-sensitive material and the dye-fixing material. Specific examples of the surfactants may include those described in the above-described Research Disclosure, JP-A Nos. 62-173,463 and 62-183,457 and the like.

For such purposes as prevention of slip, prevention of electrostatic charge and improvement of the releasability, an organic fluorine-containing compound may be added to the constitutional layers of the light-sensitive material and the dye-fixing material. Typical examples of the organic fluorine-containing compounds may include a fluorine-containing surfactant and a hydrophobic fluorine-containing compound, such as an oily fluorine-containing compound, e.g., fluorocarbon oil, and a solid fluorine-containing resin, e.g., tetrafluoroethylene, described in JP-B No. 57-9,053, columns 8–17, JP-A Nos. 61-20,944 and 62-135,826 and the like.

For such purposes as prevention of adhesion, improvement of slipperiness, and the like, a matting agent can be used in the light-sensitive material and the dye-fixing material. Examples of the matting agent may include compounds described in JP-A Nos. 63-274,944 and 63-274,952 such as a benzoguanamine resin bead, polycarbonate resin bead, ABS resin bead and the like, in addition to compounds described in JP-A No. 61-88,256, p. 29 such as silicon dioxide, polyolefin, polymethacrylate and the like. Further, compounds described in the above-described Research Disclosure can be used.

These matting agents can be added, if necessary, not only to the top layer (protective layer) but also to a lower layer.

Further, the constitutional layers of the light-sensitive material and the dye-fixing material may contain heated solvent, de-foaming agent, antimicrobial agent, colloidal silica and the like. Specific examples of these additives are described in JP-A No. 61-88,256, pp. 26 to 32, JP-A No. 3-11,338, JP-B No. 2-51,496 and the like.

In the present invention, an image formation accelerator can be used in the light-sensitive material and/or the dye-fixing material. The image formation accelerator has such functions as promotion of a redox reaction of a silver salt oxidizing agent with a reducing agent, promotion of reactions such as formation or decomposition of a dye from the dye donative material or releasing of a diffusible dye, and promotion of movement of a dye from the layer of the light-sensitive material to a dye-fixing layer, and the like, and is classified from the view point of physicochemical functions into a base or base precursor, nucleophilic compound, high boiling point organic solvent (oil), heated solvent, surfactant, compound having mutual action with silver or silver ion, and the like. Since these compounds have generally complex functions, they usually have several functions described above in combination. The details thereof are described in U.S. Pat. No. 4,678,739, columns 38 to 40.

Examples of the base precursor may include a salt of a base and an organic acid which is de-carbonated by heating, a compound which releases amines by intramolecular nucleophilic substitution reaction, Lossen transformation or Beckmann transformation, and the like. Specific examples thereof may be described in U.S. Pat. Nos. 4,514,493, 4,657,848 and the like.

In a system wherein heat development and transfer of a dye are conducted simultaneously in the presence of a small amount of water, a method in which a base and/or base precursor is contained in the dye-fixing material is preferable in terms of increased preservability of the heat developable light-sensitive material.

In addition to the above-described methods, a combination of a poor-soluble metal compound with a compound (complex forming compound) which can effect complex forming reaction with a metal ion constituting this poor-soluble metal compound described in EP-A No. 210,660 and U.S. Pat. No. 4,740,445, a compound which generates a base by electrolysis described in JP-A No. 61-232,451, and the like can also be used as the base precursor. Particularly, the former method is effective. It is advantageous that the poor-soluble metal compound and complex forming compound are added separately to the light-sensitive material and the dye-fixing material as described in the above-described patents.

In the present invention, various development stopping agents can be used in the light-sensitive material and/or the dye-fixing material for the purpose of obtaining usually constant image in spite of variation in treating temperature and treating time in developing.

The above-described development stopping agent means a compound which, after suitable developing, neutralizes a base or reacts with a base quickly to lower the base concentration in a film to stop the development or a compound which acts on silver or silver salt mutually to suppress the development. Specific examples thereof may include an acid precursor which releases an acid by heating, an electrophilic compound which causes substitution reaction with a coexisting base by heating, a nitrogen-containing heterocyclic compound, a mercapto compound and precursors thereof, and the like. The more details are described in JP-A No. 62-253159, pp. 31 to 32.

In the present invention, as the support of the light-sensitive material and the dye-fixing material, those which can endure the treating temperature can be used. In general, supports for photography such as paper, synthetic polymer (film) and the like described in Japanese Photographic Institue "Base for Photographic Technology (ed. by Silver Salt Photography)" Corona Corp., 1979, pp. (223) to (240), can be listed. Specific examples thereof may include films composed of polyethylene terephthalate, polyethylene naphthalate, polycarbonate, poly vinyl chloride, polystyrene, polypropylene, polyimide or celluloses (for example, triacetylcellulose) or such films containing a pigment such as titanium oxide and the like, and film method synthetic paper made from polypropylene, mixed paper made from natural pulp and synthetic resin pulp such as polyethylene and the like, Yankee paper, baryta paper, coated paper (particularly, cast-coated paper), metal, fabrics, glasses and the like.

These may be used alone, or may be used in the form of a support of which one side or both sides are laminated with a synthetic polymer such as polyethylene and the like. This laminated layer can optionally contain a pigment and dyestuff such as titanium oxide, ultramarine blue pigment, carbon black and the like.

In addition, supports described in JP-A Nos. 62-253,159, pp. (29) to (31), 1- 61,236, pp. (14) to (17), 63-316,848, 2-22,651 and 3-56,955, U.S. Pat. No. 5,001,033, and the like can be used.

The back surface of the support may be coated with a hydrophilic binder and a semiconductive metal oxide such as alumina sol and tin oxide, carbon black and other antistatic agents. Concretely, supports which are described in JP-A No. 63-220,246 and the like can be used.

Further, the front surface of the support is preferably subjected to various surface treatments and primer coating for the purpose of improving adhesion with the hydrophilic binder.

For exposure and recording of an image on the light-sensitive material, there are, for example, a method in which scenery and people are directly photographed using a camera, a method in which exposure is effected through a reversal film or negative film using a printer and projector, a method in which scanning exposure of an original image is effected through a slit and the like using an exposing apparatus of a copy machine, a method in which light emission is effected from an emission diode, various lasers (laser diode, gas laser) and the like via electric signals and scanning exposure is conducted on an image information (methods described in JP-A Nos. 2-129625, 5-176144, 5-199372, 6-127021 and the like), a method in which an image information is output on an image showing apparatus such as CRT, liquid crystal display, electroluminescence display, plasma display and the like, and exposure is effected directly or through an optical system, and the like.

As light source for recording an image on the light-sentsitive material, there can be used light sources and exposing methods described in U.S. Pat. No. 4,500,626, column 56, JP-A Nos. 2-53,378 and 2-54,672 such as natural light, tungsten lamp, light emitting diode, laser light source, CRT light source and the like, as described above.

Further, image exposure can also be conducted using a wavelength converting element which is obtained by combining a non-linear optical material with a coherent light source such as laser light and the like. The above-described non-linear optical material is a material which can manifest non-linear characteristic between electric field and polarization which occurs when strong light electric field such as a laser light is imparted. There are preferably used inorganic compounds represented by lithium niobate, potassium dihydrogen phosphate (KDP), lithium iodate, $BaB_2O_4$ and the like, urea derivatives, nitroaniline derivatives, for example, nitropyridine-N-oxide derivatives such as 3-methyl-4-nitropyridine-N-oxide (POM), compounds described in JP-A Nos. 61-53462 and 62-210432. As the form of the wavelength converting element, monocrystalline light directing route type, fiber type and the like are known, and any of them may be useful.

Further, the above-described image information can utilize image signals obtained from a video camera, electronic still camera and the like, television signals represented by that stipulated by Nippon Television Signal Criteria (NTSC), image signals obtained by dividing an original image into many picture elements such as a scanner, and image signals made by a computer represented by CG, CAD.

The light-sensitive material and/or the dye-fixing material of the present invention may adopt form having an electroconductive heat generating layer as a heating means for heat development and diffusion transfer of a dye. As the heat generating element in this case, those described in JP-A No. 61-145544 and the like can be used.

The heating temperature in the heat developing may be from about 50 to 250° C., preferably from about 60 to 180° C. The diffusion transfer process of a dye may be conducted simultaneously with the heat development or may be conducted after completion of the heat development process. In the latter case, it is preferable that the heating temperature in the transfer process is particularly 50° C. or higher and lower than the temperature in the heat developing process by about 10° C., though the transfer process can be conducted at from room temperature to the temperature in the heat developing process.

Although a dye moves in the presence of heat, a solvent may be used to promote the dye movement. A method is also useful in which development and transfer are conducted simultaneously or continuously by heating in the presence of a small amount of solvent (especially, water) described in U.S. Pat. Nos. 4,704,345 and 4,740,445, JP-A No. 61-238,056 and the like. In this method, the heating temperature may be preferably 50° C. or higher and not more than boiling point of the solvent. For example, when the solvent is water, it is preferably from 50 to 100° C.

Examples of the solvent used to promote development and/or diffusion transfer of a dye may include water, an aqueous basic solution containing an inorganic alkaline metal salt and an organic base (as described above in the column of the image formation promoter), a solvent having a low boiling point or a mixed solvent of the solvent having a low boiling point and water or the above-described aqueous basic solution. Further, the solvent may contain a surfactant, antifoggant, compound which forms a complex with a poor-soluble metal salt, antifungal agent and antimicrobial agent.

As the solvent used in these heat developing and diffusion transfer, water is preferably used. The water may be any water usually used. Concretely, distilled water, tap water, well water, mineral water and the like can be used. Further, in a heat developing apparatus using the heat developable light-sensitive material and the dye-fixing material of the present invention, water may be used without recycling or may be recycled and used repeatedly. In the latter case, water containing components eluted from wood shall be used. There may also be used apparatuses and water described in JP-A Nos. 63-144,354, 63-144,355, 62-38,460, 3-210,55 and the like.

These solvents may be added to the heat developable light-sensitive material, the dye-fixing material or both of them. The amount used thereof may be not more than the weight of solvent corresponding to the maximum swollen volume of the total coated film.

As this method for imparting water, there are preferably used methods described in JP-A Nos. 62-253,159 p. (5), and 63-85,544, 10-26,818, and the like. It is also possible that a solvent is enclosed in a micro capsule, or a solvent is previously contained in the heat developable light-sensitive material or the dye-fixing element or both of them in the form of a hydrate.

The temperature of water added may be from 30 to 60° C. as described in JP-A No. 63-85,544 and the like. Particularly, it is useful that the temperature is 45° C. or higher for the purpose of preventing proliferation of contaminant bacteria in water.

To promote dye movement, a hydrophilic hot solvent which is solid at ambient temperature and is dissolved at high temperature can be contained in the heat developable light-sensitive material and/or the dye-fixing material. The layer which contains the solvent may be any of a light-sensitive silver halide emulsion layer, intermediate layer, protective layer and dye-fixing layer, and a dye-fixing layer and/or adjacent layer thereof is preferable.

Examples of the hydrophilic hot solvent may include ureas, pyridines, amides, sulfonamides, imides, alcohols, oximes and other heterocyclic rings.

Examples of heating method in the development and/or transfer process may include contacting to a heated block and plate, contacting to a heat plate, hot presser, heat roller, heat drum, halogen lamp heater, infrared and far infrared lamp heaters and the like, passing through high temperature atmosphere, and the like. For laminating the heat developable light-sensitive material and the dye-fixing material, there can be adopted methods described in JP-A Nos. 62-253,159, 61-147,244 p. (27) and the like.

For treatment of the photographic element of the present invention, any of various heat developing apparatuses. For examples, apparatuses described in JP-A Nos. 59-75,247, 59-177,547, 59-181,353 and 60-18,951, Japanese Utility Model Application Laid-Open (JP-U) No. 62-25,944 and the like are preferably used. As the commercially available apparatus, there can be used PICTOSTAT 100 and 200, PICTOGRAPHY 3000 and 2000 manufactured by Fuji Photo Film Co., Ltd., and the like.

When an image obtained from the above-described light-sensitive material and dye-fixing element is used as a color proof for printing, the method for concentration expression thereof may be conducted by any of a continuous gradation control method, area gradation control method utilizing parts of discontinuous concentration, or a gradation control method obtained by combining them.

When LD or LED is used as a light source, output of a digital signal is possible. Thus, a using method in which control of design and hue of a print is conducted on CRT and a color proof is output as final output (DDCP) is possible. Namely, DDCP is an effective means for conducting output of a proof efficiently in the field of a color proof. This is the reason why i) a color printer has relatively simple structure and is inexpensive; ii) by using the color printer, as is well known, production of a preparation film for a color printer and production of a press plate (PS plate) and the like are not necessary; and iii) thus, a hard copy obtained by forming an image on a sheet can be easily produced in a short period of time for several times.

When LD or LED is used as a light source, it is preferable that three spectral sensitivities of yellow, magenta and cyan, four spectral sensitivities of yellow, magenta, cyan and black, or, for the purpose of obtaining desirable hue, spectral sensitivities of respective colors obtained by mixing two or more color materials, have respective peaks of the spectral sensitivities at separate wavelengths respectively apart by 20 nm or more. Further, as other method, when spectral sensitivities of two or more different colors have difference by 10 times or more, there is also adopted a method in which an image of two or more colors is obtained by one radiation wavelength.

Then, a method for reproducing moire of a print by a color printer will be described below.

To produce a color proof for printing by a color printer of low resolution, which correctly reproduces moire and the like appearing on a print of high resolution, respective net point area ration data aj of a CMYK4 size plate are converted to 48800 DPI bit map data b'j respectively by referring to a threshold matrix 24. Then, area ratio ci of each color is counted by referring simultaneously to bit map data b'j in given range. Then, primary three stimulation value data X, Y, Z of 1600 DPI which show measured value data of the above-described respective colors previously determined are calculated. Secondary three stimulation value data X', Y', Z' of 400 DPI are calculated by conducting anti-areazing filter treatment against this primary three stimulation value data X, Y, Z. These calculated data are used as input data for the color printer.

When color image recording is conducted using an output apparatus such as a color printer and the like, it is possible, for example, that a color image having desired color is realized by manipulating color signals of yellow, magenta and cyan. However, since the color signals depend on output property of an output apparatus, it is necessary that a color signal supplied from an extraneous apparatus having different property is subjected to color converting treatment with considering the above-described output property.

Then, a plurality of known color patches having different colors are produced by using the output apparatus. Then, the color of the above-described color patch is measured, to obtain, for example, conversion relation (hereinafter, referred to as orderly conversion relation) in which known color signals CMY of the above-described color patch are converted to stimulation value signals XYZ which do not depend on the output apparatus. Then, conversion relation (hereinafter, referred to as reverse conversion relation) by which stimulation value signals XYZ are converted to color signals CMY is calculated utilizing the orderly conversion relation. The above-described color conversion treatment is conducted using this reverse conversion relation.

Herein, the following three examples may be, but not limited to, a method for calculating color signals CMY from the stimulation value signals XYZ:

(1) A tetrahedral in which four stimulation value signals XYZ constitute respective summits is made, space of the stimulation value signals XYZ is divided by this tetrahedron, and space of color signals CMY is also divided by the tetrahedron in the same manner, and color signals CMY against any stimulation value signals XYZ in corresponding tetrahedron are calculated by liner computing.

(2) Color signals CMY against any stimulation value signals XYZ are calculated by repeated computing using the Newton method (see, PHOTOGRAPHIC SCIENCE AND ENGINEERING Volume 16, Number 2. March-April 1972 pp136–pp143 "Metameric color matching in subtractive color photography").

(3) A color conversion method which converts color signals from first color specifications to second color specifications, comprising first step in which relationship between real color signals (first signals) in the first specifications and known real color signals (second signals) in the second specifications is determined as first orderly conversion relationship, second step in which hypothesis color signals are set outside the area composed of the real color signals by approximating the first orderly conversion relationship as monotone function, third step in which relationship between the first signals and color signals (third signals) composed of the second signals and hypothesis color signals is determined as the second orderly conversion relationship, and forth step in which relationship of first signals is determined as reverse conversion relationship using a repeated computing method from the second conversion relationship, and a color signal is converted from first specifications to the second specifications by using the reverse conversion relationship. Namely, the conversion method where first color signals of first color specifications are converted to second color signals of second color specification comprises determining first real color signals (for example, XYZ color signals) in first specifications corresponding to known, second real color signals (for example, CMY color signals) in second specifications, followed by approximating the first orderly conversion relationship between these real color signals as a monotone function, and setting hypothesis color signals outside the area comprising the real color signals. Then, according to the second orderly conversion relationship between the first and second specifications respectively comprising the first and second real color signals and hypothesis color signals, reverse conversion relation is determined, which effect conversion of the first and second specifications by repeated computing represented by the Newton method. Color conversion is conducted by using the reverse conversion relation. Further, other methods can be used.

The size of an image obtained from the heat developable light-sensitive material and the dye-fixing element may be any of A line book size, A1 to A6, octavo (kiku size), B line book size, B1 to B6, four-six size. The size of the heat developable light-sensitive material and dye-fixing element may be any size in the width range from 100 mm to 2000 mm, corresponding to the above-described size.

For heat developable light-sensitive material and the dye-fixing element, the raw materials may be supplied in the form of either roll or sheet, and it is also possible that only one of them is in the form of roll, and other is in the form of sheet.

EXAMPLES

The following examples further illustrate the present invention in detail, but do not limit the scope thereof. Compounds used in these examples are described below.

Example 1

Image receiving elements R101 having constitutions shown in Table 1 and Table 2 were produced.

TABLE 1

Structure of dye-fixing material R101

| Constituent layer | Added substance | Amount added (mg/m$^2$) |
|---|---|---|
| 6th layer | Water-soluble polymer (1) | 130 |
| | Water-soluble polymer (2) | 35 |
| | Water-soluble polymer (3) | 45 |
| | Potassium nitrate | 20 |
| | Anionic surfactant (1) | 6 |
| | Anionic surfactant (2) | 6 |
| | Ampholytic surfactant (1) | 50 |
| | Stain preventing agent (1) | 7 |
| | Stain preventing agent (2) | 12 |
| | Matting agent (1) | 7 |
| 5th layer | Gelatin | 250 |
| | Water-soluble polymer (1) | 25 |
| | Anionic surfactant (3) | 9 |
| | Film hardener (1) | 185 |
| 4th layer | Mordant (1) | 1850 |
| | Water-soluble polymer (2) | 260 |
| | Water-soluble polymer (4) | 1400 |
| | Latex dispersion (1) | 600 |
| | Anionic surfactant (3) | 25 |
| | Nonionic surfactant (1) | 18 |
| | Guanidine picolinate | 2550 |
| | Sodium quinolinate | 350 |
| 3rd layer | Gelatin | 370 |
| | Mordant (1) | 300 |
| | Anionic surfactant (3) | 12 |
| 2nd layer | Gelatin | 700 |
| | Mordant (1) | 290 |
| | Water-soluble polymer (1) | 55 |
| | Water-soluble polymer (2) | 330 |
| | Anionic surfactant (3) | 30 |
| | Anionic surfactant (4) | 7 |
| | Organic solvent having high boiling point (1) | 700 |
| | Brightener (1) | 30 |
| | Stain preventing agent (3) | 32 |
| | Guanidine picolinate | 360 |
| | Sodium quinolinate | 45 |
| 1st layer | Gelatin | 280 |
| | Water-soluble polymer (1) | 12 |
| | Anionic surfactant (1) | 14 |
| | Sodium metaborate | 35 |
| | Film hardener (1) | 185 |
| Support (1): Paper support laminated with polyethylene (thickness: 215 μm) | | |

The amount coated of a latex dispersion is an amount coated of latex solid component.

TABLE 2

Structure of support

| Layer name | Composition | | Film thickness (μm) |
|---|---|---|---|
| Surface primer | Gelatin | | 0.1 |
| Surface PE layer (glossy) | Low density polyethylene (density: 0.923): | 90.2 parts | 36.0 |
| | Surface-processed titanium oxide: | 9.8 parts | |
| | Marine blue: | 0.001 parts | |
| Pulp layer | High quality paper (LBKP/NBSP = 6/4, density: 1.053) | | 152.0 |
| Back surface layer (matt) | High density polyethylene (density: 0.955) | | 27.0 |
| Back primer | Styrene/acrylate copolymer | | 0.1 |
| | Colloidal silica | | |
| | Sodium | | |

TABLE 2-continued

| Structure of support | | |
|---|---|---|
| Layer name | Composition | Film thickness (μm) |
| | polystyrenesulfonate | — |
| | | 215.2 |

Anionic surfactant (1)

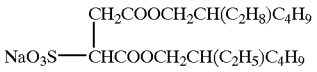

Anionic surfactant (2)

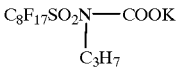

Anionic surfactant (3)

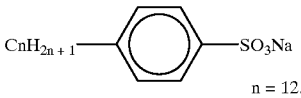

n = 12.6

Anionic surfactant (4)

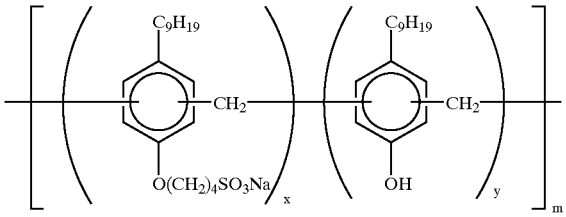

x:y = 4:6
m ≈ 6.8

Nonionic surfactant (1)

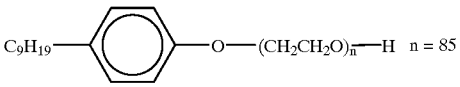

Ampholytic surfactant (1)

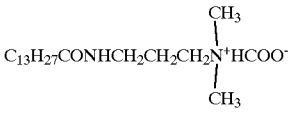

Brightener (1)

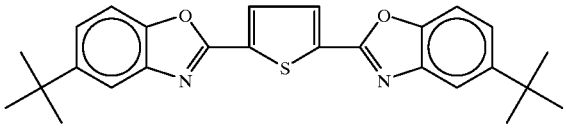

Mordant (1)

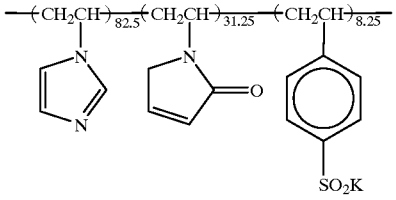

-continued

Stain preventing agent (1)

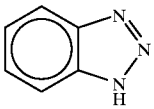

Stain preventing agent (2)

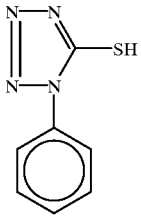

Stain preventing agent (3)

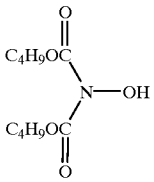

Organic solvent having high boiling point (1)
$C_{28}H_{48.9}Cl_{7.1}$ En-Para 40 (manufactured by Ajinomoto Co., Inc.)
Water-soluble polymer (1)
SUMIKAGEL L5-H (manufactured by Sumitomo Chemical Co., Ltd.)
Water-soluble polymer (2)
Dextran (molecular weight: 70000)
Water-soluble polymer (3)
κ-carageenan (manufactured by Taito Corp.)
Water-soluble polymer (4)
MP polymer MP-102 (manufactured by Kuraray Co., Ltd.)
Water-soluble polymer (5)
Acryl modified copolymer of polyvinyl alcohol (degree of modification: 17%)
Latex dispersion (1)
LX-438 (manufactured by Nippon Zeon Corp.)
Matting agent (1)
SYLOID79 (manufactured by Fuji Devison Corp.)
Matting agent (2)
PMMA particle (average particle size: μm)

Film hardner (1)

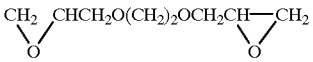

Then, a dye-fixing material was prepared in the same manner as described above except that a compound represented by the general formula (II') of the present invention was added to the second and third layers of the above-described dye-fixing material respectively in an amount of 0.5 mmol/$m^2$, as shown in Table 14. Among these compounds, an oil-soluble compound was dissolved in the organic solvent having a high boiling point (1) and emulsified and dispersed before added to the composition, and a water-soluble compound or latex was directly added to the composition.

Then, a method for producing a light-sensitive element will be described.

First, a method for producing a light-sensitive silver halide emulsion is described. Light-sensitive silver halide emulsion (1) [for red sensitive emulsion layer]

A solution (I) having a composition shown in Table 4 was added to an aqueous solution having a composition shown in Table 3 at a constant flow rate with sufficient stirring over a period of 9 minutes. A solution (II) was added at a constant flow rate 10 seconds before the addition of the solution (I) over a period of 9 minutes and 10 seconds. 36 minutes after the addition, a solution (III) having a composition shown in Table 4 was added at a constant flow rate over a period of 24 minutes. A solution (IV) was added at a constant flow rate simultaneously with the solution (III) over a period of 25 minutes.

The mixture was washed with water and desalted (conducted at a pH of 4.0 using a flocculating agent a) by ordinary methods, then 880 g of lime-processed ossein gelatin was added to control pH to 6.0 before addition of 12.8 g of ribonucleic acid decomposed compound and 32 mg of trimethylthiourea. Then, the mixture was chemically sensitized for 71 minute appropriately at 60° C. 2.6 g of 4-hydroxy-6-methyl-1,3,3a,7-tetrazaindene, 3.2 g of a dye (a), 5.1 g of KBr and 2.6 g of a stabilizer described below were added one by one, and the resulting mixture was cooled. In this manner, 28.1 kg of monodispersed cubic silver chloride bromide emulsion having an average particle size of 0.35 $\mu$m was obtained.

TABLE 3

| Composition | |
|---|---|
| $H_2O$ | 26300 cc |
| Lime-processed gelatin | 800 g |
| KBr | 12 g |
| NaCl | 80 g |
| Compound (a) | 1.2 g |
| Temperature | 53° C. |

TABLE 4

| | (I) solution | (II) solution | (III) solution | (IV) solution |
|---|---|---|---|---|
| $AgNO_3$ | 1200 g | None | 2800 g | None |
| KBr | None | 546 g | None | 1766 g |
| NaCl | None | 144 g | None | 96 g |
| $K_2IrCl_6$ | None | 3.6 mg | None | None |
| Total amount | 6.5 liter with added water | 6.5 liter with added water | 10 liter with added water | 10 liter with added water |

Compound (a)

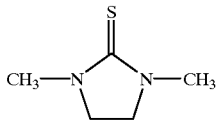

-continued

Dye (a)

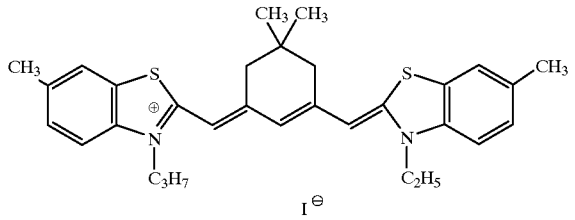

Light-sensitive Silver Halide Emulsion (2) [for Green Sensitive Emulsion Layer]

Solutions (I) and (II) each having a composition shown in Table 6 were simultaneously added to an aqueous solution having a composition shown in Table 5 at a constant flow rate with sufficient stirring over a period of 9 minutes. 5 minute after the addition, solutions (III) and (IV) each having a composition shown in Table 6 were simultaneously added at a constant flow rate over a period of 32 minutes. After the addition of the solutions (III) and (IV), 60 ml of a methanol solution of dyes (containing 360 mg of a dye (b1) and 73.4 mg of a dye (b2)) was added in one time.

The mixture was washed with water and desalted (conducted at a pH of 4.0 using a flocculating agent (a)) by ordinary methods. Then, 22 g of lime-processed ossein gelatin was added to control pH to 6.0 and pAg to 7.6 before addition of 1.8 mg of sodium thiosulfate and 180 mg of 4-hydroxy-6-methyl-1,3,3a,7-tetrazaindene. The mixture was chemically sensitized at 60° C. appropriately, then 90 mg of an antifoggant (1) was added, and the resulting mixture was cooled. In this manner, 635 g of monodispersed cubic silver chloride bromide emulsion having an average particle size of 0.30 $\mu$m was obtained.

TABLE 5

| Composition | |
|---|---|
| $H_2O$ | 600 cc |
| Lime-processed gelatin | 20 g |
| KBr | 0.3 g |
| NaCl | 2 g |
| Compound (a) | 0.03 g |
| Sulfuric acid (1N) | 16 cc |
| Temperature | 46° C. |

TABLE 6

| | (I) solution | (II) solution | (III) solution | (IV) solution |
|---|---|---|---|---|
| $AgNO_3$ | 10.0 g | None | 90.0 g | None |
| KBr | None | 3.50 g | None | 57.1 g |
| NaCl | None | 1.72 g | None | 3.13 g |
| $K_2IrCl_6$ | None | None | None | 0.03 g |
| Total amount | 126 ml with added water | 131 ml with added water | 280 ml with added water | 289 ml with added water |

Dye (b1)

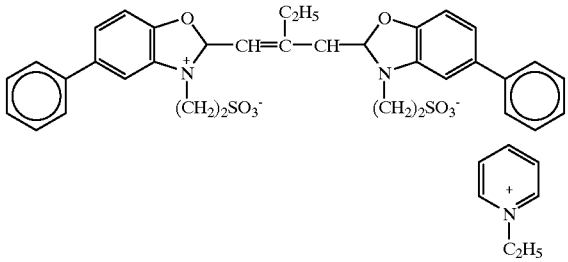

Dye (b2)

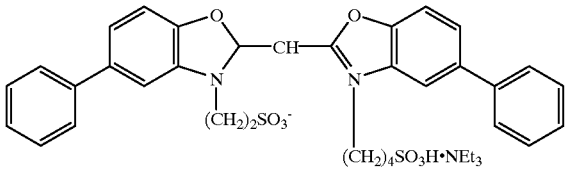

Precipitating agent (a)

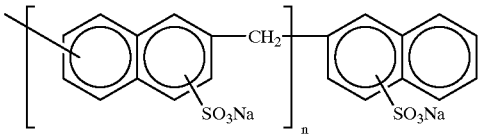

Antifoggant (1)

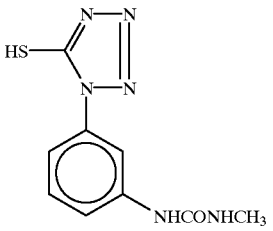

Light-sensitive Silver Halide Emulsion (3) [for Blue Sensitive Emulsion Layer]

Solutions (I) and (II) each having a composition shown in Table 7 were added to an aqueous solution having a composition shown in Table 7 in a manner that the solution (II) was added first, and 10 seconds after, the solution (I) was added respectively over a period of 30 minutes with sufficient stirring. 2 minutes after the addition of the (I) solution, a solution (V) was added, and 5 minutes after the addition of the solution (II), a solution (IV) was added over a period of 28 minutes, and 10 seconds after, a solution (III) was added over a period of 27 minutes and 50 seconds.

The mixture was washed with water and desalted (conducted at a pH of 3.9 using a flocculating agent (b)) by ordinary methods, then 1230 g of lime-processed ossein gelatin and 2.8 mg of a compound (b) were added to control pH to 6.1 and pAg to 8.4 before addition of 24.9 mg of sodium thiosulfate. The mixture was chemically sensitized at 60° C. appropriately, then, 13.1 g of a dye (c) and 118 ml of a compound (c) one by one, and the resulting mixture was cooled. The halide particle in the resulted emulsion was a potato-like particle, and had an average particle size of 0.53 μm, and the yield was 30700 g.

TABLE 7

| Composition | |
|---|---|
| $H_2O$ | 29200 cc |
| Lime-processed gelatin | 1582 g |
| KBr | 127 g |
| Compound (a) | 0.66 g |
| Temperature | 72° C. |

TABLE 8

| | (I) solution | (II) solution | (III) solution | (IV) solution | (V) solution |
|---|---|---|---|---|---|
| $AgNO_3$ | 939 g | None | 3461 g | None | None |
| KBr | None | 572 g | None | 2464 g | None |
| Kl | None | None | None | None | 22 g |
| Total amount | 6690 ml with added water | 6680 ml with added water | 9700 ml with added water | 9740 ml with added water | 4400 ml with added water |

Precipitating agent (b)

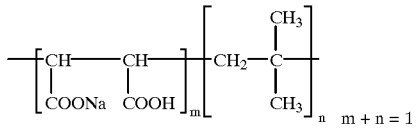

Dye (c)

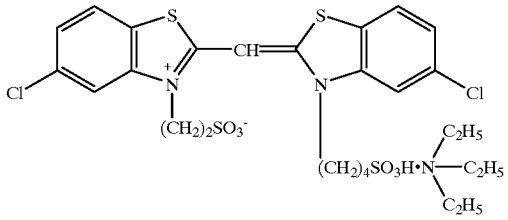

Compound (c)

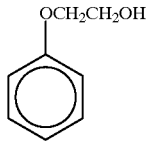

Compound (b)

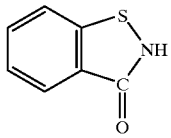

Then, a method for preparing a gelatin dispersion of a hydrophobic additive is described.

Gelatin dispersions of yellow coupler, magenta coupler, cyan coupler and developing agent were prepared respectively according to formulations shown in Table 9. Oil phase components were heated at 70° C. to be dissolved to form a uniform solution. To the solution were added aqueous phase components heated to about 60° C., stirred and mixed. Then, the mixture was dispersed at 10000 rpm by a homogenizer for 10 minutes. To this was added water, and the solution was stirred to give a uniform dispersion.

TABLE 9

| | | Dispersion composition | | |
|---|---|---|---|---|
| | | Yellow | Magenta | Cyan |
| Oil phase | Cyan coupler (15) | None | None | 7.0 g |
| | Magenta coupler (20) | None | 7.0 g | None |
| | Yellow coupler (1) | 7.0 g | None | None |
| | Developing agent D-3 | None | None | 5.6 g |
| | Developing agent D-3 | None | 5.6 g | None |
| | Developing agent D-3 | 5.6 g | None | None |
| | Antifoggant (5) | 0.25 g | None | None |
| | Antifoggant (2) | None | 0.25 g | 0.25 g |
| | Solvent having high boiling point (4) | 7.4 g | 7.4 g | 7.4 g |
| | Ethyl acetate | 15 cc | 15 cc | 15 cc |
| Water phase | Lime-processed gelatin | 10.0 g | 10.0 g | 10.0 g |
| | Calcium nitrate | 0.1 g | 0.1 g | 0.1 g |
| | Surfactant (1) | 0.7 g | 0.7 g | 0.7 g |
| | Water | 110 cc | 110 cc | 110 cc |
| | Water added | 110 cc | 110 cc | 110 cc |
| | Preservative (1) | 0.04 g | 0.04 g | 0.04 g |

A gelatin dispersion of an antifoggant (4) and reducing agent (1) was prepared according to a formulation shown in Table 10. Oil phase components were heated at 60° C. to be dissolved. To the solution were added aqueous phase components heated to about 60° C., and the solution was stirred and mixed, then was dispersed at 10000 rpm by a homogenizer for 10 minutes to give a uniform dispersion.

TABLE 10

| | | Dispersion composition |
|---|---|---|
| Oil phase | Antifoggant (4) | 0.16 g |
| | Reducing agent (1) | 1.3 g |
| | Solvent having high boiling point (2) | 2.3 g |
| | Solvent having high boiling point (5) | 0.2 g |
| | Surfactant (1) | 0.5 g |
| | Surfactant (4) | 0.5 g |
| | Ethyl acetate | 10.0 ml |
| Water phase | Acid-processed gelatin | 10.0 g |
| | Preservative (1) | 0.004 g |
| | Calcium nitrate | 0.1 g |
| | Water | 35.0 ml |
| | Water added | 104.4 ml |

A dispersion of a polymer latex (a) was prepared according to a formulation shown in Table 11. Namely, to a mixture of a polymer latex (a), surfactant (5) and water in amounts shown in Table 11 was added to an anionic surfactant (6) over a period of 10 minutes with stirring to give a uniform dispersion. Further, the resulting dispersion was repeatedly diluted with water and concentrated using a ultrafiltration module (ultrafiltration module manufactured by Asahi Chemical Industry Co., Ltd.: ACV-3050) to decrease salt concentration in the dispersion to one-ninth.

TABLE 11

| | Dispersion composition |
|---|---|
| Polymer latex (a) aqueous solution (solid content: 13%) | 108 ml |
| Surfactant (5) | 20 g |
| Surfactant (6) | 600 ml |
| Water | 1232 ml |

A gelatin dispersion of zinc hydroxide was prepared according to a formulation shown in Table 12. Components were mixed and dissolved, and then dispersed for 30 minutes by a mill using glass beads having an average particle size of 0.75 μm. Further, the glass beads were removed to give a uniform dispersion.

TABLE 12

| | Dispersion composition |
|---|---|
| Zinc hydroxide | 15.9 g |
| Carboxylmethylcellulose | 0.7 g |
| Sodium polyacrylate | 0.07 g |
| Limer-processed gelatin | 4.2 g |
| Water | 100 ml |
| Preservative (2) | 0.4 g |

Then, a method for preparing a gelatin dispersion of a matting agent added to a protective layer is described. A solution obtained by dissolving polymethyl methacrylate in methylene chloride was added to gelatin together with a small amount of a surfactant. The mixture was stirred at high speed to be dispersed. Then, methylene chloride was removed by using a vacuum solvent removing apparatus to give a dispersion having an average particle sized of 4.3 μm.

The above-described products were used to produce light-sensitive elements 101 shown in Tables 13.

TABLE 13

Structure of main components of light-sensitive material R101

| Constituent layer | Layer name | Added substance | Amount added (mg/m$^2$) |
|---|---|---|---|
| 7th layer | Protective layer | Acid-processed gelatin | 387 |
| | | Matting agent (PMMA resin) | 17 |
| | | Surfactant (2) | 6 |
| | | Surfactant (3) | 20 |
| | | Polymer latex (a) Dispersion | 10 |
| 6th layer | Intermediate layer | Lime-processed gelatin | 862 |
| | | Antifoggant (4) | 7 |
| | | Reducing agent (1) | 57 |
| | | Solvent having high boiling point (2) | 101 |
| | | Solvent having high boiling point (5) | 9 |
| | | Surfactant (1) | 21 |
| | | Surfactant (4) | 21 |
| | | Water-soluble polymer (1) | 5 |
| | | Zinc hydroxide | 558 |
| | | Calcium nitrate | 6 |
| 5th layer | Blue light-sensitive layer | Lime-processed gelatine | 587 |
| | | Light-sensitive silver halide emulsion (3) | 399 |
| | | Yellow coupler (1) | 410 |
| | | Developing agent D-3 | 328 |
| | | Antifoggant (3) | 15 |
| | | Solvent having high boiling point (4) | 433 |
| | | Surfactant (1) | 12 |
| | | Water-soluble polymer (1) | 40 |
| 4th layer | Intermediate layer | Lime-processed gelatin | 862 |
| | | Antifoggant (4) | 7 |
| | | Reducing agent (1) | 57 |
| | | Solvent having high boiling point (2) | 101 |
| | | Solvent having high boiling point (5) | 9 |
| | | Surfactant (1) | 21 |
| | | Surfactant (4) | 21 |
| | | Water-soluble polymer (1) | 4 |
| | | Zinc hydroxide | 341 |
| | | Calcium nitrate | 8 |
| 3rd layer | Green light-sensitive layer | Lime-processed gelatin | 452 |
| | | Light-sensitive silver halide emulsion (2) | 234 |
| | | Magenta coupler (20) | 420 |

TABLE 13-continued

Structure of main components of light-sensitive material R101

| Constituent layer | Layer name | Added substance | Amount added (mg/m$^2$) |
|---|---|---|---|
| | | D-3 | 336 |
| | | Antifoggant (2) | 15 |
| | | Solvent having high boiling point (4) | 444 |
| | | Surfactant (1) | 12 |
| | | Water-soluble polymer (1) | 10 |
| 2nd layer | Intermediate layer | Lime-processed gelatin | 862 |
| | | Antifoggant (4) | 7 |
| | | Reducing agent (1) | 57 |
| | | Solvent having high boiling point (2) | 101 |
| | | Solvent having high boiling point (5) | 9 |
| | | Surfactant (1) | 21 |
| | | Surfactant (4) | 21 |
| | | Water-soluble polymer (1) | 10 |
| | | Calcium nitrate | 6 |
| 1st layer | Red light-sensitive layer | Lime-processed gelatin | 373 |
| | | Light-sensitive silver halide emulsion (1) | 160 |
| | | Cyan coupler (15) | 390 |
| | | Developing agent D-3 | 312 |
| | | Antifoggant (2) | 14 |
| | | Solvent having high boiling point (4) | 412 |
| | | Surfactant (1) | 11 |
| | | Water-soluble polymer (2) | 25 |
| | | Film hardener (1) | 45 |
| | | Preservative (1) | 45 |

Support (support prepared by vapor deposition of aluminum on PET with a thickness of 20 $\mu$m and further coating of a gelatin primer on the surface)

Cyan coupler (15)

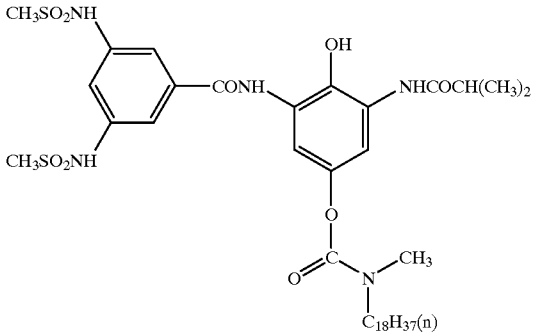

Magenta coupler (20)

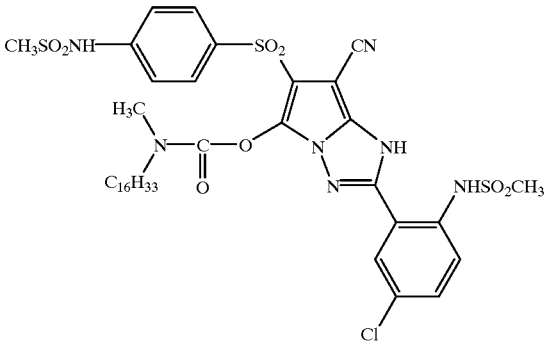

-continued

Yellow coupler (1)

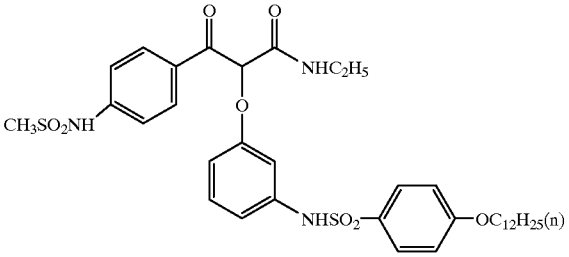

Antifoggant (5)

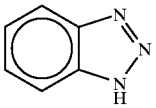

Antifoggant (2)

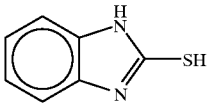

Solvent having high boiling point (4)

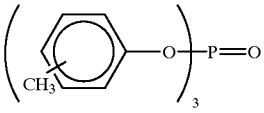

Preservative (1)

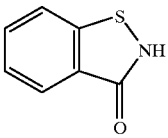

Surfactant (1)

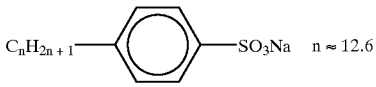

Antifoggant (4)

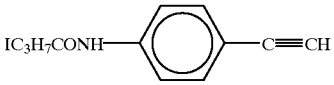

Surfactant (4)

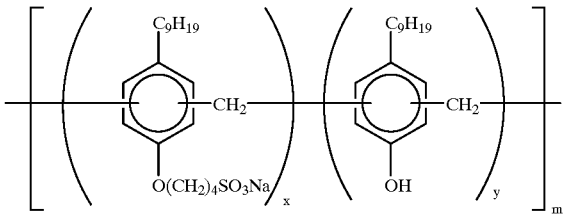

x:y = 4:6
m ≈ 6.8

Solvent having high boiling point (2)

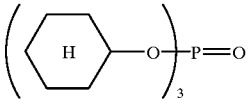

-continued

Preservative (1)

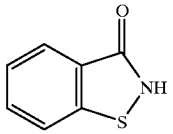

Solvent having high boiling point (5)

$C_{28}H_{48.9}Cl_{7.1}$ En-Para 40 (manufactured by Ajinomoto. Co., Inc.)

Reducing agent (1)

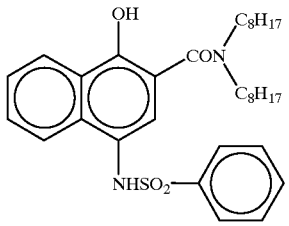

Polymer latex (a)

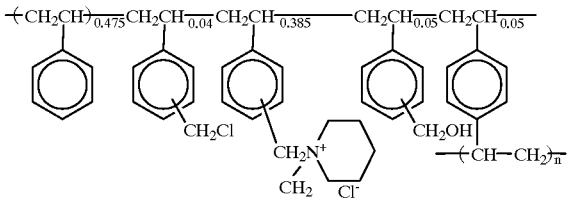

Surfactant (5)

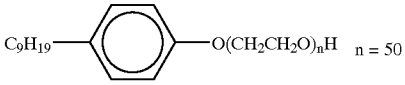

Surfactant (6)

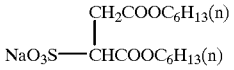

Preservative (2)

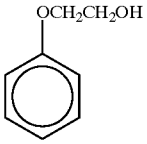

Surfactant (2)

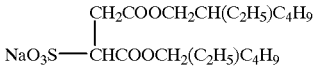

Surfactant (3)

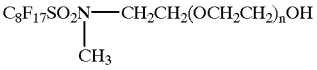

-continued

Water-soluble polymer (1)

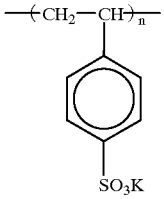

Intrinsic viscosity [η] = 1.6 (0.1N NaCl, 30° C.)

Molecular weight ≈ 1 million

Water-soluble polymer (2)

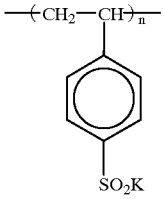

Intrinsic viscosity [η] = 0.8 (0.1N NaCl, 30° C.)

Molecular weight ≈ 0.4 million

Film hardner (1)

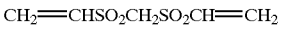

Developing agent (a)

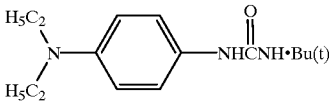

Compound described in JP-A No. 59-111148

Then, as comparative examples, light-sensitive materials 102 were produced in the same manner as for the light-sensitive material 101 except that the developing agents of the dispersion in Table 9 were changed to the developing agent (a) in all Yellow, Magent and Cyan. Then, light-sensitive materials 103 to 115 were produced in which the couplers and developing agents of the present invention were changed as described in Table 14. With these light-sensitive materials and dye fixing materials, image output was conducted at heating condition of 80° C. for 30 seconds by PICTOSTAT 330 manufactured by Fuji Photo Film Co., Ltd. The resulted image was a clear color image. {Maximum concentration and minimum concentration were measured by using a reflection concentration meter X-lite 304 manufactured by X-lite Corp.}.

Further, the treated sample was left for 14 days at 40° C. under RH humidity of 80%, then, the minimum concentration was measured again, and increase in the concentration was measured by yellow concentration.

Regarding discoloration, a transparent film having a ultraviolet ray absorption layer was laminated on the film surface of this dye fixing material, and left for 30 days under fluorescent light of 17000 lux, then, the concentration was measured, and percentage of the ratio of the measured value to the concentration directly after the treatment is shown as discoloration ratio.

Discoloration ratio=(concentration after left for 30 days)/(concentration directly after treatment)×100

The results are shown in Table 14. Table 14 showed that the compound of the present invention provides excellent photographic property and image fastness.

TABLE 14

| Light-sensitive element | Light-sensitive element Hue | Developing agent | Coupler | Image receiving element Discoloration preventing agent | Photographic property Dmin | Dmax | Image fastness ΔDmin | Discoloration ratio % | Remarks |
|---|---|---|---|---|---|---|---|---|---|
| 102 | Y | (a) | (1) | None | 0.54 | 1 | 0.58 | 70 | Comparative Example |
| | M | (a) | (20) | | 0.49 | 0.88 | | 62 | |
| | C | (a) | (15) | | 0.52 | 0.95 | | 50 | |
| 102 | Y | (a) | (1) | II'-6 | 0.53 | 0.94 | 0.55 | 75 | Comparative Example |
| | M | (a) | (20) | | 0.47 | 0.88 | | 70 | |
| | C | (a) | (15) | | 0.5 | 0.92 | | 60 | |
| 101 | Y | D-3 | (1) | None | 0.24 | 2.08 | 0.2 | 85 | Comparative Example |
| | M | D-3 | (20) | | 0.25 | 2.19 | | 77 | |
| | C | D-3 | (15) | | 0.14 | 2.29 | | 71 | |
| 101 | Y | D-3 | (1) | II'-6 | 0.23 | 2.1 | 0.05 | 94 | Present Invention |
| | M | D-3 | (20) | | 0.22 | 2.22 | | 93 | |
| | C | D-3 | (15) | | 0.13 | 2.32 | | 85 | |
| 103 | Y | D-5 | (1) | II'-6 | 0.2 | 2.12 | 0.04 | 95 | Present Invention |
| | M | D-5 | (20) | | 0.19 | 2.21 | | 94 | |
| | C | D-5 | (15) | | 0.15 | 2.32 | | 88 | |
| 104 | Y | D-7 | (1) | II'-6 | 0.19 | 2.19 | 0.05 | 96 | Present Invention |
| | M | D-7 | (20) | | 0.2 | 2.21 | | 90 | |
| | C | D-7 | (15) | | 0.17 | 2.32 | | 86 | |
| 105 | Y | D-25 | (1) | II'-6 | 0.18 | 2.2 | 0.03 | 95 | Present Invention |
| | M | D-25 | (20) | | 0.2 | 2.15 | | 92 | |
| | C | D-25 | (15) | | 0.17 | 2.22 | | 87 | |
| 106 | Y | D-31 | (1) | II'-6 | 0.17 | 2.19 | 0.04 | 94 | Present Invention |
| | M | D-31 | (20) | | 0.19 | 2.16 | | 93 | |
| | C | D-31 | (15) | | 0.18 | 2.23 | | 86 | |
| 107 | Y | D-37 | (1) | II'-6 | 0.16 | 2.23 | 0.06 | 95 | Present Invention |
| | M | D-37 | (20) | | 0.18 | 2.42 | | 96 | |
| | C | D-37 | (15) | | 0.19 | 2.32 | | 91 | |
| 108 | Y | D-8 | (1) | II'-6 | 0.15 | 2.24 | 0.07 | 94 | Present Invention |
| | M | D-8 | (20) | | 0.14 | 2.2 | | 95 | |
| | C | D-8 | (15) | | 0.2 | 2.17 | | 97 | |
| 109 | Y | D-4 | (1) | II'-6 | 0.14 | 2.22 | 0.06 | 94 | Present Invention |
| | M | D-9 | (20) | | 0.13 | 2.19 | | 93 | |
| | C | D-20 | (15) | | 0.09 | 2.18 | | 90 | |
| 110 | Y | D-6 | (1) | II'-6 | 0.15 | 2.21 | 0.04 | 93 | Present Invention |
| | M | D-14 | (20) | | 0.14 | 2.22 | | 92 | |
| | C | D-22 | (15) | | 0.11 | 2.32 | | 90 | |
| 111 | Y | D-2 | (1) | II'-6 | 0.18 | 2.13 | 0.05 | 92 | Present Invention |
| | M | D-31 | (20) | | 0.2 | 2.21 | | 90 | |
| | C | D-33 | (15) | | 0.15 | 2.29 | | 85 | |
| 112 | Y | D-38 | (1) | II'-6 | 0.17 | 2.19 | 0.06 | 94 | Present Invention |
| | M | D-38 | (20) | | 0.2 | 2.21 | | 91 | |
| | C | D-38 | (15) | | 0.18 | 2.04 | | 89 | |
| 113 | Y | D-39 | (1) | II'-6 | 0.17 | 2.21 | 0.05 | 93 | Present Invention |
| | M | D-39 | (20) | | 0.17 | 2.21 | | 91 | |
| | C | D-39 | (15) | | 0.17 | 2.32 | | 88 | |
| 114 | Y | D-40 | (1) | II'-6 | 0.17 | 2.21 | 0.05 | 94 | Present Invention |
| | M | D-40 | (20) | | 0.18 | 2.32 | | 93 | |
| | C | D-40 | (15) | | 0.18 | 2.29 | | 90 | |
| 115 | Y | D-40 | (2) | II'-6 | 0.17 | 2.21 | 0.05 | 92 | Present Invention |
| | M | D-38 | (20) | | 0.18 | 2.23 | | 91 | |
| | C | D-39 | (15) | | 0.18 | 2.26 | | 90 | |

Example 2

A dye fixing material was prepared in the same manner as in Example 1 except that a compound represented by the general formulae (II) to (VI) of the present invention was added to the second and third layers of the above-described dye fixing material respectively in an amount of 0.5 mmol/$m^2$, as shown in Table 34.

Then, a method for producing a light-sensitive material is described.

First, a method for producing a light-sensitive silver halide emulsion is described.

Light-sensitive Silver Halide Emulsion (1) [Emulsion for 5th Layer (680 nm Light-sensitive Layer)]

Solutions (I) and (II) each having a composition shown in Table 16 were simultaneously added to an aqueous solution having a composition shown in Table 15 with sufficient stirring over a period of 13 minutes. More 10 minutes after, solutions (III) and (IV) each having a composition shown in Table 16 were added over a period of 33 minutes.

TABLE 15

| Composition | |
|---|---|
| $H_2O$ | 620 cc |
| Lime-processed gelatin | 20 g |
| KBr | 0.3 g |
| NaCl | 2 g |
| Solvent for silver halide (1) | 0.03 g |

TABLE 15-continued

| Composition | |
|---|---|
| Sulfuric acid (1N) | 16 cc |
| Temperature | 45° C. |

TABLE 16

| | (I) Solution | (II) Solution | (III) Solution | (IV) Solution |
|---|---|---|---|---|
| $AgNO_3$ | 30.0 g | None | 70.0 g | None |
| KBr | None | 13.7 g | None | 44.2 g |
| NaCl | None | 3.62 g | None | 2.4 g |
| $K_2IrCl_3$ | None | None | None | 0.039 mg |
| Total amount | 126 ml with water added | 132 ml with water added | 254 ml with water added | 252 ml with water added |

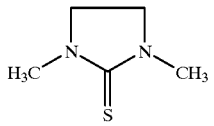

Solvent (1) for silver halide 13 minutes after initiation of the addition of the solution (III), 150 cc of an aqueous solution containing 0.350% of a sensitizing dye (1) was added over 27 minutes.

The mixture was washed with water and desalted (conducted at a pH of 4.1 using a flocculating agent (a)) by ordinary methods, then 22 g of lime-processed ossein gelatin was added to control pH to 6.0 and pAg to 7.9. The mixture was chemically sensitized at 60° C. appropriately. The compound used in the chemical sensitization is shown in Table 17.

The resulted emulsion (630 g) was a monodispersed cubic silver chloride bromide emulsion having a variation coefficient of 10.2% and an average particle size of 0.20 $\mu$m.

TABLE 17

| Chemical used in chemical sensitization | Amount added |
|---|---|
| 4-hydroxy-6-methyl-1,3,3a,7-tetraazaindene | 0.36 g |
| Sodium thiosulfate | 6.75 mg |
| Antifoggant (1) | 0.11 g |
| Preservative (1) | 0.07 g |
| Preservative (2) | 3.31 g |

Sensitizin dye (1)

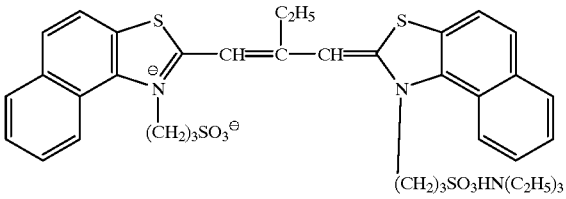

-continued

Precipitating agent (a)

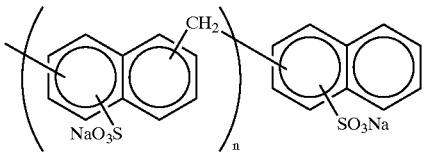

Precipitating agent (b)

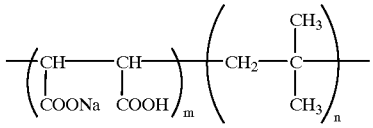

Antifoggant (1)

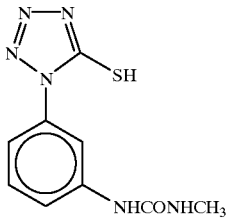

Preservative (1)

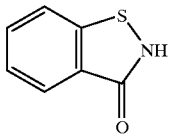

Preservative (2)

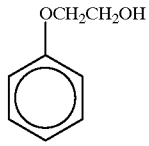

Light-sensitive Silver Halide Emulsion (2) [Emulsion for 3rd Layer (750 nm Light-sensitive Layer)]

Solutions (I) and (II) each having a composition shown in Table 20 were simultaneously added to an aqueous solution having a composition shown in Table 18 with sufficient stirring over a period of 18 minutes. 10 minute after the addition, solutions (III) and (IV) each having a composition shown in Table 19 were added over a period of 24 minutes.

TABLE 18

| Composition | |
|---|---|
| $H_2O$ | 620 cc |
| Lime-processed gelatin | 20 g |
| KBr | 0.3 g |
| NaCl | 2 g |
| Solvent (1) for silver halide | 0.03 g |
| Sulfuric acid (1N) | 16 cc |
| Temperature | 45° C. |

TABLE 19

| | (I) solution | (II) solution | (III) solution | (IV) solution |
|---|---|---|---|---|
| $AgNO_3$ | 30.0 g | None | 70.0 g | None |
| KBr | None | 13.7 g | None | 44.2 g |

TABLE 19-continued

| | (I) solution | (II) solution | (III) solution | (IV) solution |
|---|---|---|---|---|
| NaCl | None | 3.62 g | None | 2.4 g |
| $K_4[Fe(CN)_6].H_2O$ | None | None | None | 0.07 g |
| $K_2IrCl_3$ | None | None | None | 0.04 mg |
| Total amount | 188 ml with water added | 188 ml with water added | 250 ml with water added | 250 ml with water added |

The mixture was washed with water and desalted (conducted at a pH of 3.9 using a f locculating agent b) by ordinary methods, then 22 g of lime-processed ossein gelatin which had been subjected to de-calcium treatment (calcium content: 150 PPM or less) was added. The mixture was redispersed at 40° C., and 0.39 g of 4-hydroxy-6-methyl-1,3,3a,7-tetrazaindene was added to control pH to 5.9 and pAg to 7.8. Then, the mixture was chemically sensitized at 70° C. using chemicals shown in Table 20. Further, at the end of the chemical sensitization, sensitizing dye (2) was added in the form of a methanol solution (solution having a composition shown in Table 21). Further, after chemical sensitization, the solution was cooled down to 40° C., to this was added 200 g of a gelatin dispersion of a stabilizer (1) described later, and they were sufficiently stirred before accommodation. The resulted emulsion was a monodispersion cubic silver chloride iodide having a variation function of 12.6% and an average particle was 0.25 μm, and the yield was 938 g. The emulsion for 750 nm light-sensitive layer had J-band type spectral sensitivity.

TABLE 20

| Chemical used in chemical sensitization | Amount added |
|---|---|
| 4-hydroxy-6-methyl-1,3,3a,7-tetraazaindene | 0.39 g |
| Triethylthiourea | 3.3 mg |
| Nucleic acid decomposed material | 0.39 g |
| NaCl | 0.15 g |
| Kl | 0.12 g |
| Antifoggant (2) | 0.10 g |
| Preservative (1) | 0.07 g |

TABLE 21

| Composition of dye solution | Amount added |
|---|---|
| Sensitizing dye (2) | 0.19 g |
| Methanol | 18.7 cc |

Stabilizer (1)

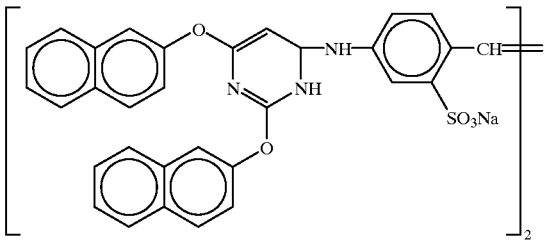

-continued

Antifoggant (2)

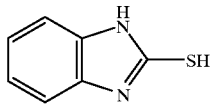

Sensitizing agent (2)

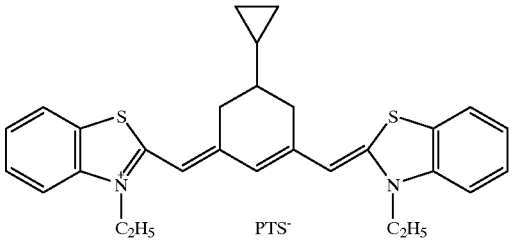

PTS = p-toluene sulfonic acid

Precipitating agent (b)

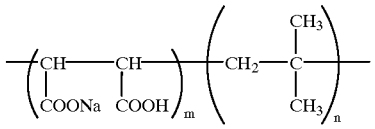

m:n = 1:1

Light-sensitive Silver Halide Emulsion (3) [Emulsion for 1st Layer (810 nm Light-sensitive Layer)]

Solutions (I) and (II) each having a composition shown in Table 23 were added to an aqueous solution having a composition shown in Table 22 over a period of 18 minutes with sufficient stirring. 10 minutes after, solutions (III) and (IV) each having a composition shown in Table 23 were added over a period of 24 minutes.

TABLE 22

| Composition | |
|---|---|
| $H_2O$ | 620 cc |
| Lime-processed gelatin | 20 g |
| KBr | 0.3 g |
| NaCl | 2 g |
| Solvent (1) for silver halide | 0.03 g |
| Sulfuric acid (1N) | 16 cc |
| Temperature | 50° C. |

TABLE 23

| | (I) solution | (II) solution | (III) solution | (IV) solution |
|---|---|---|---|---|
| $AgNO_3$ | 30.0 g | None | 70.0 g | None |
| KBr | None | 13.7 g | None | 44.1 g |
| NaCl | None | 3.62 g | None | 2.4 g |
| $K_2IrCl_3$ | None | None | None | 0.02 mg |
| Total amount | 180 ml with water added | 181 ml with water added | 242 ml with water added | 250 ml with water added |

The mixture was washed with water and desalted (conducted at a pH of 3.8 using a flocculating agent a) by ordinary methods, then 22 g of lime-processed ossein gelatin was added to control pH to 7.4 and pAg to 7.8 before chemical sensitization at 60° C. The compounds used in the chemical sensitization are shown in Table 24. The resulted emulsion was a monodispersion cubic silver chloride bromide emulsion having a variation coefficient of 9.7% and an average particle size of 0.32 μm, and the yield was 680 g.

TABLE 24

| Chemical used in chemical sensitization | Amount added |
|---|---|
| 4-hydroxy-6-methyl-1,3,3a,7-tetraazaindene | 0.38 g |
| Triethylthiourea | 3.1 mg |
| Antifoggant (2) | 0.19 g |
| Preservative (1) | 0.07 g |
| Preservative (2) | 3.13 g |

Then, a method for preparing a gelatin dispersion of colloid silver is described.

A solution having a composition shown in Table 26 was added to an aqueous solution having a composition shown in Table 25 over a period of 24 minutes with sufficient stirring. Next, the mixture was washed with water using a flocculating agent (a), then 43 g of lime-processed ossein gelatin was added to control pH to 6.3. The resulted product had an average particle size of 0.02 $\mu$m, and the yield was 512 g (dispersion containing 2% of silver and 6.8% of gelatin).

TABLE 25

| Composition | |
|---|---|
| $H_2O$ | 620 cc |
| Dextrin | 16 g |
| NaOH(5N) | 41 cc |
| Temperature | 30° C. |

TABLE 26

| Composition | |
|---|---|
| $H_2O$ | 135 cc |
| $AgNO_3$ | 17 g |

Then, a method for preparing a gelatin dispersion of a hydrophobic additive is described.

Gelatin dispersions of yellow coupler, magenta coupler, cyan coupler and developing agent were prepared respectively according to formulations shown in Table 27. Oil phase components were heated at 70° C. to be dissolved to form a uniform solution. To the solution were added aqueous phase components heated to about 60° C., stirred and mixed. Then, the mixture was dispersed at 10000 rpm by a homogenizer for 10 minutes. To this was added water, and the solution was stirred to give a uniform dispersion.

TABLE 27

| | | Dispersion composition | | |
|---|---|---|---|---|
| | | Yellow | Magenta | Cyan |
| Oil phase | Cyan coupler (15) | None | None | 7.0 g |
| | Magenta coupler (20) | None | 7.0 g | None |
| | Yellow coupler (1) | 7.0 g | None | None |
| | Developing agent (2) | None | None | 5.6 g |
| | Developing agent (2) | None | 5.6 g | None |
| | Developing agent (2) | 5.6 g | None | None |
| | Antifoggant (5) | 0.25 g | None | None |
| | Antifoggant (2) | None | 0.25 g | 0.25 g |
| | Solvent having high boiling point (4) | 7.4 g | 7.4 g | 7.4 g |
| | Dye (a) | 1.1 g | None | 0.5 g |
| | Ethyl acetate | 15 cc | 15 cc | 15 cc |
| Water phase | Lime-processed gelatin | 10.0 g | 10.0 g | 10.0 g |
| | Calcium nitrate | 0.1 g | 0.1 g | 0.1 g |
| | Surfactant (1) | 0.2 g | 0.2 g | 0.2 g |
| | Water | 110 cc | 110 cc | 110 cc |

TABLE 27-continued

| | | Dispersion composition | | |
|---|---|---|---|---|
| | | Yellow | Magenta | Cyan |
| | Water added | 110 cc | 110 cc | 110 cc |
| | Preservative (1) | 0.04 g | 0.04 g | 0.04 g |

Dye (a)

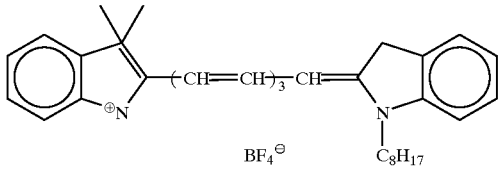

A gelatin dispersion of an antifoggant (4) and reducing agent (1) prepared according to a formulation shown in Table 28. Oil phase components were heated at about 60° C. to be dissolved. To the solution were added aqueous phase components heated to about 60° C., stirred and mixed. Then, the mixture was dispersed at 10000 rpm by a homogenizer for 10 minutes to give a uniform dispersion.

TABLE 28

| | | Dispersion composition |
|---|---|---|
| Oil phase | Antifoggant (4) | 0.16 g |
| | Reducing agent (1) | 1.3 g |
| | Solvent having high boiling point (2) | 2.3 g |
| | Solvent having high boiling point (5) | 0.2 g |
| | Surfactant (1) | 0.5 g |
| | Surfactant (4) | 0.5 g |
| | Ethyl acetate | 10.0 ml |
| Water phase | Acid-processed gelatin | 10.0 g |
| | Preservative (1) | 0.004 g |
| | Calcium nitrate | 0.1 g |
| | Water | 35.0 ml |
| | Water added | 104.4 ml |

A gelatin dispersion of a reducing agent (2) was prepared according to a formulation shown in Table 29. Namely, oil phase components were heated at 60° C. to be dissolved, to this solution were added aqueous phase components heated to about 60° C., and the solution was stirred and mixed, then was dispersed at 10000 rpm by a homogenizer for 10 minutes to give a uniform dispersion. Further, ethyl acetate was removed from the resulted dispersion using a vacuum organic solvent removing apparatus.

TABLE 29

| | | Dispersion composition |
|---|---|---|
| Oil phase | Reducing agent (2) | 7.5 g |
| | Solvent having high boiling point (1) | 4.7 g |
| | Surfactant (1) | 1.9 g |
| | Ethyl acetate | 14.4 ml |
| Water phase | Acid-processed gelatin | 10.0 g |
| | Preservative (1) | 0.02 g |
| | Gentamicin | 0.04 g |
| | Sodium hydrogensulfite | 0.1 g |
| | Water | 136.7 ml |

A dispersion of a polymer latex (a) was prepared according to a formulation shown in Table 30. To a mixture of a polymer latex (a), surfactant (5) and water in amounts shown in Table 30 was added an anionic surfactant (6) over a period of 10 minutes with stirring to give a uniform dispersion. Further, the resulting dispersion was repeatedly diluted with water and concentrated using a ultrafiltration module (ultrafiltration module manufactured by Asahi Chemical Industry Co., Ltd.: ACV-3050) to decrease salt concentration in the dispersion to one-ninth.

TABLE 30

| | Dispersion composition |
|---|---|
| Polymer latex (a) aqueous solution (solid content: 13%) | 108 ml |
| Surfactant (5) | 20 g |
| Surfactant (6) | 600 ml |
| Water | 1232 ml |

A gelatin dispersion of a reducing agent (1) was prepared according to a formulation shown in Table 31. Oil phase components were dissolved at room temperature. To the solution were added aqueous phase components heated to about 40° C., stirred and mixed. Then, the mixture was dispersed at 10000 rpm by a homogenizer for 10 minutes to give a dispersion. Further, water added and the mixture was stirred to give a uniform dispersion.

TABLE 31

| | | Dispersion composition |
|---|---|---|
| Oil phase | Stabilizer (1) | 4.0 g |
| | Sodium hydroxide | 0.3 g |
| | Methanol | 62.8 g |
| | Preservative (2) | 0.8 g |
| Water phase | Decalcium-processed gelatin (Ca content: 100 ppm or less) | 10.0 g |
| | Preservative (1) | 0.04 g |
| | Water | 320 ml |

A gelatin dispersion of zinc hydroxide was prepared according to a formulation shown in Table 32. Namely, components were mixed and dissolved, and then dispersed for 30 minutes by a mill using glass beads having an average particle size of 0.75 μm. Further, the glass beads were removed to give a uniform dispersion.

TABLE 32

| | Dispersion composition |
|---|---|
| Zinc hydroxide | 15.9 g |
| Carboxymethylcellulose | 0.7 g |
| Sodium polyacrylate | 0.07 g |
| Lime-processed gelatin | 4.2 g |
| Water | 100 ml |
| Preservative (2) | 0.4 g |

Stabilizer (1)

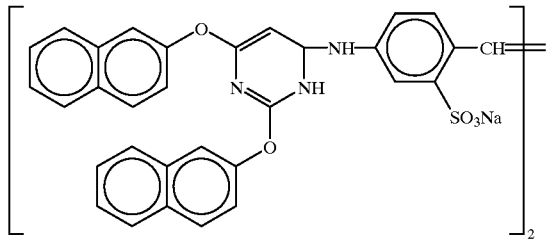

Preservative (1)

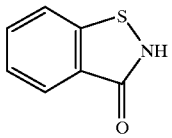

Preservative (2)

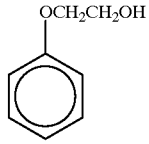

Then, a method for preparing a gelatin dispersion of a matting agent added to a protective layer is described. A solution obtained by dissolving PMMA in methylene chloride was added to gelatin together with a small amount of a surfactant. The mixture was stirred at high speed to be dispersed. Then, methylene chloride was removed by using a vacuum solvent removing apparatus to give a dispersion having an average particle sized of 4.3 μm.

Cyan coupler (15)

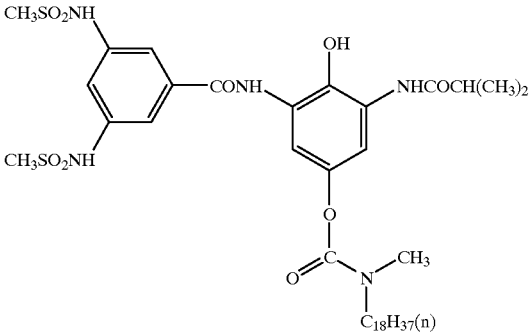

Magenta coupler (20)

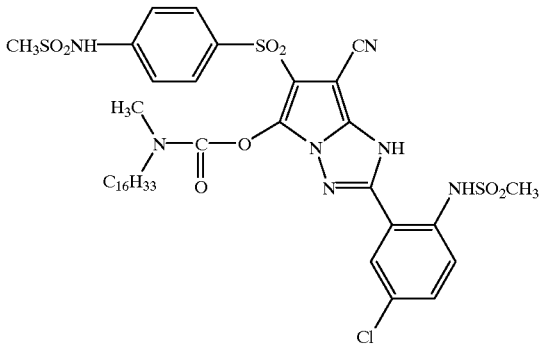

-continued

Yellow coupler (1)

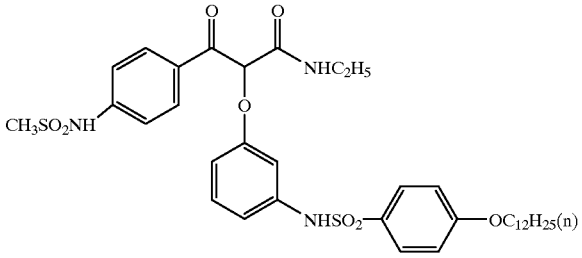

Developing agent (2)

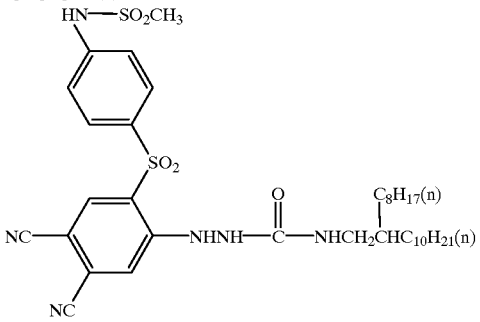

Antifoggant (5)

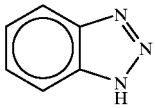

Antifoggant (2)

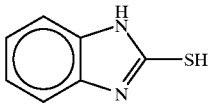

Solvent having high boiling point (4)

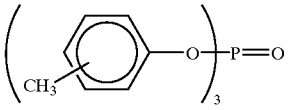

Preservative (1)

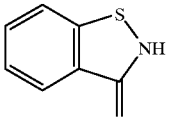

Reducing agent (1)

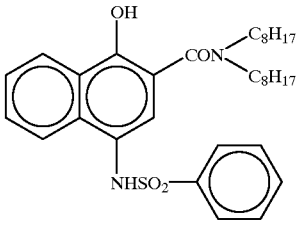

Antifoggant (3)

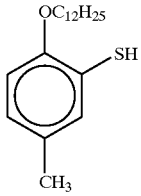

Antifoggant (4)

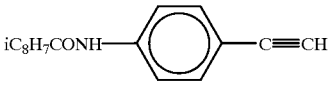

Surfactant (1)

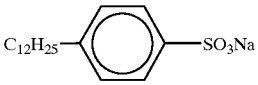

Solvent having high boiling point (1)

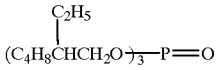

Solvent having high boiling point (2)

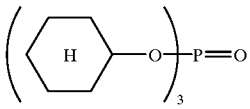

Preservative (1)

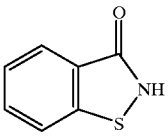

Reducing agent (2)

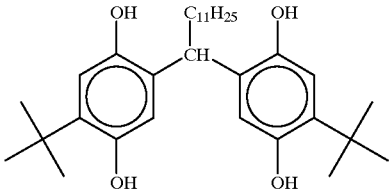

Surfactant (2)

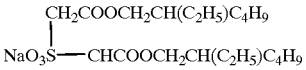

Surfactant (3)

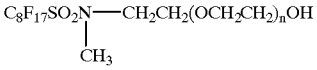

Water-soluble polymer (1)

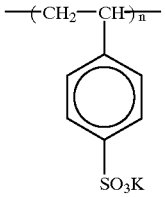

Intrinsic viscosity [η] = 1.6 (0.1N NaCl, 30° C.)
Molecular weight ≈ 1 million

Water-soluble polymer (2)

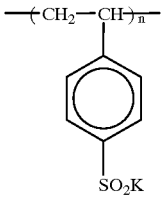

Intrinsic viscosity [η] = 0.8 (0.1N NaCl, 30° C.)
Molecular weight ≈ 0.4 million -continued Sensitizing dye (3)

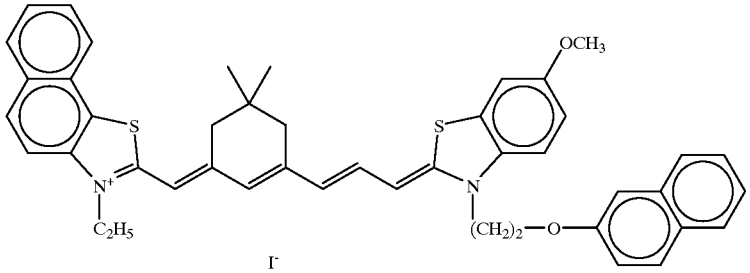

Film hardener (1)

$CH_2{=}CHSO_2CH_2SO_2CH{=}CH_2$

Surfactant (4)

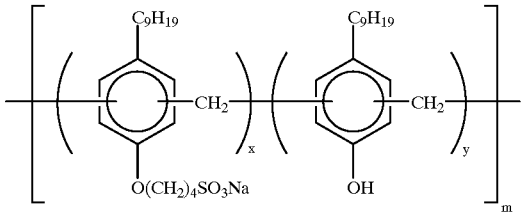

x:y = 4:6 m ≈ 6.8

Organic solvent having high boiling point (5)

$C_{28}H_{48.9}Cl_{7.1}$ En-Para 40 (manufactured by Ajinomoto Co., Inc.)

Polymer latex (a)

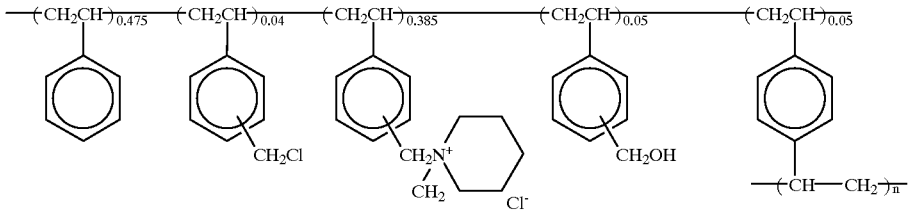

Surfactant (5)

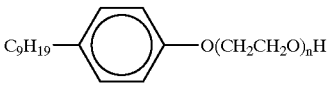

n = 50

Surfactant (6)

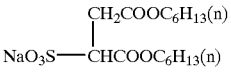

Developing agent (a)

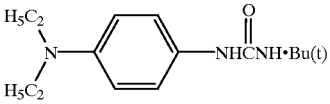

Compound described in JP-A No. 59-111,148

The above-described products were used to produce light-sensitive elements 201 shown in Table 33.

TABLE 33

Structure of main components of light-sensitive material R201

| Constituent layer | Layer name | Added substance | Amount added ($mg/m^2$) |
|---|---|---|---|
| 7th layer | Protective layer | Acid-processed gelatin | 442 |
| | | Reducing agent (2) | 47 |
| | | Solvent having high boiling point (1) | 30 |
| | | Colloidal silver particle | 2 |
| | | Matting agent (PMMA resin) | 17 |
| | | Surfactant (1) | 16 |
| | | Surfactant (2) | 9 |
| | | Surfactant (3) | 2 |

TABLE 33-continued

Structure of main components of light-sensitive material R201

| Constituent layer | Layer name | Added substance | Amount added ($mg/m^2$) |
|---|---|---|---|
| 6th layer | Intermediate layer | Lime-processed gelatin | 862 |
| | | Antifoggant (4) | 7 |
| | | Reducing agent (1) | 57 |
| | | Solvent having high boiling point (2) | 101 |
| | | Solvent having high boiling point (5) | 9 |
| | | Surfactant (1) | 21 |
| | | Surfactant (4) | 21 |
| | | Polymer latex (a) dispersion | 5 |
| | | Water-soluble polymer (1) | 4 |
| | | Calcium nitrate | 6 |
| 5th layer | Red light-sensitive layer | Lime-processed gelatine | 452 |
| | | Light-sensitive silver halide emulsion (1) | 301 |
| | | Magenta coupler (20) | 420 |
| | | Developing agent (2) | 336 |
| | | Antifoggant (2) | 15 |
| | | Solvent having high boiling point (2) | 444 |
| | | Surfactant (1) | 12 |
| | | Water-soluble polymer (1) | 10 |
| 4th layer | Intermediate layer | Lime-processed gelatin | 862 |
| | | Antifoggant (4) | 7 |
| | | Reducing agent (1) | 57 |
| | | Solvent having high boiling point (2) | 101 |
| | | Solvent having high boiling point (5) | 9 |
| | | Surfactant (1) | 21 |
| | | Surfactant (4) | 21 |
| | | Polymer latex (a) diseprsion | 5 |
| | | Water-soluble polymer (1) | 4 |
| | | Calcium nitrate | 6 |
| 3rd layer | Second Red light-sensitive layer | Lime-processed gelatin | 373 |
| | | Light-sensitive silver halide emulsion (2) | 106 |
| | | Cyan coupler (15) | 390 |
| | | Developing agent (2) | 312 |
| | | Antifoggant (2) | 14 |
| | | Solvent having high boiling point (5) | 412 |
| | | Surfactant (1) | 11 |
| | | Water-soluble polymer (1) | 11 |
| 2nd layer | Intermediate layer | Lime-processed gelatin | 862 |
| | | Antifoggant (4) | 7 |
| | | Reducing agent (1) | 57 |
| | | Solvent having high boiling point (2) | 101 |
| | | Solvent having high boiling point (5) | 9 |
| | | Surfactant (1) | 21 |
| | | Surfactant (4) | 21 |
| | | Water-soluble polymer (2) | 25 |
| | | Zinc hydroxide | 750 |
| | | Calcium nitrate | 6 |
| 1st layer | First Red light-sensitive layer | Lime-processed gelatin | 587 |
| | | Light-sensitive silver halide emulsion (3) | 311 |
| | | Yellow coupler (1) | 410 |
| | | Developing agent (2) | 328 |
| | | Antifoggant (2) | 15 |
| | | Solvent having high boiling point (4) | 433 |
| | | Surfactant (1) | 12 |
| | | Water-soluble polymer (2) | 40 |
| | | Film hardener (1) | 45 |

Support (support prepared by vapor deposition of aluminum on PET with a thickness of 20 $\mu$m and further coating of a gelatin primer on the surface)

Then, as comparative examples, light-sensitive elements 202 were prepared in the same manner as for the light-sensitive element 201 except that the developing agents of the dispersion in Table 27 were change to developing agent (a) in all Yellow, Magenta and Cyan.

Then, dye fixing materials were prepared containing the above-described light-sensitive material 201 and the compounds (II) to (VI) of the present invention as described in Table 34. With these dye fixing materials, image output was conducted at heating condition of 83° C. for 35 seconds by PICTOSTAT PG-3000 manufactured by Fuji Photo Film Co., Ltd. The resulted image was a clear color image. {Maximum concentration and minimum concentration were measured by using a reflection concentration meter X-lite 304 manufactured by X-lite Corp.}.

Further, the treated sample was left for 14 days at 40° C. under RH humidity of 80%, then, the minimum concentration was measured again, and increase in the concentration was measured by yellow concentration.

Regarding discoloration, a transparent film having a ultraviolet ray absorption layer was laminated on the film surface of the dye fixing material, and the color image was irradiated with xenon (100000 lux) for 10 days using Atlas C.I 65 weatherometer, then, the concentration was measured again, and percentage of the ratio of this measured value to the concentration directly after the treatment is shown as discoloration ratio.

Discoloration ratio=(concentration after left for 30 days)/(concentration directly after treatment)×100

The results are shown in Table 34. As apparent Table 34 shows that the compound of the present invention provides excellent photographic property and image fastness.

TABLE 34

| Light-sensitive element | Light-sensitive element | | | Image receiving element Discoloration preventing agent | Image fastness | | |
|---|---|---|---|---|---|---|---|
| | Hue | Developing agent | Coupler | | ΔDmin | Discoloration ratio % | Remarks |
| 202 | Y | (a) | C-5 | None | 0.71 | 64 | Comparative Example |
| | M | (a) | C-19 | | | 58 | |
| | C | (a) | C-17 | | | 50 | |
| 202 | Y | (a) | C-5 | II'-1 | 0.69 | 71 | Comparative Example |
| | M | (a) | C-19 | | | 66 | |
| | C | (a) | C-17 | | | 60 | |
| 201 | Y | (2) | (1) | None | 0.22 | 76 | Comparative Example |
| | M | (2) | (20) | | | 68 | |
| | C | (2) | (15) | | | 61 | |
| 201 | Y | (2) | (1) | II-6 | 0.1 | 90 | Present Invention |
| | M | (2) | (20) | | | 89 | |
| | C | (2) | (15) | | | 81 | |
| 201 | Y | (2) | (1) | II-8 | 0.06 | 91 | Present Invention |
| | M | (2) | (20) | | | 90 | |
| | C | (2) | (15) | | | 84 | |
| 201 | Y | (2) | (1) | II-12 | 0.08 | 92 | Present Invention |
| | M | (2) | (20) | | | 86 | |
| | C | (2) | (15) | | | 82 | |
| 201 | Y | (2) | (1) | II'-1 | 0.04 | 95 | Present Invention |
| | M | (2) | (20) | | | 94 | |
| | C | (2) | (15) | | | 90 | |
| 201 | Y | (2) | (1) | II'-5 | 0.04 | 90 | Present Invention |
| | M | (2) | (20) | | | 82 | |
| | C | (2) | (15) | | | 88 | |
| 201 | Y | (2) | (1) | II'-6 | 0.05 | 94 | Present Invention |
| | M | (2) | (20) | | | 95 | |
| | C | (2) | (15) | | | 89 | |
| 201 | Y | (2) | (1) | III-1 | 0.1 | 90 | Present Invention |
| | M | (2) | (20) | | | 91 | |
| | C | (2) | (15) | | | 89 | |
| 201 | Y | (2) | (1) | III-5 | 0.09 | 81 | Present Invention |
| | M | (2) | (20) | | | 89 | |
| | C | (2) | (15) | | | 83 | |
| 201 | Y | (2) | (1) | III-10 | 0.09 | 89 | Present Invention |
| | M | (2) | (20) | | | 88 | |
| | C | (2) | (15) | | | 84 | |
| 201 | Y | (2) | (1) | III'-2 | 0.09 | 92 | Present Invention |
| | M | (2) | (20) | | | 90 | |
| | C | (2) | (15) | | | 85 | |
| 201 | Y | (2) | (1) | III'-6 | 0.06 | 95 | Present Invention |
| | M | (2) | (20) | | | 93 | |
| | C | (2) | (15) | | | 90 | |
| 201 | Y | (2) | (1) | III'-17 | 0.07 | 96 | Present Invention |
| | M | (2) | (20) | | | 89 | |
| | C | (2) | (15) | | | 83 | |
| 201 | Y | (2) | (1) | IV-7 | 0.1 | 87 | Present Invention |
| | M | (2) | (20) | | | 81 | |
| | C | (2) | (15) | | | 80 | |
| 201 | Y | (2) | (1) | IV-12 | 0.06 | 87 | Present Invention |
| | M | (2) | (20) | | | 83 | |
| | C | (2) | (15) | | | 80 | |
| 201 | Y | (2) | (1) | IV-15 | 0.1 | 86 | Present Invention |
| | M | (2) | (20) | | | 84 | |
| | C | (2) | (15) | | | 80 | |
| 201 | Y | (2) | (1) | V-3 | 0.1 | 85 | Present Invention |
| | M | (2) | (20) | | | 80 | |
| | C | (2) | (15) | | | 82 | |
| 201 | Y | (2) | (1) | V-5 | 0.13 | 84 | Present Invention |
| | M | (2) | (20) | | | 89 | |
| | C | (2) | (15) | | | 80 | |

TABLE 34-continued

| Light-sensitive element | Light-sensitive element Hue | Developing agent | Coupler | Image receiving element Discoloration preventing agent | Image fastness ΔDmin | Discoloration ratio % | Remarks |
|---|---|---|---|---|---|---|---|
| 201 | Y | (2) | (1) | V-10 | 0.12 | 86 | Present Invention |
| | M | (2) | (20) | | | 87 | |
| | C | (2) | (15) | | | 82 | |
| 201 | Y | (2) | (1) | V-20 | 0.16 | 84 | Present Invention |
| | M | (2) | (20) | | | 83 | |
| | C | (2) | (15) | | | 77 | |
| 201 | Y | (2) | (1) | VI-2 | 0.17 | 83 | Present Invention |
| | M | (2) | (20) | | | 83 | |
| | C | (2) | (15) | | | 88 | |
| 222 | Y | (2) | (1) | VI-10 | 0.16 | 82 | Present Invention |
| | M | (2) | (20) | | | 87 | |
| | C | (2) | (15) | | | 82 | |
| 201 | Y | (2) | (1) | VI-16 | 0.14 | 82 | Present Invention |
| | M | (2) | (20) | | | 88 | |
| | C | (2) | (15) | | | 81 | |

What is claimed is:

1. A color diffusion transfer image forming material comprising a light-sensitive material and a dye-fixing material, wherein the light-sensitive material comprises a first support having thereon a light-sensitive silver halide, a binder, a first compound represented by general formula (I) described below, and a second compound which is a coupler that forms a diffusible dye by directly reacting with an oxidation product of the first compound, wherein the dye-fixing material comprises at least a dye-fixing layer, wherein the dye-fixing layer or an adjacent layer contains at least one of a third compound which is non-diffusible and organic solvent soluble and which is represented by general formula (V) or (VI) described below, and wherein the dye-fixing material is coated on the first support or on a separate support, and the light-sensitive material and the dye-fixing material are located so that the diffusible dye is transferred from the light-sensitive material to the dye-fixing material when the light-sensitive material is developed after exposure:

(I)

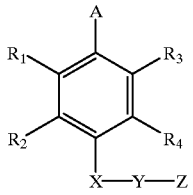

wherein each of $R_1$ to $R_4$ independently represents a hydrogen atom or substituent, A represents a hydroxyl group, X represents a group selected from the group consisting of —NHCO—, —NHSO—, —$NHSO_2$—, and —NHPO<, Y represents a divalent connecting group, Z represents a nucleophilic group which can attack X when oxidized, $R_1$ and $R_2$ may be linked to each other to form a ring, and $R_3$ and $R_4$ may be linked to each other to form a ring; and (V)

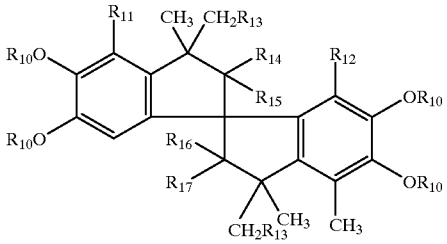

wherein $R_{10}$ represents an alkyl group, an alkenyl group, an aryl group, an aralkyl group, a heterocyclic group or group represented by $R_{18}CO$, $R_{19}SO_2$ or $R_{20}NHCO$ wherein each of $R_{18}$ to $R_{20}$ independently represents an alkyl group, an alkenyl group, an aryl group or a heterocyclic group, each of $R_{11}$ and $R_{12}$ independently represents a hydrogen atom, a halogen atom, an alkyl group, an alkenyl group, an alkoxy group or an alkenoxy group, and each of $R_{13}$ to $R_{17}$ independently represents a hydrogen atom, an alkyl group, an alkenyl group or an aryl group; or (VI)

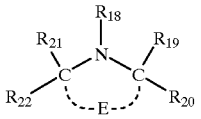

wherein

E represents a piperidine group, $R_{18}$ represents a hydrogen atom, an alkyl group, an alkenyl group, an alkynyl group, an acyl group, a sulfonyl group, a sulfinyl group, an oxyradical group or a hydroxyl group, and each of $R_{19}$, $R_{20}$, $R_{21}$ and $R_{22}$ independently represents a hydrogen atom or an alkyl group.

2. The image forming material according to claim 1, wherein Y in the general formula (I) is an alkylene group, an alkenylene group, an arylene group, a divalent heterocyclic group or an aralkylene group.

3. The image forming material according to claim 1, wherein the light-sensitive material is developed by heating in the presence of a base and/or a base precursor.

4. The image forming material according to claim 1, wherein the dye-fixing material is coated on the separate support, and wherein after the light-sensitive material is exposed, the dye-fixing material is located onto the light-sensitive material so that the dye-fixing layer faces the light-sensitive silver halide layer.

5. The image forming material according to claim 1, wherein each of $R_1$ to $R_4$ in the general formula (I) independently represents a hydrogen atom, a halogen atom, an alkyl group, an aryl group, a carbonamide group, a sulfonamide group, an alkoxy group, an aryloxy group, an alkylthio group, an arylthio group, a carbamoyl group, a sulfamoyl group, a cyano group, a sulfonyl group, an alkoxycarbonyl group, an aryloxycarbonyl group, an acyl group, an ureide group, an urethane group or an acyloxy group.

6. The image forming material according to claim 1, wherein $R_1$ and $R_4$ in the general formula (I) represent a hydrogen atom.

7. The image forming material according to claim 1, wherein when A in the general formula (I) represents a hydroxy group, the total of Hammett's constants $\sigma_p$ of $R_1$ to $R_4$ is 0 or more.

8. The image forming material according to claim 1, wherein when A in the general formula (I) represents a substituted amino group, the total of Hammett's constants $\sigma_p$ of $R_1$ to $R_4$ is 0 or less.

9. The image forming material according to claim 1, wherein X in the general formula (I) represents —NHCO—, —$NHSO_2$— or —NHPO<.

10. The image forming material according to claim 1, wherein Z in the general formula (I) is a group having a partial structure described by the following formula or a dissociated group thereof:

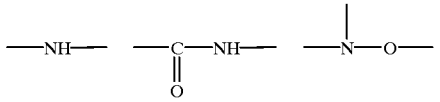

-continued

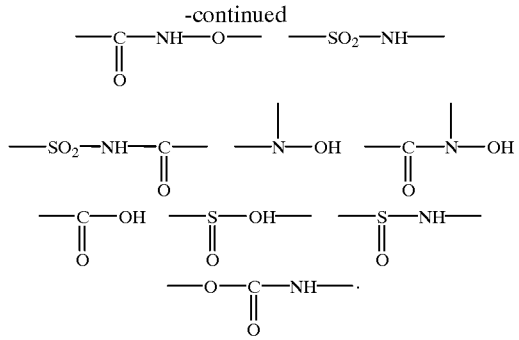

11. The image forming material according to claim 1, wherein Z in the general formula (I) is a group having a partial structure described by the following formula or a dissociated group thereof:

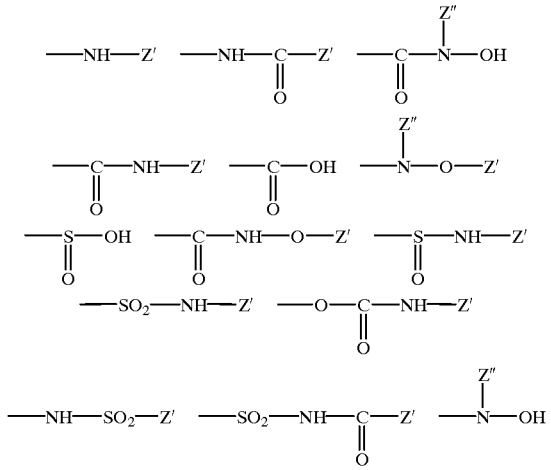

wherein each of Z' and Z" independently represents a hydrogen atom or substituent.

12. A color diffusion transfer image forming material as claimed in claim 2, wherein Y is methylene, 1,2-alkylene, 1,3-alkylene, 1,2-cycloalkylene, vinylene, 1,2-phenylene, 1,8-naphthylene, 2,3-pyridinediyl, or 1,2-phenylmethylene.

* * * * *